US011293309B2

(12) United States Patent
Bowan

(10) Patent No.: US 11,293,309 B2
(45) **Date of Patent: *Apr. 5, 2022**

(54) ACTIVE THRUST MANAGEMENT OF A TURBOPUMP WITHIN A SUPERCRITICAL WORKING FLUID CIRCUIT IN A HEAT ENGINE SYSTEM

(71) Applicant: ECHOGEN POWER SYSTEMS, L.L.C., Akron, OH (US)

(72) Inventor: Brett Bowan, Copley, OH (US)

(73) Assignee: ECHOGEN POWER SYSTEMS, LLC, Akron, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/800,420

(22) Filed: Feb. 25, 2020

(65) Prior Publication Data

US 2020/0208536 A1 Jul. 2, 2020

Related U.S. Application Data

(63) Continuation of application No. 15/523,485, filed as application No. PCT/US2015/057756 on Oct. 28, 2015, now Pat. No. 10,570,777.

(Continued)

(51) Int. Cl.
*F01D 25/22* (2006.01)
*F01D 15/08* (2006.01)

(Continued)

(52) U.S. Cl.
CPC ..... *F01D 25/22* (2013.01); *F01D 3/04* (2013.01); *F01D 15/08* (2013.01); *F01D 17/08* (2013.01);

(Continued)

(58) Field of Classification Search
CPC ..... F01K 7/32; F01D 25/22; F05D 2240/52
See application file for complete search history.

(56) References Cited

U.S. PATENT DOCUMENTS 1,433,883 A 10/1922 Friderich
1,969,526 A 2/1934 Rosch (Continued)

FOREIGN PATENT DOCUMENTS

CA 2794150 A1 11/2011
CN 1165238 A 11/1997

(Continued)

OTHER PUBLICATIONS

Alpy, N., et al., "French Atomic Energy Commission views as regards SCO2 Cycle Development priorities and related R&D approach," Presentation, Symposium on SCO2 Power Cycles, Apr. 29-30, 2009, Troy, NY, 20 pages.

(Continued)

*Primary Examiner* — Laert Dounis
(74) *Attorney, Agent, or Firm* — Nolte Lackenbach Siegel

(57) ABSTRACT

Aspects of the invention disclosed herein generally provide a heat engine system, a turbopump system, and methods for lubricating a turbopump while generating energy. The systems and methods provide proper lubrication and cooling to turbomachinery components by controlling pressures applied to a thrust bearing in the turbopump. The applied pressure on the thrust bearing may be controlled by a turbopump back-pressure regulator valve adjusted to maintain proper pressures within bearing pockets disposed on two opposing surfaces of the thrust bearing. Pocket pressure ratios, such as a turbine-side pocket pressure ratio (P1) and a pump-side pocket pressure ratio (P2), may be monitored and adjusted by a process control system. In order to prevent damage to the thrust bearing, the systems and methods may utilize advanced control theory of sliding mode, the multi- (Continued)

variables of the pocket pressure ratios P1 and P2, and regulating the bearing fluid to maintain a supercritical state.

26 Claims, 7 Drawing Sheets

Related U.S. Application Data

(60) Provisional application No. 62/074,192, filed on Nov. 3, 2014.

(51) Int. Cl.

| | |
|---|---|
| ***F01D 25/16*** | (2006.01) |
| ***F01K 7/32*** | (2006.01) |
| ***F01K 25/10*** | (2006.01) |
| ***F01K 23/02*** | (2006.01) |
| ***F01K 11/02*** | (2006.01) |
| ***F04D 29/047*** | (2006.01) |
| ***F04D 13/04*** | (2006.01) |
| ***F01D 3/04*** | (2006.01) |
| ***F04D 29/06*** | (2006.01) |
| ***F04D 29/041*** | (2006.01) |
| ***F01D 17/08*** | (2006.01) |
| ***F01D 25/10*** | (2006.01) |

(52) U.S. Cl.

CPC ..... *F01D 25/10* (2013.01); *F01D 25/168* (2013.01); *F01K 7/32* (2013.01); *F01K 11/02* (2013.01); *F01K 23/02* (2013.01); *F01K 25/10* (2013.01); *F01K 25/103* (2013.01); *F04D 13/04* (2013.01); *F04D 29/0413* (2013.01); *F04D 29/0473* (2013.01); *F04D 29/061* (2013.01); *F05D 2240/52* (2013.01); *F05D 2260/98* (2013.01)

(56) References Cited

U.S. PATENT DOCUMENTS

| | | | |
|---|---|---|---|
| 2,575,478 | A | 11/1951 | Wilson |
| 2,634,375 | A | 4/1953 | Guimbal |
| 2,691,280 | A | 10/1954 | Albert |
| 3,095,274 | A | 6/1963 | Crawford |
| 3,105,748 | A | 10/1963 | Stahl |
| 3,118,277 | A | 1/1964 | Wormser |
| 3,237,403 | A | 3/1966 | Feher |
| 3,277,955 | A | 10/1966 | Laszlo |
| 3,401,277 | A | 9/1968 | Larson |
| 3,620,584 | A | 11/1971 | Rosensweig |
| 3,622,767 | A | 11/1971 | Koepcke |
| 3,630,022 | A | 12/1971 | Jubb |
| 3,736,745 | A | 6/1973 | Karig |
| 3,772,879 | A | 11/1973 | Engdahl |
| 3,791,137 | A | 2/1974 | Jubb |
| 3,828,610 | A | 8/1974 | Swearingen |
| 3,830,062 | A | 8/1974 | Morgan et al. |
| 3,831,381 | A | 8/1974 | Swearingen |
| 3,939,328 | A | 2/1976 | Davis |
| 3,971,211 | A | 7/1976 | Wethe |
| 3,982,379 | A | 9/1976 | Gilli |
| 3,991,588 | A | 11/1976 | Laskaris |
| 3,998,058 | A | 12/1976 | Park |
| 4,005,580 | A | 2/1977 | Swearingen |
| 4,009,575 | A | 3/1977 | Hartman, Jr. |
| 4,015,962 | A | 4/1977 | Tompkins |
| 4,029,255 | A | 6/1977 | Heiser |
| 4,030,312 | A | 6/1977 | Wallin |
| 4,037,413 | A | 7/1977 | Heller et al. |
| 4,049,407 | A | 9/1977 | Bottum |
| 4,070,870 | A | 1/1978 | Bahel |
| 4,071,897 | A | 1/1978 | Groves, Jr. et al. |
| 4,099,381 | A | 7/1978 | Rappoport |
| 4,119,140 | A | 10/1978 | Cates |
| 4,150,547 | A | 4/1979 | Hobson |
| 4,152,901 | A | 5/1979 | Munters |
| 4,164,848 | A | 8/1979 | Gilli |
| 4,164,849 | A | 8/1979 | Mangus |
| 4,170,435 | A | 10/1979 | Swearingen |
| 4,178,762 | A | 12/1979 | Binstock et al. |
| 4,182,960 | A | 1/1980 | Reuyl |
| 4,183,220 | A | 1/1980 | Shaw |
| 4,198,827 | A | 4/1980 | Terry et al. |
| 4,208,882 | A | 6/1980 | Lopes |
| 4,221,185 | A | 9/1980 | Scholes |
| 4,233,085 | A | 11/1980 | Roderick |
| 4,236,869 | A | 12/1980 | Laurello |
| 4,245,476 | A | 1/1981 | Shaw |
| 4,248,049 | A | 2/1981 | Briley |
| 4,257,232 | A | 3/1981 | Bell |
| 4,287,430 | A | 9/1981 | Guido |
| 4,336,692 | A | 6/1982 | Ecker |
| 4,347,711 | A | 9/1982 | Noe |
| 4,347,714 | A | 9/1982 | Kinsell |
| 4,364,239 | A | 12/1982 | Chappelle et al. |
| 4,372,125 | A | 2/1983 | Dickenson |
| 4,374,467 | A | 2/1983 | Briley |
| 4,384,568 | A | 5/1983 | Palmatier |
| 4,390,082 | A | 6/1983 | Swearingen |
| 4,391,101 | A | 7/1983 | Labbe |
| 4,420,947 | A | 12/1983 | Yoshino |
| 4,428,190 | A | 1/1984 | Bronicki |
| 4,433,554 | A | 2/1984 | Rojey |
| 4,439,687 | A | 3/1984 | Wood |
| 4,439,994 | A | 4/1984 | Briley |
| 4,445,180 | A | 4/1984 | Davis |
| 4,448,033 | A | 5/1984 | Briccetti |
| 4,450,363 | A | 5/1984 | Russell |
| 4,455,836 | A | 6/1984 | Binstock |
| 4,467,609 | A | 8/1984 | Loomis |
| 4,467,621 | A | 8/1984 | O'Brien |
| 4,471,622 | A | 9/1984 | Kuwahara |
| 4,475,353 | A | 10/1984 | Lazare |
| 4,489,562 | A | 12/1984 | Snyder |
| 4,489,563 | A | 12/1984 | Kalina |
| 4,498,289 | A | 2/1985 | Osgerby |
| 4,507,936 | A | 4/1985 | Yoshino |
| 4,516,403 | A | 5/1985 | Tanaka |
| 4,538,960 | A | 9/1985 | Iino et al. |
| 4,549,401 | A | 10/1985 | Spliethoff |
| 4,555,905 | A | 12/1985 | Endou |
| 4,558,228 | A | 12/1985 | Larjola |
| 4,573,321 | A | 3/1986 | Knaebel |
| 4,578,953 | A | 4/1986 | Krieger |
| 4,589,255 | A | 5/1986 | Martens |
| 4,636,578 | A | 1/1987 | Feinberg |
| 4,665,975 | A | 5/1987 | Johnson |
| 4,674,297 | A | 6/1987 | Vobach |
| 4,694,189 | A | 9/1987 | Haraguchi |
| 4,697,981 | A | 10/1987 | Brown et al. |
| 4,700,543 | A | 10/1987 | Krieger |
| 4,730,977 | A | 3/1988 | Haaser |
| 4,756,162 | A | 7/1988 | Dayan |
| 4,765,143 | A | 8/1988 | Crawford |
| 4,773,212 | A | 9/1988 | Griffin |
| 4,798,056 | A | 1/1989 | Franklin |
| 4,813,242 | A | 3/1989 | Wicks |
| 4,821,514 | A | 4/1989 | Schmidt |
| 4,867,633 | A | 9/1989 | Gravelle |
| 4,884,942 | A | 12/1989 | Pennink |
| 4,888,954 | A | 12/1989 | Silvestri, Jr. |
| 4,892,459 | A | 1/1990 | Guelich |
| 4,986,071 | A | 1/1991 | Voss |
| 4,993,483 | A | 2/1991 | Harris |
| 5,000,003 | A | 3/1991 | Wicks |
| 5,050,375 | A | 9/1991 | Dickinson |
| 5,080,047 | A | 1/1992 | Williams et al. |
| 5,083,425 | A | 1/1992 | Hendriks et al. |
| 5,098,194 | A | 3/1992 | Kuo |
| 5,102,295 | A | 4/1992 | Pope |
| 5,104,284 | A | 4/1992 | Hustak, Jr. |
| 5,164,020 | A | 11/1992 | Wagner |

(56) References Cited

U.S. PATENT DOCUMENTS 5,176,321 A 1/1993 Doherty
5,203,159 A 4/1993 Koizumi et al.
5,228,310 A 7/1993 Vandenberg
5,248,239 A 9/1993 Andrews
5,291,509 A 3/1994 Mizoguchi et al.
5,291,960 A 3/1994 Brandenburg
5,320,482 A 6/1994 Palmer et al.
5,321,944 A 6/1994 Bronicki et al.
5,335,510 A 8/1994 Rockenfeller
5,358,378 A 10/1994 Holscher
5,360,057 A 11/1994 Rockenfeller
5,392,606 A 2/1995 Labinov
5,440,882 A 8/1995 Kalina
5,444,972 A 8/1995 Moore
5,483,797 A 1/1996 Rigal et al.
5,487,822 A 1/1996 Demaray et al.
5,488,828 A 2/1996 Brossard
5,490,386 A 2/1996 Keller
5,503,222 A 4/1996 Dunne
5,531,073 A 7/1996 Bronicki
5,538,564 A 7/1996 Kaschmitter
5,542,203 A 8/1996 Luoma
5,544,479 A 8/1996 Yan et al.
5,570,578 A 11/1996 Saujet
5,588,298 A 12/1996 Kalina
5,600,967 A 2/1997 Meckler
5,609,465 A 3/1997 Batson et al.
5,634,340 A 6/1997 Grennan
5,647,221 A 7/1997 Garris, Jr.
5,649,426 A 7/1997 Kalina
5,676,382 A 10/1997 Dahlheimer
5,680,753 A 10/1997 Hollinger
5,704,206 A 1/1998 Kaneko et al.
5,738,164 A 4/1998 Hildebrand
5,754,613 A 5/1998 Hashiguchi
5,771,700 A 6/1998 Cochran
5,782,081 A 7/1998 Pak et al.
5,789,822 A 8/1998 Calistrat
5,799,490 A 9/1998 Bronicki et al.
5,813,215 A 9/1998 Weisser
5,833,876 A 11/1998 Schnur
5,862,666 A 1/1999 Liu
5,873,260 A 2/1999 Linhardt
5,874,039 A 2/1999 Edelson
5,884,470 A 3/1999 Frutschi
5,894,836 A 4/1999 Wu
5,899,067 A 5/1999 Hageman
5,901,783 A 5/1999 Dobak, III et al.
5,903,060 A 5/1999 Norton
5,918,460 A 7/1999 Connell
5,941,238 A 8/1999 Tracy
5,943,869 A 8/1999 Cheng
5,946,931 A 9/1999 Lomax
5,954,342 A 9/1999 Mikhalev et al.
5,973,050 A 10/1999 Johnson
6,037,683 A 3/2000 Lulay
6,041,604 A 3/2000 Nicodemus
6,058,695 A 5/2000 Ranasinghe
6,058,930 A 5/2000 Shingleton
6,062,815 A 5/2000 Holt
6,065,280 A 5/2000 Ranasinghe
6,066,797 A 5/2000 Toyomura
6,070,405 A 6/2000 Jerye
6,082,110 A 7/2000 Rosenblatt
6,105,368 A 8/2000 Hansen
6,112,547 A 9/2000 Spauschus
6,129,507 A 10/2000 Ganelin
6,158,237 A 12/2000 Riffat
6,164,655 A 12/2000 Bothien
6,202,782 B1 3/2001 Hatanaka
6,223,846 B1 5/2001 Schechter
6,233,938 B1 5/2001 Nicodemus
6,233,955 B1 5/2001 Egara
6,282,900 B1 9/2001 Bell
6,282,917 B1 9/2001 Mongan
6,295,818 B1 10/2001 Ansley
6,298,653 B1 10/2001 Lawlor
6,299,690 B1 10/2001 Mongeon
6,341,781 B1 1/2002 Matz
6,347,520 B1 2/2002 Ranasinghe et al.
6,374,630 B1 4/2002 Jones
6,393,851 B1 5/2002 Wightman
6,432,320 B1 8/2002 Bonsignore
6,434,955 B1 8/2002 Ng
6,442,951 B1 9/2002 Maeda
6,446,425 B1 9/2002 Lawlor
6,446,465 B1 9/2002 Dubar
6,463,730 B1 10/2002 Keller
6,484,490 B1 11/2002 Olsen
6,490,812 B1 12/2002 Bennett et al.
6,530,224 B1 3/2003 Conchieri
6,539,720 B2 4/2003 Rouse et al.
6,539,728 B2 4/2003 Korin
6,563,855 B1 5/2003 Nishi et al.
6,571,548 B1 6/2003 Bronicki
6,581,384 B1 6/2003 Benson
6,588,499 B1 7/2003 Fahlsing
6,598,397 B2 7/2003 Hanna
6,644,062 B1 11/2003 Hays
6,657,849 B1 12/2003 Andresakis
6,668,554 B1 12/2003 Brown
6,684,625 B2 2/2004 Kline
6,695,974 B2 2/2004 Withers
6,715,294 B2 4/2004 Anderson
6,734,585 B2 5/2004 Tornquist
6,735,948 B1 5/2004 Kalina
6,739,142 B2 5/2004 Korin
6,751,959 B1 6/2004 McClanahan et al.
6,769,256 B1 8/2004 Kalina
6,799,892 B2 10/2004 Leuthold
6,808,179 B1 10/2004 Bhattacharyya
6,810,335 B2 10/2004 Lysaght
6,817,185 B2 11/2004 Coney
6,857,268 B2 2/2005 Stinger
6,892,522 B2 5/2005 Brasz et al.
6,910,334 B2 6/2005 Kalina
6,918,254 B2 7/2005 Baker
6,921,518 B2 7/2005 Johnston
6,941,757 B2 9/2005 Kalina
6,960,839 B2 11/2005 Zimron
6,960,840 B2 11/2005 Willis
6,962,054 B1 11/2005 Linney
6,962,056 B2 11/2005 Brasz et al.
6,964,168 B1 11/2005 Pierson
6,968,690 B2 11/2005 Kalina
6,986,251 B2 1/2006 Radcliff
7,013,205 B1 3/2006 Hafner et al.
7,021,060 B1 4/2006 Kalina
7,022,294 B2 4/2006 Johnston
7,033,553 B2 4/2006 Johnston
7,036,315 B2 5/2006 Kang
7,041,272 B2 5/2006 Keefer
7,047,744 B1 5/2006 Robertson
7,048,782 B1 5/2006 Couch
7,062,913 B2 6/2006 Christensen
7,096,665 B2 8/2006 Stinger
7,096,679 B2 8/2006 Manole
7,124,587 B1 10/2006 Linney
7,174,715 B2 2/2007 Armitage
7,194,863 B2 3/2007 Ganev
7,197,876 B1 4/2007 Kalina
7,200,996 B2 4/2007 Cogswell
7,234,314 B1 6/2007 Wiggs
7,249,588 B2 7/2007 Russell
7,278,267 B2 10/2007 Yamada
7,279,800 B2 10/2007 Bassett
7,287,381 B1 10/2007 Pierson
7,305,829 B2 12/2007 Mirolli
7,313,926 B2 1/2008 Gurin
7,340,894 B2 3/2008 Miyahara et al.
7,340,897 B2 3/2008 Zimron
7,343,746 B2 3/2008 Pierson
7,406,830 B2 8/2008 Valentian
7,416,137 B2 8/2008 Hagen et al.

(56) References Cited

U.S. PATENT DOCUMENTS 7,453,242 B2 11/2008 Ichinose
7,458,217 B2 12/2008 Kalina
7,458,218 B2 12/2008 Kalina
7,464,551 B2 12/2008 Althaus et al.
7,469,542 B2 12/2008 Kalina
7,516,619 B2 4/2009 Pelletier
7,600,394 B2 10/2009 Kalina
7,621,133 B2 11/2009 Tomlinson
7,654,354 B1 2/2010 Otterstrom
7,665,291 B2 2/2010 Anand
7,665,304 B2 2/2010 Sundel
7,673,681 B2 3/2010 Vinegar et al.
7,685,820 B2 3/2010 Litwin et al.
7,685,821 B2 3/2010 Kalina
7,730,713 B2 6/2010 Nakano
7,735,335 B2 6/2010 Uno
7,770,376 B1 8/2010 Brostmeyer
7,775,758 B2 8/2010 Legare
7,827,791 B2 11/2010 Pierson
7,838,470 B2 11/2010 Shaw
7,841,179 B2 11/2010 Kalina
7,841,306 B2 11/2010 Myers
7,854,587 B2 12/2010 Ito
7,866,157 B2 1/2011 Ernst
7,900,450 B2 3/2011 Gurin
7,950,230 B2 5/2011 Nishikawa
7,950,243 B2 5/2011 Gurin
7,971,424 B2 7/2011 Masada
7,972,529 B2 7/2011 Machado
7,997,076 B2 8/2011 Ernst
8,015,790 B2 9/2011 Zhang et al.
8,096,128 B2 1/2012 Held et al.
8,099,198 B2 1/2012 Gurin
8,099,972 B2 1/2012 Dupraz
8,146,360 B2 4/2012 Myers
8,235,647 B2 8/2012 Pisseloup et al.
8,281,593 B2 10/2012 Held
8,289,710 B2 10/2012 Spearing et al.
8,297,065 B2 10/2012 Vaisman et al.
8,375,719 B2 2/2013 Rhodes et al.
8,387,248 B2 3/2013 Rolt et al.
8,419,936 B2 4/2013 Berger et al.
8,544,274 B2 10/2013 Ernst
8,613,195 B2 12/2013 Held et al.
8,661,820 B2 3/2014 Mak
8,813,497 B2 8/2014 Hart et al.
8,820,083 B2 9/2014 Davidson et al.
8,869,531 B2 10/2014 Held
8,973,398 B2 3/2015 Coyle
9,038,390 B1 5/2015 Kreuger
9,180,421 B2 11/2015 Kwang et al.
9,523,312 B2 12/2016 Allam et al.
9,638,065 B2 5/2017 Vermeersch et al.
9,810,451 B2 11/2017 O'Donnell et al.
9,845,667 B2 12/2017 Mokheimer et al.
9,874,112 B2 1/2018 Giegel
9,932,861 B2 4/2018 Preuss et al.
10,077,683 B2 9/2018 Close
2001/0015061 A1 8/2001 Viteri et al.
2001/0020444 A1 9/2001 Johnston
2001/0027642 A1 10/2001 Tsuji
2001/0030952 A1 10/2001 Roy
2002/0029558 A1 3/2002 Tamaro
2002/0053196 A1 5/2002 Lerner et al.
2002/0066270 A1 6/2002 Rouse et al.
2002/0078696 A1 6/2002 Korin
2002/0078697 A1 6/2002 Lifson
2002/0082747 A1 6/2002 Kramer
2002/0148225 A1 10/2002 Lewis
2003/0000213 A1 1/2003 Christensen
2003/0061823 A1 4/2003 Alden
2003/0154718 A1 8/2003 Nayar
2003/0182946 A1 10/2003 Sami
2003/0213246 A1 11/2003 Coll et al.
2003/0221438 A1 12/2003 Rane et al.
2004/0011038 A1 1/2004 Stinger
2004/0011039 A1 1/2004 Stinger et al.
2004/0020185 A1 2/2004 Brouillette et al.
2004/0020206 A1 2/2004 Sullivan et al.
2004/0021182 A1 2/2004 Green et al.
2004/0035117 A1 2/2004 Rosen
2004/0083731 A1 5/2004 Lasker
2004/0083732 A1 5/2004 Hanna et al.
2004/0088992 A1 5/2004 Brasz et al.
2004/0097388 A1 5/2004 Brask et al.
2004/0105980 A1 6/2004 Sudarshan et al.
2004/0107700 A1 6/2004 McClanahan et al.
2004/0159110 A1 8/2004 Janssen
2004/0211182 A1 10/2004 Gould
2004/0247211 A1 12/2004 Hamke
2005/0022963 A1 2/2005 Garrabrant et al.
2005/0056001 A1 3/2005 Frutschi
2005/0072182 A1 4/2005 Taniguchi et al.
2005/0096676 A1 5/2005 Gifford et al.
2005/0109387 A1 5/2005 Marshall
2005/0118025 A1 6/2005 Hiegemann et al.
2005/0137777 A1 6/2005 Kolavennu et al.
2005/0162018 A1 7/2005 Realmuto et al.
2005/0167169 A1 8/2005 Gering et al.
2005/0183421 A1 8/2005 Vaynberg et al.
2005/0196676 A1 9/2005 Singh et al.
2005/0198959 A1 9/2005 Schubert
2005/0227187 A1 10/2005 Schilling
2005/0252235 A1 11/2005 Critoph et al.
2005/0257812 A1 11/2005 Wright et al.
2005/0262848 A1 12/2005 Joshi et al.
2005/0276685 A1 12/2005 Wiggins et al.
2006/0010868 A1 1/2006 Smith
2006/0060333 A1 3/2006 Chordia et al.
2006/0066113 A1 3/2006 Ebrahim et al.
2006/0080960 A1 4/2006 Rajendran et al.
2006/0112693 A1 6/2006 Sundel
2006/0112702 A1 6/2006 Martin et al.
2006/0182680 A1 8/2006 Keefer et al.
2006/0211871 A1 9/2006 Dai et al.
2006/0213218 A1 9/2006 Uno et al.
2006/0222523 A1 10/2006 Valentian et al.
2006/0225421 A1 10/2006 Yamanaka et al.
2006/0225459 A1 10/2006 Meyer
2006/0249020 A1 11/2006 Tonkovich et al.
2006/0254281 A1 11/2006 Badeer et al.
2007/0001766 A1 1/2007 Ripley et al.
2007/0007771 A1 1/2007 Biddle et al.
2007/0017192 A1 1/2007 Bednarek et al.
2007/0019708 A1 1/2007 Shiflett et al.
2007/0027038 A1 2/2007 Kamimura et al.
2007/0056290 A1 3/2007 Dahm
2007/0089449 A1 4/2007 Gurin
2007/0108200 A1 5/2007 McKinzie, II
2007/0119175 A1 5/2007 Ruggieri et al.
2007/0130952 A1 6/2007 Copen
2007/0151244 A1 7/2007 Gurin
2007/0161095 A1 7/2007 Gurin
2007/0163261 A1 7/2007 Strathman
2007/0195152 A1 8/2007 Kawai et al.
2007/0204620 A1 9/2007 Pronske et al.
2007/0116299 A1 10/2007 Energies
2007/0227472 A1 10/2007 Takeuchi et al.
2007/0234722 A1 10/2007 Kalina
2007/0245733 A1 10/2007 Pierson et al.
2007/0246206 A1 10/2007 Gong et al.
2008/0000225 A1 1/2008 Kalina
2008/0006040 A1 1/2008 Peterson et al.
2008/0010967 A1 1/2008 Griffin et al.
2008/0023666 A1 1/2008 Gurin
2008/0053095 A1 3/2008 Kalina
2008/0066470 A1 3/2008 MacKnight
2008/0135253 A1 6/2008 Vinegar et al.
2008/0163618 A1 7/2008 Paul
2008/0163625 A1 7/2008 O'Brien
2008/0173444 A1 7/2008 Stone et al.
2008/0173450 A1 7/2008 Goldberg et al.
2008/0174115 A1 7/2008 Lambirth
2008/0211230 A1 9/2008 Gurin

(56) References Cited

U.S. PATENT DOCUMENTS

| | | | |
|---|---|---|---|
| 2008/0217321 | A1 | 9/2008 | Vinegar et al. |
| 2008/0250789 | A1 | 10/2008 | Myers et al. |
| 2008/0252078 | A1 | 10/2008 | Myers |
| 2008/0282702 | A1 | 11/2008 | Collins |
| 2008/0282715 | A1 | 11/2008 | Aue et al. |
| 2009/0021251 | A1 | 1/2009 | Simon |
| 2009/0071156 | A1 | 3/2009 | Nishikawa et al. |
| 2009/0085709 | A1 | 4/2009 | Meinke |
| 2009/0107144 | A1 | 4/2009 | Moghtaderi et al. |
| 2009/0139234 | A1 | 6/2009 | Gurin |
| 2009/0139781 | A1 | 6/2009 | Straubel |
| 2009/0173337 | A1 | 7/2009 | Tamaura et al. |
| 2009/0173486 | A1 | 7/2009 | Copeland |
| 2009/0180903 | A1 | 7/2009 | Martin et al. |
| 2009/0205892 | A1 | 8/2009 | Jensen et al. |
| 2009/0211251 | A1 | 8/2009 | Peterson et al. |
| 2009/0211253 | A1 | 8/2009 | Radcliff et al. |
| 2009/0257902 | A1 | 10/2009 | Ernens |
| 2009/0266075 | A1 | 10/2009 | Westmeier et al. |
| 2009/0293503 | A1 | 12/2009 | Vandor |
| 2009/0320477 | A1 | 12/2009 | Juchymenko |
| 2010/0024421 | A1 | 2/2010 | Litwin |
| 2010/0077792 | A1 | 4/2010 | Gurin |
| 2010/0083662 | A1 | 4/2010 | Kalina |
| 2010/0102008 | A1 | 4/2010 | Hedberg |
| 2010/0122533 | A1 | 5/2010 | Kalina |
| 2010/0143094 | A1 | 6/2010 | Pisseloup et al. |
| 2010/0146949 | A1 | 6/2010 | Stobart et al. |
| 2010/0146973 | A1 | 6/2010 | Kalina |
| 2010/0156112 | A1 | 6/2010 | Held et al. |
| 2010/0162721 | A1 | 7/2010 | Welch et al. |
| 2010/0205962 | A1 | 8/2010 | Kalina |
| 2010/0212316 | A1 | 8/2010 | Waterstripe et al. |
| 2010/0218513 | A1 | 9/2010 | Vaisman et al. |
| 2010/0218930 | A1 | 9/2010 | Proeschel |
| 2010/0263380 | A1 | 10/2010 | Biederman et al. |
| 2010/0287920 | A1 | 11/2010 | Duparchy |
| 2010/0287934 | A1 | 11/2010 | Glynn et al. |
| 2010/0300093 | A1 | 12/2010 | Doty |
| 2010/0319346 | A1 | 12/2010 | Ast et al. |
| 2010/0326076 | A1 | 12/2010 | Ast et al. |
| 2011/0027064 | A1 | 2/2011 | Pal et al. |
| 2011/0030404 | A1 | 2/2011 | Gurin |
| 2011/0048012 | A1 | 3/2011 | Ernst et al. |
| 2011/0051880 | A1 | 3/2011 | Al-Mayahi et al. |
| 2011/0061384 | A1 | 3/2011 | Held et al. |
| 2011/0061387 | A1 | 3/2011 | Held et al. |
| 2011/0088399 | A1 | 4/2011 | Briesch et al. |
| 2011/0100002 | A1 | 5/2011 | Muir et al. |
| 2011/0113781 | A1 | 5/2011 | Frey et al. |
| 2011/0164957 | A1 | 7/2011 | Rivas et al. |
| 2011/0179799 | A1 | 7/2011 | Allam et al. |
| 2011/0185729 | A1 | 8/2011 | Held |
| 2011/0192163 | A1 | 8/2011 | Kasuya |
| 2011/0203278 | A1 | 8/2011 | Kopecek et al. |
| 2011/0214424 | A1 | 9/2011 | Wood |
| 2011/0219760 | A1 | 9/2011 | McBride et al. |
| 2011/0259010 | A1 | 10/2011 | Bronicki et al. |
| 2011/0270451 | A1 | 11/2011 | Sakaguchi et al. |
| 2011/0288688 | A1 | 11/2011 | Lehan |
| 2011/0299972 | A1 | 12/2011 | Morris |
| 2011/0308253 | A1 | 12/2011 | Ritter |
| 2012/0042650 | A1 | 2/2012 | Ernst et al. |
| 2012/0027688 | A1 | 3/2012 | Yin et al. |
| 2012/0047892 | A1 | 3/2012 | Held et al. |
| 2012/0055153 | A1 | 3/2012 | Murata et al. |
| 2012/0067046 | A1 | 3/2012 | Drenik et al. |
| 2012/0067055 | A1 | 3/2012 | Held |
| 2012/0047889 | A1 | 4/2012 | Yarpour |
| 2012/0111003 | A1 | 5/2012 | Kasuya et al. |
| 2012/0125002 | A1 | 5/2012 | Lehar et al. |
| 2012/0128463 | A1 | 5/2012 | Held |
| 2012/0131918 | A1 | 5/2012 | Held |
| 2012/0131919 | A1 | 5/2012 | Held |
| 2012/0131920 | A1 | 5/2012 | Held |
| 2012/0131921 | A1 | 5/2012 | Held |
| 2012/0159922 | A1 | 6/2012 | Gurin |
| 2012/0159956 | A1 | 6/2012 | Gurin |
| 2012/0167873 | A1 | 7/2012 | Venetos et al. |
| 2012/0174558 | A1 | 7/2012 | Gurin |
| 2012/0186219 | A1 | 7/2012 | Gurin |
| 2012/0240616 | A1 | 9/2012 | Ritter et al. |
| 2012/0247134 | A1 | 10/2012 | Gurin |
| 2012/0247455 | A1 | 10/2012 | Gurin et al. |
| 2012/0255304 | A1 | 10/2012 | Li et al. |
| 2012/0261090 | A1 | 10/2012 | Durmaz et al. |
| 2012/0261104 | A1 | 10/2012 | Kelly et al. |
| 2012/0306206 | A1 | 12/2012 | Agrawal et al. |
| 2012/0319410 | A1 | 12/2012 | Ambrosek et al. |
| 2013/0019597 | A1 | 1/2013 | Kalina |
| 2013/0033037 | A1 | 2/2013 | Held et al. |
| 2013/0036736 | A1 | 2/2013 | Hart et al. |
| 2013/0074497 | A1 | 3/2013 | Mori et al. |
| 2013/0087301 | A1 | 4/2013 | Hemrle et al. |
| 2013/0113221 | A1 | 5/2013 | Held |
| 2013/0134720 | A1 | 5/2013 | Fukasaku et al. |
| 2013/0145759 | A1 | 6/2013 | Sonwane et al. |
| 2014/0041387 | A1 | 2/2014 | Benson |
| 2014/0090405 | A1 | 4/2014 | Held et al. |
| 2014/0102098 | A1 | 4/2014 | Bowan et al. |
| 2014/0102103 | A1 | 4/2014 | Yamamoto et al. |
| 2014/0150992 | A1 | 6/2014 | Koontz et al. |
| 2014/0208750 | A1 | 7/2014 | Vermeersch |
| 2014/0208751 | A1 | 7/2014 | Bowan |
| 2014/0216034 | A1 | 8/2014 | Numata et al. |
| 2014/0223907 | A1 | 8/2014 | Fujioka et al. |
| 2015/0069758 | A1 | 3/2015 | Davidson et al. |
| 2015/0369086 | A1 | 12/2015 | Johnson et al. |
| 2016/0017759 | A1 | 1/2016 | Gayawal et al. |
| 2016/0040557 | A1 | 2/2016 | Vermeersch et al. |
| 2016/0102608 | A1 | 4/2016 | Lynn |
| 2016/0237904 | A1 | 8/2016 | Scarboro et al. |
| 2017/0058202 | A1 | 3/2017 | Noureldin et al. |
| 2017/0350658 | A1 | 12/2017 | Kerth et al. |
| 2017/0362963 | A1 | 12/2017 | Hostler et al. |
| 2018/0187628 | A1 | 7/2018 | Apte |
| 2018/0340712 | A1 | 11/2018 | Peter et al. |
| 2019/0170026 | A1 | 6/2019 | Matsukuma et al. |
| 2020/0003081 | A1 | 1/2020 | Held |

FOREIGN PATENT DOCUMENTS

| | | | |
|---|---|---|---|
| CN | 1432102 | A | 7/2003 |
| CN | 101614139 | A | 12/2009 |
| CN | 202055876 | U | 11/2011 |
| CN | 202544943 | U | 11/2012 |
| CN | 202718721 | U | 2/2013 |
| DE | 2632777 | A1 | 2/1977 |
| DE | 19906087 | A1 | 8/2000 |
| DE | 10052993 | A1 | 5/2002 |
| DE | 102007020086 | B3 | 4/2007 |
| DE | 10 2011005722 | B3 | 3/2011 |
| EP | 0003980 | A1 | 2/1979 |
| EP | 0286565 | A2 | 4/1988 |
| EP | 1484489 | A2 | 8/2004 |
| EP | 1577549 | A1 | 9/2005 |
| EP | 1977174 | A2 | 10/2008 |
| EP | 1998013 | A2 | 12/2008 |
| EP | 2312129 | A1 | 4/2011 |
| EP | 2357324 | A2 | 9/2011 |
| EP | 2390473 | A1 | 11/2011 |
| EP | 2419621 | A1 | 2/2012 |
| EP | 2446122 | A1 | 5/2012 |
| EP | 2478201 | A1 | 7/2012 |
| EP | 2500530 | A1 | 9/2012 |
| EP | 2550436 | A1 | 1/2013 |
| EP | 2698506 | A1 | 2/2014 |
| GB | 856985 | A | 12/1960 |
| GB | 2010974 | A | 7/1979 |
| GB | 2075608 | A | 11/1981 |
| JP | 58-193051 | A | 11/1983 |
| JP | 60-040707 | A | 3/1985 |
| JP | 61-152914 | A | 7/1986 |
| JP | 01-240705 | A | 9/1989 |

(56) References Cited

FOREIGN PATENT DOCUMENTS

| | | | |
|---|---|---|---|
| JP | H03182638 | A | 8/1991 |
| JP | 05-321612 | A | 12/1993 |
| JP | 05-321648 | A | 12/1993 |
| JP | 06-331225 | A | 11/1994 |
| JP | 08-028805 | A | 2/1996 |
| JP | 09-100702 | A | 4/1997 |
| JP | 2641581 | B2 | 5/1997 |
| JP | 09-209716 | A | 8/1997 |
| JP | 2858750 | B2 | 12/1998 |
| JP | H11-270352 | | 5/1999 |
| JP | 2000-257407 | A | 9/2000 |
| JP | 3119718 | B2 | 12/2000 |
| JP | JP 3119718 | B2 | 12/2000 |
| JP | 2001-193419 | A | 7/2001 |
| JP | 2002-097965 | A | 4/2002 |
| JP | 2003-529715 | A | 10/2003 |
| JP | 2004-239250 | A | 8/2004 |
| JP | 2004-332626 | A | 11/2004 |
| JP | 2005-030727 | A | 2/2005 |
| JP | 2005-533972 | A1 | 11/2005 |
| JP | 2006-037760 | A | 2/2006 |
| JP | 2006-177266 | A | 7/2006 |
| JP | 2007-198200 | A | 9/2007 |
| JP | 4343738 | B2 | 10/2009 |
| JP | 2011-017268 | A | 1/2011 |
| KR | 100191080 | | 6/1999 |
| KR | 10 2007 0086244 | A | 8/2007 |
| KR | 10-0766101 | B1 | 10/2007 |
| KR | 10-0844634 | A | 7/2008 |
| KR | 10-20100067927 | A | 6/2010 |
| KR | 1020110018769 | A | 2/2011 |
| KR | 1069914 | B1 | 9/2011 |
| KR | 1103549 | B1 | 1/2012 |
| KR | 10-2012-0058582 | A | 6/2012 |
| KR | 2012-0068670 | A | 6/2012 |
| KR | 2012-0128753 | A | 11/2012 |
| KR | 2012-0128755 | A | 11/2012 |
| WO | WO 1991/05145 | A1 | 4/1991 |
| WO | WO 92/12366 | A1 | 7/1992 |
| WO | WO 1996/009500 | A1 | 3/1996 |
| WO | WO 00-71944 | A1 | 11/2000 |
| WO | WO 2001/044658 | A1 | 6/2001 |
| WO | WO 02/090721 | A1 | 11/2002 |
| WO | WO 02/090747 | A2 | 11/2002 |
| WO | WO 2006/060253 | | 6/2006 |
| WO | WO 2006/137957 | A1 | 12/2006 |
| WO | WO 2007/056241 | A2 | 5/2007 |
| WO | WO 2007/079245 | A2 | 7/2007 |
| WO | WO 2007/082103 | A2 | 7/2007 |
| WO | WO 2007/112090 | A2 | 10/2007 |
| WO | WO 2008014774 | A2 | 2/2008 |
| WO | WO 2008/039725 | A2 | 4/2008 |
| WO | WO 2008/101711 | A2 | 8/2008 |
| WO | WO 2009/045196 | A1 | 4/2009 |
| WO | WO 2009/058992 | A2 | 5/2009 |
| WO | WO 2010/017981 | A2 | 2/2010 |
| WO | WO 2010/017981 | A3 | 2/2010 |
| WO | WO 2010/074173 | A1 | 7/2010 |
| WO | WO 2010/083198 | A1 | 7/2010 |
| WO | WO 2010/121255 | A1 | 10/2010 |
| WO | WO 2010/126980 | A2 | 11/2010 |
| WO | WO 2010/151560 | A1 | 12/2010 |
| WO | WO 2011/017450 | A2 | 2/2011 |
| WO | WO 2011/017476 | A1 | 2/2011 |
| WO | WO 2011/017599 | A1 | 2/2011 |
| WO | WO 2011/034984 | A1 | 3/2011 |
| WO | WO 2011/094294 | A2 | 8/2011 |
| WO | WO 2011/119650 | A2 | 9/2011 |
| WO | WO 2012/036678 | A1 | 3/2012 |
| WO | WO 2012/074905 | A2 | 6/2012 |
| WO | WO 2012/074907 | A2 | 6/2012 |
| WO | WO 2012/074911 | A2 | 6/2012 |
| WO | WO 2012/074940 | A2 | 6/2012 |
| WO | WO 2013/055391 | A1 | 4/2013 |
| WO | WO 2013/059687 | A1 | 4/2013 |
| WO | WO 2013/059695 | A1 | 4/2013 |
| WO | WO 2013/070249 | A1 | 5/2013 |
| WO | WO 2013/074907 | A1 | 5/2013 |
| WO | WO 2014/164620 | A1 | 3/2014 |
| WO | WO 2014/138035 | A1 | 9/2014 |
| WO | WO 2014/159520 | A1 | 10/2014 |
| WO | WO 2018/217969 | A1 | 11/2018 |

OTHER PUBLICATIONS

Angelino, G., and Invernizzi, C.M., "Carbon Dioxide Power Cycles using Liquid Natural Gas as Heat Sink", Applied Thermal Engineering Mar. 3, 2009, 43 pages.

Bryant, John C., Saari, Henry, and Zanganeh, Kourosh, "An Analysis and Comparison of the Simple and Recompression Supercritical CO2 Cycles" Supercritical CO2 Power Cycle Symposium, May 24-25, 2011, Boulder, CO, 8 pages.

Chapman, Daniel J., Arias, Diego A., "An Assessment of the Supercritical Carbon Dioxide Cycle for Use in a Solar Parabolic Trough Power Plant", Presentation, Abengoa Solar, Apr. 29-30, 2009, Troy, NY, 20 pages.

Chapman, Daniel J., Arias, Diego A., "An Assessment of the Supercritical Carbon Dioxide Cycle for Use in a Solar Parabolic Trough Power Plant", Paper, Abengoa Solar, Apr. 29-30, 2009, Troy, NY, 5 pages.

Chen, Yang, Lundqvist, P., Johansson, A., Platell, P., "A Comparative Study of the Carbon Dioxide Transcritical Power Cycle Compared with an Organic Rankine Cycle with R123 as Working Fluid in Waste Heat Recovery", Science Direct, Applied Thermal Engineering, Jun. 12, 2006, 6 pages.

Chen, Yang, "Thermodynamic Cycles Using Carbon Dioxide as Working Fluid", Doctoral Thesis, School of Industrial Engineering and Management, Stockholm, Oct. 2011, 150 pages., (3 parts).

Chinese Search Report for Application No. 201080035382.1, 2 pages.

Chinese Search Report for Application No. 201080050795.7, 2 pages.

Chordia, Lalit, "Optimizing Equipment for Supercritical Applications", Thar Energy LLC, Supercritical CO2 Power Cycle Symposium, May 24-25, 2011, Boulder, CO, 7 pages.

Colegrove, et al., "Structured Steam Turbines for the Combined-Cycle Market", GE Power Systems, GER-4201, May 2001, 18 pages.

Combs, Osie V., "An Investigation of the Supercritical CO2 Cycle (Feher cycle) for Shipboard Application", Massachusetts Institute of Technology, May 1977, 290 pages.

Di Bella, Francis A., "Gas Turbine Engine Exhaust Waste Heat Recovery Navy Shipboard Module Development", Supercritical CO2 Power Cycle Symposium, May 24-25, 2011, Boulder, CO, 8 pages.

Dostal, V., et al., A Supercritical Carbon Dioxide Cycle for Next Generation Nuclear Reactors, Mar. 10, 2004, 326 pages., (7 parts).

Dostal, Vaclav and Kulhanek, Martin, "Research on the Supercritical Carbon Dioxide Cycles in the Czech Republic", Czech Technical University in Prague, Symposium on SCO2 Power Cycles, Apr. 29-30, 2009, Troy, NY, 8 pages.

Dostal, Vaclav, and Dostal, Jan, "Supercritical CO2 Regeneration Bypass Cycle—Comparison to Traditional Layouts", Supercritical CO2 Power Cycle Symposium, May 24-25, 2011, Boulder, CO, 5 pages.

Ebenezer, Salako A.; "Removal of Carbon Dioxide from Natural Gas for LNG Production", Institute of Petroleum Technology Norwegian University of Science and Technology, Dec. 2005, Trondheim, Norway, 74 pages.

Eisemann, Kevin, and Fuller, Robert L., "Supercritical CO2 Brayton Cycle Design and System Start-up Options", Barber Nichols, Inc., Paper, Supercritical CO2 Power Cycle Symposium, May 24-25, 2011, Boulder, CO, 7 pages.

Eisemann, Kevin, and Fuller, Robert L., "Supercritical CO2 Brayton Cycle Design and System Start-up Options", Presentation, Supercritical CO2 Power Cycle Symposium, May 24-25, 2011, Boulder, CO, 11 pages.

(56) References Cited

OTHER PUBLICATIONS

Feher, E.G., et al., "Investigation of Supercritical (Feher) Cycle", Astropower Laboratory, Missile & Space Systems Division, Oct. 1968, 152 pages.
Fuller, Robert L., and Eisemann, Kevin, "Centrifugal Compressor Off-Design Performance for Super-Critical CO2", Barber Nichols, Inc. Presentation, Supercritical CO2 Power Cycle Symposium, May 24-25, 2011, Boulder, CO, 20 pages.
Fuller, Robert L., and Eisemann, Kevin, "Centrifugal Compressor Off-Design Performance for Super-Critical CO2", Paper, Supercritical CO2 Power Cycle Symposium, May 24-25, 2011, Boulder, CO, 12 pages.
Gokhstein, D.P. and Verkhivker, G.P. "Use of Carbon Dioxide as a Heat Carrier and Working Substance in Atomic Power Stations", Soviet Atomic Energy, Apr. 1969, vol. 26, Issue 4, pp. 430-432.
Gokhstein, D.P.; Taubman, E.I.; Konyaeva, G.P., "Thermodynamic Cycles of Carbon Dioxide Plant with an Additional Turbine After the Regenerator", Energy Citations Database, Mar. 1973, 1 Page, Abstract only.
Gowrishankar, K., "Adaptive Fuzzy Controller to Control Turbine Speed", Rajiv Gandhi College of Engg. & tech., Puducherry, India, 7 pages.
Hjartarson, Heimir; "Waste Heat Utilization at Elkem Ferrosilicon Plant in Iceland", University of Iceland, 2009, 102 pages.
Hjartarson, et al.; "Waste Heat Utilization from a Submerged ARC Furnace Producing Ferrosilicon", The Twelfth International Ferroalloys Congress Sustainable Future;, Helsinki, Finland ,Jun. 6-9, 2010, 10 pages.
Hejzlar, P. et al., "Assessment of Gas Cooled Gas Reactor with Indirect Supercritical CO2 Cycle" Massachusetts Institute of Technology, Jan. 2006, 10 pages.
Hoffman, John R., and Feher, E.G., "150 kwe Supercritical Closed Cycle System", Transactions of the ASME, Jan. 1971, pp. 70-80.
Jeong, Woo Seok, et al., "Performance of S-CO2 Brayton Cycle with Additive Gases for SFR Application", Korea Advanced Institute of Science and Technology, Supercritical CO2 Power Cycle Symposium, May 24-25, 2011, Boulder, CO, 5 pages.
Johnson, Gregory A., & McDowell, Michael, "Issues Associated with Coupling Supercritical CO2 Power Cycles to Nuclear, Solar and Fossil Fuel Heat Sources", Hamilton Sundstrand, Energy Space & Defense-Rocketdyne, Apr. 29-30, 2009, Troy, NY, Presentation, 18 pages.
Kawakubo, Tomoki, "Unsteady Roto-Stator Interaction of a Radial-Inflow Turbine with Variable Nozzle Vanes", ASME Turbo Expo 2010: Power for Land, Sea, and Air; vol. 7: Turbomachinery, Parts A, B, and C; Glasgow, UK, Jun. 14-18, 2010, Paper No. GT2010-23677, pp. 2075-2084, (1 page, Abstract only).
Kulhanek, Martin, "Thermodynamic Analysis and Comparison of S-CO2 Cycles", Presentation, Czech Technical University in Prague, Supercritical CO2 Power Cycle Symposium, May 24-25, 2011, Boulder, CO, 14 pages.
Kulhanek, Martin, "Thermodynamic Analysis and Comparison of S-CO2 Cycles", Paper, Czech Technical University in Prague, Supercritical CO2 Power Cycle Symposium, May 24-25, 2011, Boulder, CO, 7 pages.
Kulhanek, Martin., and Dostal, Vaclav, "Supercritical Carbon Dioxide Cycles Thermodynamic Analysis and Comparison", Abstract, Faculty Conference held in Prague, Mar. 24, 2009, 13 pages.
Ma, Zhiwen and Turchi, Craig S., "Advanced Supercritical Carbon Dioxide Power Cycle Configurations for Use in Concentrating Solar Power Systems", National Renewable Energy Laboratory, Supercritical CO2 Power Cycle Symposium, May 24-25, 2011, Boulder, CO, 4 pages.
Mohamed, Omar, et al., "Modelling Study of Supercritical Power Plant and Parameter Identified Using Genetic Algorithms", Proceedings of the World Congress on Engineering 2010 Vol II, WCE 2010, Jun. 30-Jul. 2, 2010, London, U.K., 6 pages.
Moisseytsev, Anton, and Sienicki, Jim, "Investigation of Alternative Layouts for the Supercritical Carbon Dioxide Brayton Cycle for a Sodium-Cooled Fast Reactor", Supercritical CO2 Power Cycle Symposium, Troy, NY, Apr. 29, 2009, 26 pages.
Munoz De Escalona, Jose M., "The Potential of the Supercritical Carbon Dioxide Cycle in High Temperature Fuel Cell Hybrid Systems", Paper, Thermal Power Group, University of Seville, Supercritical CO2 Power Cycle Symposium, May 24-25, 2011, Boulder, CO, 6 pages.
Munoz De Escalona, Jose M., et al., "The Potential of the Supercritical Carbon Dioxide Cycle in High Temperature Fuel Cell Hybrid Systems", Presentation, Thermal Power Group, University of Seville, Supercritical CO2 Power Cycle Symposium, May 24-25, 2011, Boulder, CO, 19 pages.
Muto, Y., et al., "Application of Supercritical CO2 Gas Turbine for the Fossil Fired Thermal Plant", Journal of Energy and Power Engineering, Sep. 30, 2010, vol. 4, No. 9, 9 pages.
Muto, Yasushi, and Kato, Yasuyoshi, "Optimal Cycle Scheme of Direct Cycle Supercritical CO2 Gas Turbine for Nuclear Power Generation Systems", International Conference on Power Engineering—2007, Oct. 23-27, 2007, Hangzhou, China, pp. 86-87.
Noriega, Bahamonde J.S., "Design Method for s-CO2 Gas Turbine Power Plants", Master of Science Thesis, Delft University of Technology, Oct. 2012, 122 pages., (3 parts).
Oh, Chang, et al., "Development of a Supercritical Carbon Dioxide Brayton Cycle: Improving PBR Efficiency and Testing Material Compatibility", Presentation, Nuclear Energy Research Initiative Report, Oct. 2004, 38 pages.
Oh, Chang; et al., "Development of a Supercritical Carbon Dioxide Brayton Cycle: Improving VHTR Efficiency and Testing Material Compatibility", Presentation, Nuclear Energy Research Initiative Report, Final Report, Mar. 2006, 97 pages.
PARMA, ED, et al., "Supercritical CO2 Direct Cycle Gas Fast Reactor (SC-GFR) Concept" Presentation for Supercritical CO2 Power Cycle Symposium, May 24-25, 2011, Boulder, CO, 40 pages.
Parma, Ed, et al., "Supercritical CO2 Direct Cycle Gas Fast Reactor (SC-GFR) Concept", Supercritical CO2 Power Cycle Symposium, May 24-25, 2011, Boulder, CO, 9 pages.
Parma, Edward J., et al., "Supercritical CO2 Direct Cycle Gas Fast Reactor (SC-GFR) Concept", Presentation, Sandia National Laboratories, May 2011, 55 pages.
PCT/US2011/029486 (EPS-002)—International Preliminary Report on Patentability dated Sep. 25, 2012, 6 pages.
PCT/US2011/029486 (EPS-002)—International Search Report and Written Opinion dated Nov. 16, 2011, 9 pages.
PCT/US2010/049042 (EPS-008)—International Search Report and Written Opinion dated Nov. 17, 2010, 11 pages.
PCT/US2010/049042 (EPS-008)—International Preliminary Report on Patentability dated Mar. 29, 2012, 18 pages.
PCT/US2010/031614 (EPS-014)—International Search Report dated Jul. 12, 2010, 3 pages.
PCT/US2010/031614—(EPS-14)—International Preliminary Report on Patentability dated Oct. 27, 2011, 9 pages.
PCT/US2010/039559 (EPS-015)—International Preliminary Report on Patentability dated Jan. 12, 2012, 7 pages.
PCT/US2010/039559 (EPS-015)—Notification of Transmittal of the International Search Report and Written Opinion of the International Searching Authority, or the Declaration dated Sep. 1, 2010, 6 pages.
PCT/US2010/044681 (EPS016)—International Search Report and Written Opinion dated Oct. 7, 2010, 10 pages.
PCT/US2010/044681(EPS-016)—International Preliminary Report on Patentability dated Feb. 16, 2012, 9 pages.
PCT/US2010/044476(EPS-018)—International Search Report dated Sep. 29, 2010, 23 pages.
PCT/US2007/001120 (EPS-019PCT)—International Search Report dated Apr. 25, 2008, 7 pages.
PCT/US2006/049623 (EPS-020PCT)—Written Opinion of ISA dated Jan. 4, 2008, 4 pages.
PCT/US2007/079318 (EPS-021PCT)—International Preliminary Report on Patentability dated Jul. 7, 2008, 5 pages.
PCT/US2013/055547 (EPS-049PCT)—Notification of Transmittal of the International Search Report and the Written Opinion of the International Searching Authority, or the Declaration dated Jan. 24, 2014, 11 pages.

(56) References Cited

OTHER PUBLICATIONS

PCT/US2013/064470 (EPS-050PCT)—Notification of Transmittal of the International Search Report and the Written Opinion of the International Searching Authority, or the Declaration dated Jan. 22, 2014, 10 pages.
PCT/US2013/064471 (EPS-053PCT)—Notification of Transmittal of the International Search Report and the Written Opinion of the International Searching Authority, or the Declaration dated Jan. 24, 2014, 10 pages.
PCT/US2014/023026 (EPS-058PCT)—Notification of Transmittal of the International Search Report and the Written Opinion of the International Searching Authority, or the Declaration dated Jul. 22, 2014, 11 pages.
PCT/US2014/013170 (EPS-061PCT)—Notification of Transmittal of the International Search Report and the Written Opinion of the International Searching Authority, or the Declaration dated May 9, 2014, 12 pages.
PCT/US2011/062266 (EPS-069)—International Search Report and Written Opinion dated Jul. 9, 2012, 12 pages.
PCT/US2011/062198 (EPS-070)—International Search Report and Written Opinion dated Jul. 2, 2012, 9 pages.
PCT/US2011/062198 (EPS-070EP)—Extended European Search Report dated May 6, 2014, 9 pages.
PCT/US2011/062201 (EPS-071)—International Search Report and Written Opinion dated Jun. 26, 2012, 9 pages.
PCT/US2011/062201 (EPS-071EP)—Extended European Search Report dated May 28, 2014, 8 pages.
PCT/US2011/062204 (EPS-072)—International Search Report dated Nov. 1, 2012, 10 pages.
PCT/US2011/62207 (EPS-073)—International Search Report and Written Opinion dated Jun. 28, 2012, 7 pages.
PCT/US2014/013154 (EPS-074PCT)—International Search Report dated May 23, 2014, 4 pages.
PCT/US2014/024548 (EPS-083)—International Search Report and Written Opinion dated Sep. 5, 2014, 11 pages.
PCT/US2013/064475 (EPS-086)—International Search Report and Written Opinion dated Jan. 16, 2014, 11 pages.
PCT/US2014/024254 (EPS-089)—International Search Report and Written Opinion dated Aug. 13, 2014, 10 pages.
PCT/US2014/026173 (EPS-090PCT)—Notification of Transmittal of the International Search Report and the Written Opinion of the International Searching Authority, or the Declaration dated Jul. 9, 2014, 10 pages.
PCT/US2012/000470 (EPS-124)—International Search Report dated Mar. 8, 2013, 10 pages.
PCT/US2012/061151 (EPS-125)—International Search Report and Written Opinion dated Feb. 25, 2013, 9 pages.
PCT/US2012/061159 (EPS-126)—International Search Report dated March 2, 2013, 10 pages.
PCT/US2014/024305 (EPS-127PCT)—Notification of Transmittal of the International Search Report and the Written Opinion of the International Searching Authority, or the Declaration dated Aug. 26, 2014, 11 pages.
PCT/US2014/023990 (EPS-128PCT)—Notification of Transmittal of the International Search Report and the Written Opinion of the International Searching Authority, or the Declaration dated Jul. 17, 2014, 10 pages.
PCT/US2015/57701 (EPS-135PCT)—Notification of Transmittal of the International Search Report and the Written Opinion of the International Searching Authority, or the Declaration dated Dec. 22, 2015, 11 pages.
PCT/US2015/57756 (EPS-136PCT)—Notification of Transmittal of the International Search Report and the Written Opinion of the International Searching Authority, or the Declaration dated Jul. 27, 2017, 41 pages.
PCT/US2014/020242 (EPS-140PCT)—Notification of Transmittal of the International Search Report and the Written Opinion of the International Searching Authority, or the Declaration dated Aug. 5, 2014, 9 pages.
PCT/US2018/034289 (EPS-170PCT)—Notification of Transmittal of the International Search Report and the Written Opinion of the International Searching Authority, or the Declaration dated Oct. 2, 2018, 22 pages.
"Steam Turbines", PDHengineer.com Course No. M-3006.
Steam Turbines (Energy Engineering) http://what-when-how.com/energy-engineering/steam-turbines-energy-engineering/, Oct. 25, 2012, 14 pages.
Persichilli, Michael, et al., "Supercritical CO2 Power Cycle Developments and Commercialization: Why sCO2 can Displace Steam" Echogen Power Systems LLC, Power-Gen India & Central Asia 2012, Apr. 19-21, 2012, New Delhi, India, 15 pages.
Pruess, Karsten, "Enhanced Geothermal Systems (EGS): Comparing Water and CO2 as Heat Transmission Fluids", Proceedings, New Zealand Geothermal Workshop 2007 Auckland, New Zealand, Nov. 19-21, 2007, 13 pages.
Pruess, Karsten, "Enhanced Geothermal Systems (EGS): Using CO2 as Working Fluid—A Novel Approach for Generating Renewable Energy with Simultaneous Sequestration of Carbon", Submitted to Geothermics, Jun. 2006, 26 pages.
Renz, Manfred, "The New Generation Kalina Cycle", Contribution to the Conference: "Electricity Generation from Enhanced Geothermal Systems", Sep. 14, 2006, Strasbourg, France, 18 pages.
Saari, Henry, et al., "Supercritical CO2 Advanced Brayton Cycle Design", Presentation, Carleton University, Supercritical CO2 Power Cycle Symposium, May 24-25, 2011, Boulder, CO, 21 pages.
San Andres, Luis, "Start-Up Response of Fluid Film Lubricated Cryogenic Turbopumps (Preprint)", AIAA/ASME/SAE/ASEE Joint Propulsion Conference, Cincinnati, OH, Jul. 8-11, 2007, 38 pages.
Sarkar, J., and Bhattacharyya, Souvik, "Optimization of Recompression S-CO2 Power Cycle with Reheating" Energy Conversion and Management 50 (May 17, 2009), pp. 1939-1945.
Thorin, Eva, "Power Cycles with Ammonia-Water Mixtures as Working Fluid", Doctoral Thesis, Department of Chemical Engineering and Technology Energy Processes, Royal Institute of Technology, Stockholm, Sweden, 2000, 66 pages.
Tom, Samsun Kwok Sun, "The Feasibility of Using Supercritical Carbon Dioxide as a Coolant for the Candu Reactor", The University of British Columbia, Jan. 1978, 156 pages.
"Two-flow rotors"; http://www.answers.com/topic/steam-turbine#ixzz2AJsKAwHX.
VGB PowerTech Service GmbH, "CO2 Capture and Storage", A VGB Report on the State of the Art, Aug. 25, 2004, 112 pages.
Vidhi, Rachana, et al., "Study of Supercritical Carbon Dioxide Power Cycle for Power Conversion from Low Grade Heat Sources", Presentation, University of South Florida and Oak Ridge National Laboratory, Supercritical CO2 Power Cycle Symposium, May 24-25, 2011, Boulder, CO, 17 pages.
Vidhi, Rachana, et al., "Study of Supercritical Carbon Dioxide Power Cycle for Power Conversion from Low Grade Heat Sources", Paper, University of South Florida and Oak Ridge National Laboratory, Supercritical CO2 Power Cycle Symposium, May 24-25, 2011, Boulder, CO, 8 pages.
Wright, Steven A., et al., "Modeling and Experimental Results for Condensing Supercritical CO2 Power Cycles", Sandia Report, Jan. 2011, 47 pages.
Wright, Steven A., et al., "Supercritical CO2 Power Cycle Development Summary at Sandia National Laboratories", May 24-25, 2011, (1 page, Abstract only).
Wright, Steven, "Mighty Mite", Mechanical Engineering, Jan. 2012, pp. 41-43.
Yoon, Ho Joon, et al., "Preliminary Results of Optimal Pressure Ratio for Supercritical CO2 Brayton Cycle coupled with Small Modular Water Cooled Reactor", Presentation, Korea Advanced Institute of Science and Technology and Khalifa University of Science, Technology and Research, Boulder, CO, May 25, 2011, 18 pages.
Yoon, Ho Joon, et al., "Preliminary Results of Optimal Pressure Ratio for Supercritical CO2 Brayton Cycle coupled with Small Modular Water Cooled Reactor", Paper, Korea Advanced Institute of Science and Technology and Khalifa University of Science, Technology and Research, May 24-25, 2011, Boulder, CO, 7 pages.

ACTIVE THRUST MANAGEMENT OF A TURBOPUMP WITHIN A SUPERCRITICAL WORKING FLUID CIRCUIT IN A HEAT ENGINE SYSTEM

This application is a continuation of U.S. application Ser. No. 15/523,485, filed May 1, 2017, now issued as U.S. Pat. No. 10,570,777, which was a national stage application of PCT/US2015/057756, now expired, which was filed on Nov. 3, 2014, the disclosures of which are incorporated herein by reference to the extent not inconsistent with the present disclosure.

BACKGROUND

Waste heat is often created as a byproduct of industrial processes where flowing streams of high-temperature liquids, gases, or fluids must be exhausted into the environment or removed in some way in an effort to maintain the operating temperatures of the industrial process equipment. Some industrial processes utilize heat exchanger devices to capture and recycle waste heat back into the process via other process streams. However, the capturing and recycling of waste heat is generally infeasible by industrial processes that utilize high temperatures or have insufficient mass flow or other unfavorable conditions.

Waste heat can be converted into useful energy by a variety of turbine generator or heat engine systems that employ thermodynamic methods, such as Rankine cycles. Rankine cycles and similar thermodynamic cycles are typically steam-based processes that recover and utilize waste heat to generate steam for driving an expander, such as a turbine, connected to an electric generator, a pump, and/or another device. As an alternative to steam-based, thermodynamic cycles, an organic Rankine cycle utilizes a lower boiling-point working fluid, instead of water. Exemplary lower boiling-point working fluids include hydrocarbons, such as light hydrocarbons (e.g., propane or butane) and halogenated hydrocarbon, such as hydrochlorofluorocarbons (HCFCs) or hydrofluorocarbons (HFCs) (e.g., R245fa).

A synchronous power generator is a commonly employed turbine generator utilized for generating electrical energy in large scales (e.g., megawatt scale) throughout the world for both commercial and non-commercial use. The synchronous power generator generally supplies electricity to an electrical bus or grid (e.g., an alternating current bus) that usually has a varying load or demand over time. In order to be properly connected, the frequency of the synchronous power generator must be tuned and maintained to match the frequency of the electrical bus or grid. Severe damage may occur to the synchronous power generator as well as the electrical bus or grid should the frequency of the synchronous power generator become unsynchronized with the frequency of the electrical bus or grid.

Turbine generator systems also may suffer an overspeed condition during the generation of electricity—generally—due to high electrical demands during peak usage times. Turbine generator systems may be damaged due to an increasing rotational speed of the moving parts, such as turbines, generators, and/or gears, as well as a deficit in lubricating and cooling such turbomachinery. In addition, the turbines and pumps utilized in turbine generator systems are susceptible to fail due to thermal shock when exposed to substantial and imminent temperature differentials. Such rapid change of temperature generally occurs when the turbine or pump is exposed to a supercritical working fluid.

The thermal shock may cause valves, blades, and other parts to crack and result in catastrophic damage to the unit.

The control of the turbine driven pump, such as a turbopump, is quite relevant to the operation and efficiency of an advanced Rankine cycle process. Generally, the control of the turbopump is often not precise enough to achieve the most efficient or maximum operating conditions without damaging the turbopump. Also, during operations, the turbopump generally requires proper lubrication and temperature regulation—often provided by a bearing or seal gas. The turbopump and/or turbomachinery components of the turbopump have very close tolerances and may be susceptible to immediate damage if there is an interruption of the bearing seal gas. If too much or not enough pressure is applied to a thrust bearing of the turbopump, then the rotor of the turbopump is likely to rub against stationary parts, such that the turbopump damages itself and ceases to operate.

Therefore, there is a need for a heat engine system, a turbopump system, and methods for generating mechanical and electrical energy, whereby pressures, temperatures, and lubrication within the turbomachinery is controlled at acceptable levels while maintaining or increasing the efficiency for operating the heat engine system.

SUMMARY

Embodiments of the invention generally provide a heat engine system, a turbopump system, and methods for lubricating a turbopump in the heat engine system while generating mechanical and electrical energy. The systems and methods described herein provide proper lubrication and cooling to turbomachinery components of a turbopump by controlling pressures applied to a thrust bearing in the turbopump. The applied pressure on the thrust bearing may be controlled by a turbopump back-pressure regulator valve that may be modulated, controlled, or otherwise adjusted to maintain proper pressures within a plurality of bearing pockets disposed on each of two opposing surfaces of the thrust bearing. Pocket pressure ratios, such as a turbine-side pocket pressure ratio (P1) and a pump-side pocket pressure ratio (P2), may be monitored and adjusted by a process control system. In some exemplary embodiments, in order to prevent damage to the thrust bearing and/or other turbomachinery components, the systems and methods may utilize advanced control theory of sliding mode, the multi-variables of the pocket pressure ratios P1 and P2, and regulating the bearing fluid to maintain a supercritical state.

The heat engine system and the method described herein are configured to efficiently generate valuable mechanical and electrical energy from thermal energy, such as a heated stream (e.g., a waste heat stream). The heat engine system utilizes a working fluid in a supercritical state (e.g., sc-$CO_2$) and/or a subcritical state (e.g., sub-$CO_2$) contained within a working fluid circuit for capturing or otherwise absorbing thermal energy of the waste heat stream with one or more heat exchangers. The thermal energy is transformed to mechanical energy by a power turbine and/or a drive turbine and subsequently transformed to electrical energy by the power generator coupled to the power turbine. The heat engine system contains several integrated sub-systems managed by the process control system for maximizing the efficiency of the heat engine system while generating electricity.

In one exemplary embodiment, a turbopump system for circulating or pressurizing a working fluid within a working fluid circuit is provided and contains a turbopump, a drive turbine, a pump portion, a driveshaft, a thrust bearing, and a housing. The thrust bearing of the turbopump may be circumferentially disposed around the driveshaft and between the drive turbine and the pump portion. The housing of the turbopump may be disposed at least partially encompassing the driveshaft and the thrust bearing. The turbopump system also contains a bearing fluid supply line, a bearing fluid drain line, and a turbopump back-pressure regulator valve, and is operatively connected or coupled to the process control system. The process control system may be operatively connected to the turbopump back-pressure regulator valve and configured to adjust the turbopump back-pressure regulator valve with a control algorithm embedded in a computer system. The bearing fluid supply line may be fluidly coupled to the housing and configured to provide a bearing fluid into the housing and the bearing fluid drain line may be fluidly coupled to the housing and configured to remove the bearing fluid from the housing. The turbopump back-pressure regulator valve may be fluidly coupled to the bearing fluid drain line and configured to control flow through the bearing fluid drain line.

In some exemplary embodiments, the thrust bearing contains a cylindrical body, a turbine-side thrust face, a pump-side thrust face, a circumferential side surface, and a central orifice defined by and extending through the cylindrical body. The cylindrical body of the thrust bearing may have an inner portion and an outer portion aligned with a common central axis. The circumferential side surface may extend along the circumference of the cylindrical body and between the pump-side thrust face and the turbine-side thrust face. The central orifice extends through the cylindrical body along the central axis and may be configured to provide passage of the driveshaft therethrough.

The turbine-side thrust face has a plurality of bearing pockets, such as turbine-side bearing pockets, extending below the turbine-side thrust face and facing the drive turbine. Similarly, the pump-side thrust face has a plurality of bearing pockets, such as pump-side bearing pockets, extending below the pump-side thrust face and facing the pump portion. Generally, the plurality of pump-side bearing pockets contains from about 2 bearing pockets to about 12 bearing pockets, for example, about 6 bearing pockets, and the plurality of turbine-side bearing pockets contains from about 2 bearing pockets to about 12 bearing pockets, for example, about 6 bearing pockets.

In one or more exemplary embodiments, the control algorithm contains a sliding mode controller configured to provide a sliding mode control method for controlling the turbopump back-pressure regulator valve. The control algorithm generally contains a plurality of loop controllers configured to control the turbopump back-pressure regulator valve while adjusting values of pocket pressure ratios for bearing surfaces of the thrust bearing. The plurality of loop controllers may be configured to adjust, modulate, or otherwise control the turbopump back-pressure regulator valve in order maintain or obtain a balanced thrust of the turbopump. The control algorithm may be incorporated or otherwise contained within the computer system as part of the process control system.

The control algorithm may contain at least a primary governing loop controller, a secondary governing loop controller, and a tertiary governing loop controller. In some exemplary embodiments, the control algorithm may be configured to calculate valve positions for the turbopump back-pressure regulator valve for providing a pump-side pocket pressure ratio (P2) of about 0.25 or less with the primary governing loop controller, a turbine-side pocket pressure ratio (P1) of about 0.25 or greater with the secondary governing loop controller, and a bearing fluid supply pressure at or greater than a critical pressure value for the bearing fluid.

In one exemplary embodiment, the primary governing loop controller may be configured to adjust the turbopump back-pressure regulator valve for maintaining a pump-side pocket pressure ratio (P2) of about 0.30 or less, such as about 0.25 or less, such as about 0.20 or less, such as about 0.15 or less. In another exemplary embodiment, the primary governing loop controller may be configured to activate and adjust the turbopump back-pressure regulator valve if the pump-side pocket pressure ratio (P2) of about 0.25 or greater is detected by the process control system. The pump-side thrust face has a plurality of pump-side bearing pockets extending below the pump-side thrust face and facing the pump portion. The pump-side pocket pressure ratio (P2) may be measured in the pump-side bearing pockets. In one exemplary embodiment, the plurality of pump-side bearing pockets contains about 10 bearing pockets or less and the pump-side pocket pressure ratio (P2) is about 0.25 or less.

In one exemplary embodiment, the secondary governing loop controller may be configured to adjust the turbopump back-pressure regulator valve for maintaining the turbine-side pocket pressure ratio (P1) of about 0.30 or less, such as about 0.25 or less, such as about 0.20 or less, such as about 0.15 or less. In another exemplary embodiment, the secondary governing loop controller may be configured to activate and adjust the turbopump back-pressure regulator valve if the turbine-side pocket pressure ratio (P1) of about 0.25 or greater is detected by the process control system. The turbine-side pocket pressure ratio (P1) may be measured on a turbine-side thrust face of the thrust bearing. The turbine-side thrust face has a plurality of turbine-side bearing pockets extending below the turbine-side thrust face and facing the drive turbine. The turbine-side pocket pressure ratio (P1) may be measured and monitored in the turbine-side bearing pockets, such as with a probe or a sensor at the pressure tap. In one exemplary embodiment, the plurality of turbine-side bearing pockets contains about 10 bearing pockets or less and the turbine-side pocket pressure ratio (P1) is about 0.25 or less.

In one exemplary embodiment, the tertiary governing loop controller may be configured to activate and adjust the turbopump back-pressure regulator valve if an undesirable pressure of the bearing fluid is detected by the process control system. The undesirable pressure of the bearing fluid may be detected at or near the bearing fluid supply line. In one example, the undesirable pressure of the bearing fluid may be about 5% greater than the supercritical pressure of the bearing fluid or less. In another exemplary embodiment, the tertiary governing loop controller may be configured to adjust the turbopump back-pressure regulator valve for maintaining the bearing fluid in a supercritical state. In other exemplary embodiments, the tertiary governing loop controller may be configured to adjust the turbopump back-pressure regulator valve for maintaining a bearing drain pressure of about 1,055 psi or greater.

In one or more exemplary embodiments, the bearing fluid is carbon dioxide or at least contains carbon dioxide. In other embodiments, a portion of the working fluid may be diverted from the working fluid circuit or another source (e.g., storage tank or conditioning system) and utilized as the bearing fluid. In some exemplary embodiments, the bearing fluid and the working fluid contain carbon dioxide.

In another exemplary embodiment, a method for lubricating and/or cooling the turbopump in the heat engine system is provided and includes circulating and/or pressuring the working fluid throughout the working fluid circuit with the turbopump and transferring thermal energy from a heat source stream to the working fluid through at least one heat exchanger fluidly coupled to and in thermal communication with the high pressure side of the working fluid circuit and may be configured to be fluidly coupled to and in thermal communication with the heat source stream. The method further includes measuring and monitoring a turbine-side pocket pressure ratio (P1), a pump-side pocket pressure ratio (P2), a bearing fluid supply pressure, and a bearing fluid drain pressure via the process control system operatively coupled to the working fluid circuit, as described by one or more embodiments. The turbine-side pocket pressure ratio (P1) may be measured and/or monitored in at least one turbine-side bearing pocket of a plurality of turbine-side bearing pockets disposed on a turbine-side thrust face of the thrust bearing within the turbopump. The pump-side pocket pressure ratio (P2) may be measured and/or monitored in at least one pump-side bearing pocket of a plurality of pump-side bearing pockets disposed on a pump-side thrust face of the thrust bearing. The bearing fluid supply pressure may be measured and/or monitored in at least one bearing supply pressure line disposed upstream of the thrust bearing. The bearing fluid drain pressure may be measured and/or monitored in at least one bearing drain pressure line disposed downstream of the thrust bearing.

The method also includes controlling the turbopump back-pressure regulator valve by the primary governing loop controller embedded in the process control system. The turbopump back-pressure regulator valve may be fluidly coupled to a bearing fluid drain line disposed downstream of the thrust bearing and the primary governing loop controller may be configured to modulate the turbopump back-pressure regulator valve while adjusting the pump-side pocket pressure ratio (P2). The method further includes controlling the turbopump back-pressure regulator valve by the secondary governing loop controller embedded in the process control system. The secondary governing loop controller may be configured to modulate the turbopump back-pressure regulator valve while adjusting the turbine-side pocket pressure ratio (P1). The method also includes controlling the turbopump back-pressure regulator valve by the tertiary governing loop controller embedded in the process control system. The tertiary governing loop controller may be configured to modulate the turbopump back-pressure regulator valve while adjusting the bearing fluid supply pressure to be at or greater than a critical pressure value for the bearing fluid and maintain the bearing fluid in a supercritical state.

In another exemplary embodiment, a method for lubricating and/or cooling the turbopump in the heat engine system is provided and includes controlling the turbopump back-pressure regulator valve by the primary governing loop controller embedded in the process control system and modulating or controlling the turbopump back-pressure regulator valve while adjusting the pump-side pocket pressure ratio (P2). The turbopump back-pressure regulator valve may be fluidly coupled to a bearing fluid drain line disposed downstream of the thrust bearing. The primary governing loop controller may be configured to modulate the turbopump back-pressure regulator valve while adjusting the pump-side pocket pressure ratio (P2).

The method further includes detecting an undesirable value of the turbine-side pocket pressure ratio (P1) via the process control system and subsequently activating the secondary governing loop controller embedded in the process control system, deactivating the primary governing loop controller, and decreasing the turbine-side pocket pressure ratio (P1) to a desirable value. The undesirable value of the turbine-side pocket pressure ratio (P1) is greater than a predetermined threshold value of the turbine-side pocket pressure ratio (P1) and the desirable value of the turbine-side pocket pressure ratio (P1) is at or less than the predetermined threshold value of the turbine-side pocket pressure ratio (P1). The secondary governing loop controller may be configured to decrease the turbine-side pocket pressure ratio (P1) by modulating the turbopump back-pressure regulator valve.

The method also includes detecting an undesirable value of the bearing fluid supply pressure via the process control system and subsequently activating the tertiary governing loop controller embedded in the process control system, deactivating the primary governing loop controller or the secondary governing loop controller, and increasing the bearing fluid supply pressure to a desirable value. The undesirable value of the bearing fluid supply pressure is less than a critical pressure value for the bearing fluid and the desirable value of the bearing fluid supply pressure is at or greater than a critical pressure value for the bearing fluid. The tertiary governing loop controller may be configured to increase the bearing fluid supply pressure by modulating the turbopump back-pressure regulator valve while increasing the bearing fluid drain pressure.

In one exemplary embodiment, the method may further include adjusting the pump-side pocket pressure ratio (P2) by modulating the turbopump back-pressure regulator valve with the primary governing loop controller to obtain or maintain the pump-side pocket pressure ratio (P2) of about 0.25 or less. In another exemplary embodiment, the method may also include adjusting the turbine-side pocket pressure ratio (P1) by modulating the turbopump back-pressure regulator valve with the secondary governing loop controller to obtain or maintain the turbine-side pocket pressure ratio (P1) of about 0.25 or greater. In another exemplary embodiment, the method may further include adjusting the turbopump back-pressure regulator valve with the tertiary governing loop controller to obtain or maintain the bearing drain pressure of about 1,055 psi or greater. Generally, the bearing fluid supply pressure may be increased until the bearing fluid is in a supercritical state. In one exemplary embodiment, the method further includes regulating and maintaining the bearing fluid in contact with the thrust bearing to be in a supercritical state. In another exemplary embodiment, the method includes modulating the turbopump back-pressure regulator valve to control the flow of the bearing fluid passing through the bearing fluid drain line. The turbopump back-pressure regulator valve is adjusted to partially opened-positions that are within a range from about 35% to about 80% of being in a fully opened-position.

In another exemplary embodiment, a heat engine system contains a working fluid circuit, at least one heat exchanger, a power turbine or other expander, a rotating shaft, at least one of the recuperators, a condenser, a start pump, a turbopump system, and a process control system. The working fluid circuit may contain the working fluid and having a high pressure side and a low pressure side, wherein a portion of the working fluid circuit contains the working fluid in a supercritical state. The heat exchangers may be fluidly coupled to and in thermal communication with the high pressure side of the working fluid circuit, configured to be fluidly coupled to and in thermal communication with a heat source stream, and configured to transfer thermal energy from the heat source stream to the working fluid within the high pressure side.

The power turbine may be fluidly coupled to the working fluid circuit, disposed between the high pressure side and the low pressure side, configured to convert a pressure drop in the working fluid to mechanical energy. The rotating shaft may be coupled to the power turbine and configured to drive a device (e.g., a generator/alternator or a pump/compressor) with the mechanical energy. In one example, the rotating shaft may be coupled to and configured to drive a power generator. The recuperators may be fluidly coupled to the working fluid circuit and configured to transfer thermal energy from the working fluid in the low pressure side to the working fluid in the high pressure side. The start pump may be fluidly coupled to the working fluid circuit, disposed between the low pressure side and the high pressure side, and configured to circulate or pressurize the working fluid within the working fluid circuit.

The drive turbine of the turbopump may be disposed between the high and low pressure sides of the working fluid circuit and may be configured to convert a pressure drop in the working fluid to mechanical energy. The pump portion of the turbopump may be disposed between the high and low pressure sides of the working fluid circuit and may be configured to circulate or pressurize the working fluid within the working fluid circuit. The driveshaft of the turbopump may be coupled to and between the drive turbine and the pump portion, such that the drive turbine may be configured to drive the pump portion via the driveshaft.

In other exemplary embodiments disclosed herein, a method for generating mechanical and electrical energy with the heat engine system includes circulating the working fluid within the working fluid circuit, such that the working fluid circuit has the high pressure side and the low pressure side and at least a portion of the working fluid circuit contains the working fluid in a supercritical state (e.g., sc-$CO_2$). The method also includes transferring thermal energy from the heat source stream to the working fluid by at least one heat exchanger fluidly coupled to and in thermal communication with the high pressure side of the working fluid circuit. The method further includes flowing the working fluid into the power turbine and converting the thermal energy from the working fluid to mechanical energy of the power turbine and converting the mechanical energy into electrical energy by a power generator coupled to the power turbine.

BRIEF DESCRIPTION OF THE DRAWINGS

Embodiments of the present disclosure are best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
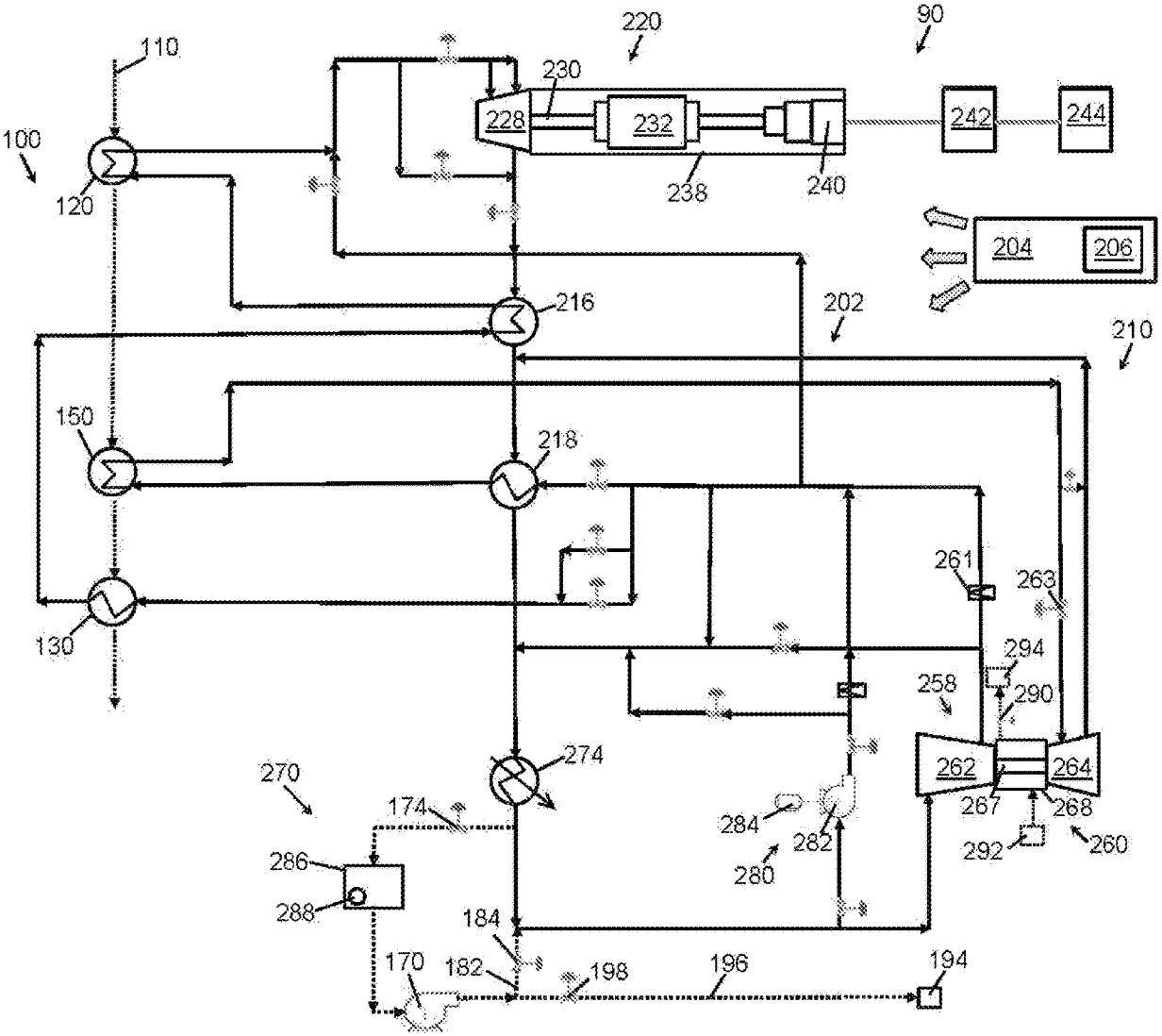
FIG. 1 depicts an exemplary heat engine system containing a turbopump system with a turbopump and a turbopump back-pressure regulator valve, according to one or more embodiments disclosed herein.

Embodiments of the invention generally provide heat engine systems and methods for generating electricity with such heat engine systems. FIG. 1 depicts an exemplary heat engine system 90, which may also be referred to as a thermal engine system, an electrical generation system, a waste heat or other heat recovery system, and/or a thermal to electrical energy system, as described in one of more embodiments herein. The heat engine system 90 further contains a waste heat system 100 and a power generation system 220 coupled to and in thermal communication with each other via a working fluid circuit 202. The working fluid circuit 202 contains the working fluid and has a high pressure side and a low pressure side. In many examples, the working fluid contained in the working fluid circuit 202 is carbon dioxide or substantially contains carbon dioxide and may be in a supercritical state (e.g., sc-$OO_2$) and/or a subcritical state (e.g., sub-COO. In one or more examples, the working fluid disposed within the high pressure side of the working fluid circuit 202 contains carbon dioxide in a supercritical state and the working fluid disposed within the low pressure side of the working fluid circuit 202 contains carbon dioxide in a subcritical state.

A heat source stream 110 may be flowed through heat exchangers 120, 130, and/or 150 disposed within the waste heat system 100. The heat exchangers 120, 130, and/or 150 are fluidly coupled to and in thermal communication with the high pressure side of the working fluid circuit 202, configured to be fluidly coupled to and in thermal communication with a heat source stream 110, and configured to transfer thermal energy from the heat source stream 110 to the working fluid. Thermal energy may be absorbed by the working fluid within the working fluid circuit 202 and the heated working fluid may be circulated through a power turbine 228 within the power generation system 220.

The power turbine 228 may be disposed between the high pressure side and the low pressure side of the working fluid circuit 202 and fluidly coupled to and in thermal communication with the working fluid. The power turbine 228 may be configured to convert thermal energy to mechanical energy by a pressure drop in the working fluid flowing between the high and the low pressure sides of the working fluid circuit 202. A power generator 240 is coupled to the power turbine 228 and configured to convert the mechanical energy into electrical energy, a power outlet 242 electrically coupled to the power generator 240 and configured to transfer the electrical energy from the power generator 240 to an electrical grid 244. The power generation system 220 generally contains a rotating shaft 230 and a gearbox 232 coupled between the power turbine 228 and the power generator 240.

The heat engine system 90 generally contains several pumps, such as a turbopump 260 and a start pump 280, disposed within the working fluid circuit 202 and fluidly coupled between the low pressure side and the high pressure side of the working fluid circuit 202. The turbopump 260 and the start pump 280 may be operative to circulate and/or pressurize the working fluid throughout the working fluid circuit 202. The start pump 280 has a pump portion 282 and a motor-drive portion 284. The start pump 280 is generally an electric motorized pump or a mechanical motorized pump, and may be a variable frequency driven pump.

The turbopump 260 contains a pump portion 262, a drive turbine 264, a driveshaft 267, a thrust bearing 310, and a bearing housing 268. The pump portion 262 may be disposed between the high and low pressure sides of the working fluid circuit 202 and may be configured to circulate or pressurize the working fluid within the working fluid circuit 202. The pump inlet on the pump portion 262 is generally disposed in the low pressure side and the pump outlet on the pump portion 262 is generally disposed in the high pressure side. The drive turbine 264 may be disposed between the high and low pressure sides of the working fluid circuit 202 and may be configured to convert a pressure drop in the working fluid to mechanical energy. The drive turbine 264 of the turbopump 260 may be fluidly coupled to the working fluid circuit 202 downstream of the heat exchanger 150 and the pump portion 262 of the turbopump 260 may be fluidly coupled to the working fluid circuit 202 upstream of the heat exchanger 120. The driveshaft 267 may be coupled to and between the drive turbine 264 and the pump portion 262, such that the drive turbine 264 may be configured to drive the pump portion 262 via the driveshaft 267. The thrust bearing 310 may be circumferentially disposed around the driveshaft 267 and between the drive turbine 264 and the pump portion 262. The bearing housing 268 may be disposed at least partially encompassing the driveshaft 267 and the thrust bearing 310.

In some embodiments, a secondary heat exchanger, such as a heat exchanger 150, may be utilized to provide heated, pressurized working fluid to the drive turbine 264 for powering the turbopump 260. The heat exchanger 150 may be fluidly coupled to and in thermal communication with the heat source stream 110 and independently fluidly coupled to and in thermal communication with the working fluid in the working fluid circuit 202. The heated, pressurized working fluid may be utilized to move, drive, or otherwise power the drive turbine 264.

The process control system 204 contains a control algorithm embedded in a computer system 206 and the control algorithm contains a governing loop controller. The governing controller is generally utilized to adjust values throughout the working fluid circuit 202 for controlling the temperature, pressure, flowrate, and/or mass of the working fluid at specified points therein. In some embodiments, the governing loop controller may configured to monitor and maintain, and/or to adjust if needed, desirable threshold values of pocket pressure ratios for a thrust bearing 310 (FIGS. 2-6B) by modulating, adjusting, or otherwise controlling a turbopump back-pressure regulator valve 290. In some exemplary embodiments, the control algorithm may be configured to calculate valve positions for the turbopump back-pressure regulator valve 290 for providing a pump-side pocket pressure ratio (P2) of about 0.25 or less with the primary governing loop controller, a turbine-side pocket pressure ratio (P1) of about 0.25 or greater with the secondary governing loop controller, and a bearing fluid supply pressure at or greater than a critical pressure value for the bearing fluid.

Figure 2:
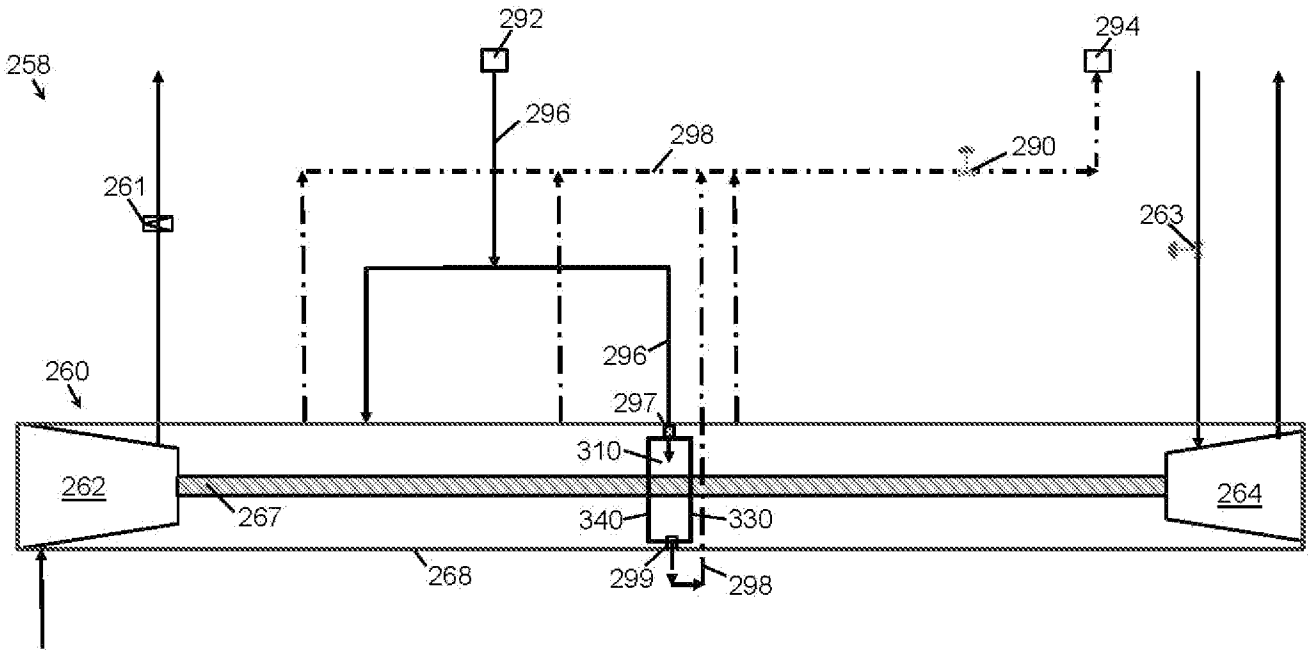
FIG. 2 depicts the turbopump system illustrated in FIG. 1, including additional components and details, according to one or more embodiments disclosed herein.
Figure 3:
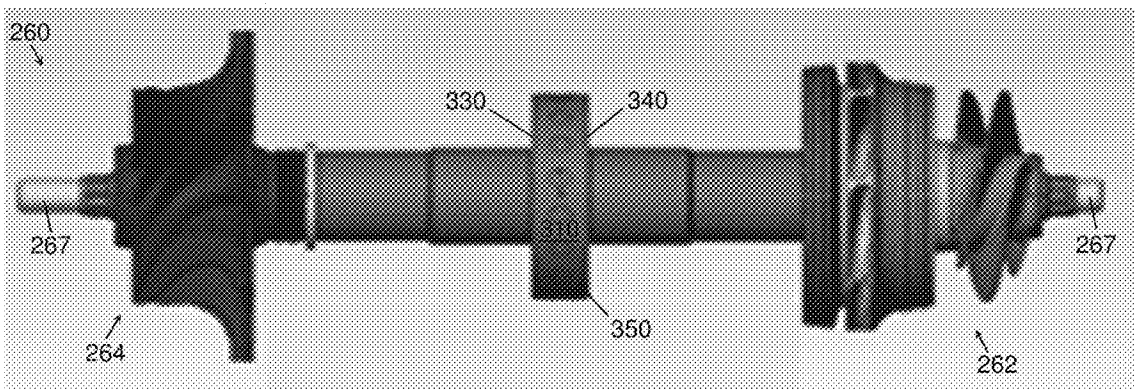
FIGS. 3 and 4 depict the turbopump illustrated in FIG. 1, including a thrust bearing and additional components and details, according to one or more embodiments disclosed herein.

FIGS. 1 and 2 depict the turbopump system 258, according to one or more embodiments disclosed herein. The turbopump system 258 may be utilized to circulate and/or pressurize the working fluid within the working fluid circuit 202. The turbopump system 258 contains a turbopump 260, a bearing fluid supply line 296, a bearing fluid drain line 298, a turbopump back-pressure regulator valve 290, and a bearing fluid return 294. The turbopump back-pressure regulator valve 290 may be operatively connected or coupled to the process control system 204, illustrated in FIGS. 1 and 9. The process control system 204 may be operatively connected or coupled to the turbopump back-pressure regulator valve 290 and configured to adjust the turbopump back-pressure regulator valve 290 with a control algorithm embedded in a computer system 206.

Figure 4:
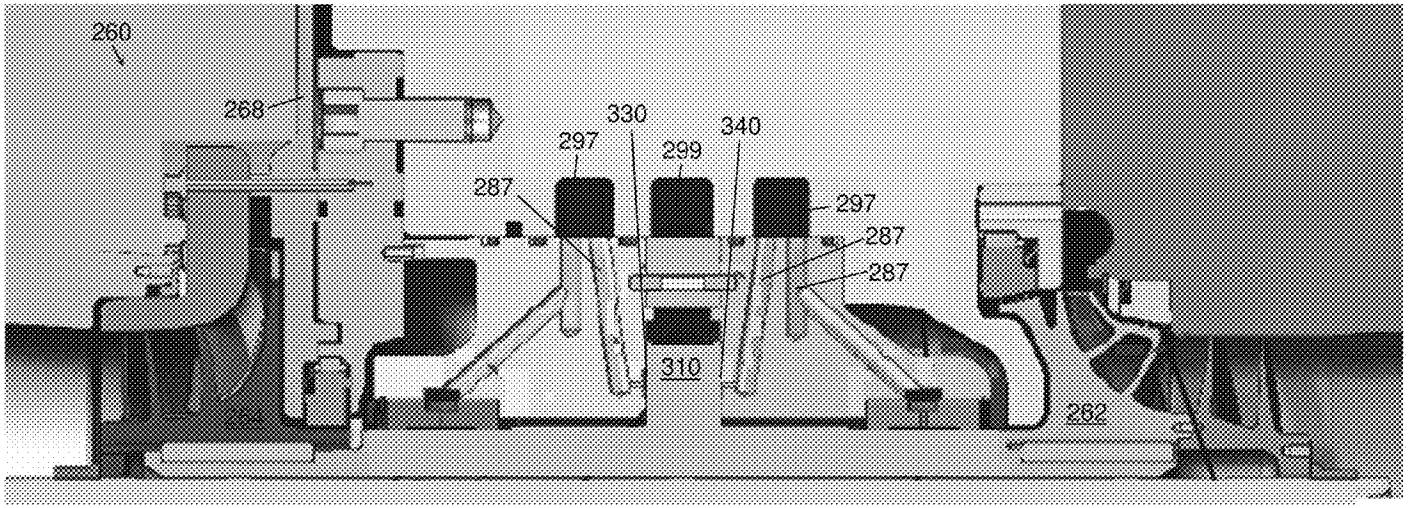
Figure 5:
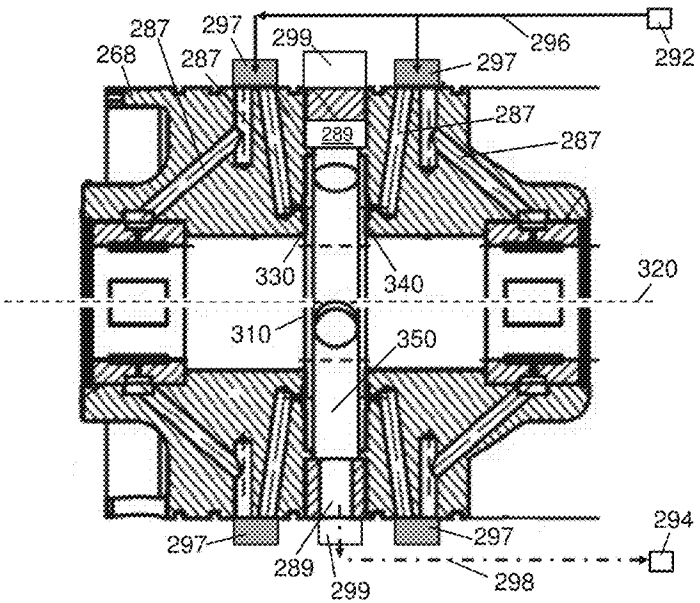
FIG. 5 depicts a cross-sectional view of the thrust bearing illustrated in FIGS. 3 and 4, according to one or more embodiments disclosed herein.

The bearing fluid supply line 296 may be fluidly coupled to the bearing housing 268 and configured to provide a bearing fluid from the bearing fluid supply 292, into the bearing housing 268, and to the thrust bearing 310, as depicted in FIG. 2. The bearing fluid supply line 296 may be one fluid line or split into multiple fluid lines feeding into the bearing housing 268. Generally, the bearing fluid supply line 296 may be fluidly coupled to a bearing fluid supply manifold 297 disposed on or in the bearing housing 268. The bearing fluid supply manifold 297 may be a header or a gas manifold configured to receive incoming bearing fluid or gas (e.g., bearing fluid) and distribute to one or multiple bearing supply pressure lines 287, as illustrated in FIGS. 4 and 5. The bearing supply pressure lines 287 may be fluidly coupled to the bearing fluid supply manifold 297 and configured to provide the bearing fluid into different portions of the bearing housing 268 and to the thrust bearing 310 including the turbine-side thrust face 330 and the pump-side thrust face 340.

In one or more exemplary embodiments, the bearing fluid is carbon dioxide or at least contains carbon dioxide. In other embodiments, a portion of the working fluid may be diverted from the working fluid circuit 202 or another source (e.g., storage tank or conditioning system) and utilized as the bearing fluid. Therefore, the bearing fluid and the working fluid may each independently contain carbon dioxide, such as supercritical carbon dioxide.

FIG. 2 further depicts that the bearing fluid drain line 298 may be fluidly coupled to the bearing housing 268 and configured to remove the bearing fluid from the thrust bearing 310 and the bearing housing 268. The bearing fluid drain line 298 may be fluidly coupled to a bearing fluid drain manifold 299 disposed on or in the bearing housing 268. The bearing fluid drain line 298 may be a header or a gas manifold configured to remove outgoing fluid or gas (e.g., bearing fluid) and transfer to one or multiple bearing drain pressure lines 289, as illustrated in FIG. 5. The bearing drain pressure lines 289 may be fluidly coupled to the bearing fluid drain manifold 299 and configured to remove or exhaust the bearing fluid from the thrust bearing 310 including the turbine-side thrust face 330 and the pump-side thrust face 340. The bearing drain pressure lines 289 may merge together as a single fluid line and extend to the bearing fluid return 294.

The turbopump back-pressure regulator valve 290 may be fluidly coupled to the bearing fluid drain line 298 and configured to control flow through the bearing fluid drain line 298, such as between the bearing housing 268 and the bearing fluid return 294. The turbopump back-pressure regulator valve 290 may be configured to control the pressure, via back-pressure, within the bearing fluid drain line 298, the bearing fluid drain manifold 299, the bearing drain pressure line 289, the turbine-side bearing pockets 332 and the pump-side bearing pockets 342, the bearing supply pressure lines 287, and the bearing fluid supply manifold 297.

Figure 6B:
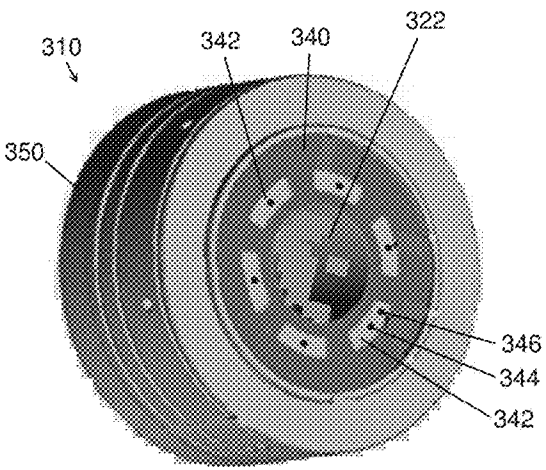
FIGS. 6A and 6B depict isometric-views of the thrust bearing illustrated in FIGS. 3 and 4, according to one or more embodiments disclosed herein.
Figure 6A:
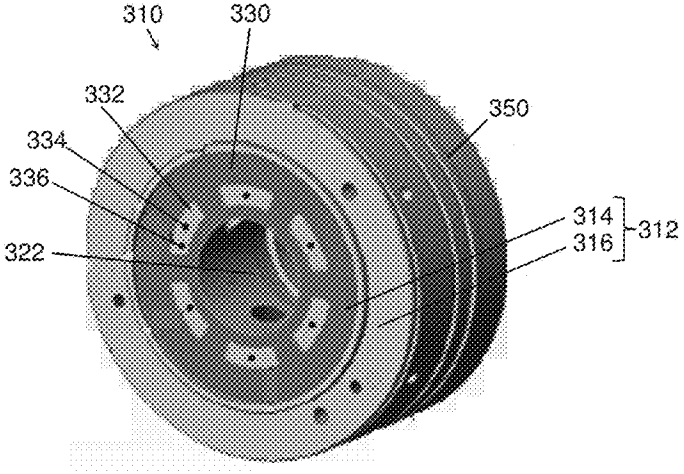

In other exemplary embodiments, as depicted in FIGS. 3-6B, the thrust bearing 310 further contains a cylindrical body 312, a turbine-side thrust face 330, a pump-side thrust face 340, a circumferential side surface 350, and a central orifice 322 defined by and extending through the cylindrical body 312. FIG. 5 depicts a cross-sectional view of the thrust bearing 310 and FIGS. 6A and 6B depict isometric-views of the thrust bearing 310. The central orifice 322 extends along a common central axis 320 of the cylindrical body 312, between the turbine-side thrust face 330 and the pump-side thrust face 340, and through the cylindrical body 312. The cylindrical body 312 of the thrust bearing 310 may have an inner portion 314 and an outer portion 316 aligned with the common central axis 320. The inner portion 314 and the outer portion 316 of the thrust bearing 310 are enabled to move relative to each other. Generally, the inner portion 314 may be configured to have movement with the driveshaft 267 and the outer portion 316 may be configured to remain stationary relative to the inner portion 314 and the driveshaft 267.

The turbine-side thrust face 330 has a plurality of bearing pockets, such as turbine-side bearing pockets 332, extending below the turbine-side thrust face 330 and facing the drive turbine 264. Similarly, the pump-side thrust face 340 has a plurality of bearing pockets, such as pump-side bearing pockets 342, extending below the pump-side thrust face 340 and facing the pump portion 262. Generally, the plurality of pump-side bearing pockets 342 contains from about 2 bearing pockets to about 12 bearing pockets and the plurality of turbine-side bearing pockets 332 contains from about 2 bearing pockets to about 12 bearing pockets. In one exemplary embodiment, the plurality of pump-side bearing pockets 342 contains from about 4 bearing pockets to about 8 bearing pockets, for example, about 6 bearing pockets and the plurality of turbine-side bearing pockets 332 contains from about 4 bearing pockets to about 8 bearing pockets, for example, about 6 bearing pockets.

In some exemplary embodiments, each bearing pocket of the turbine-side bearing pockets 332 and the pump-side bearing pockets 342 may have a surface area, as measured on the lower surface of the pocket area, within a range from about 0.05 $in^2$ (about 0.32 $cm^2$) to about 1 $in^2$ (about 6.45 $cm^2$), more narrowly within a range from about 0.08 $in^2$ (about 0.52 $cm^2$) to about 0.8 $in^2$ (about 5.16 $cm^2$), more narrowly within a range from about 0.1 $in^2$ (about 0.65 $cm^2$) to about 0.5 $in^2$ (about 3.23 $cm^2$), and more narrowly within a range from about 0.2 $in^2$ (about 1.29 $cm^2$) to about 0.3 $in^2$ (about 2.94 $cm^2$), for example, about 0.25 $in^2$ (about 1.61 $cm^2$). Also, each bearing pocket of the turbine-side bearing pockets 332 and the pump-side bearing pockets 342 may have a pocket depth within a range from about 0.010 in (about 0.25 mm) to about 0.060 in (about 1.62 mm), more narrowly within a range from about 0.015 in (about 0.38 mm) to about 0.050 in (about 1.27 mm), more narrowly within a range from about 0.020 in (about 0.51 mm) to about 0.040 in (about 1.02 mm), and more narrowly within a range from about 0.028 in (about 0.71 mm) to about 0.032 in (about 0.81 mm), for example, about 0.030 in (about 0.76 mm).

Each of the turbine-side bearing pockets 332 contains a pocket orifice 334 and each of the pump-side bearing pockets 342 contains a pocket orifice 344. The bearing pockets 332, 342 are configured to receive the bearing fluid from the bearing supply pressure lines 287 on each side of the thrust bearing 310 and to discharge the bearing fluid into their respective pocket orifices 334, 344. The pocket orifices 334, 344 extend from their respective bearing pockets 332, 342, through the inner portion 314, through the outer portion 316, out of the circumferential side surface 350 and to the bearing fluid drain manifold 299. In another exemplary embodiment, each of the turbine-side thrust face 330 and the pump-side thrust face 340 has at least one pressure tap, such as a pressure tap 336 in one of the turbine-side bearing pockets 332 and a pressure tap 346 in one of the pump-side bearing pockets 342.

The circumferential side surface 350 may extend along the circumference of the cylindrical body 312 and between the pump-side thrust face 340 and the turbine-side thrust face 330. The central orifice 322 extends through the cylindrical body 312 along the central axis 320 and may be configured to provide passage of the driveshaft 267 therethrough.

Figure 7:
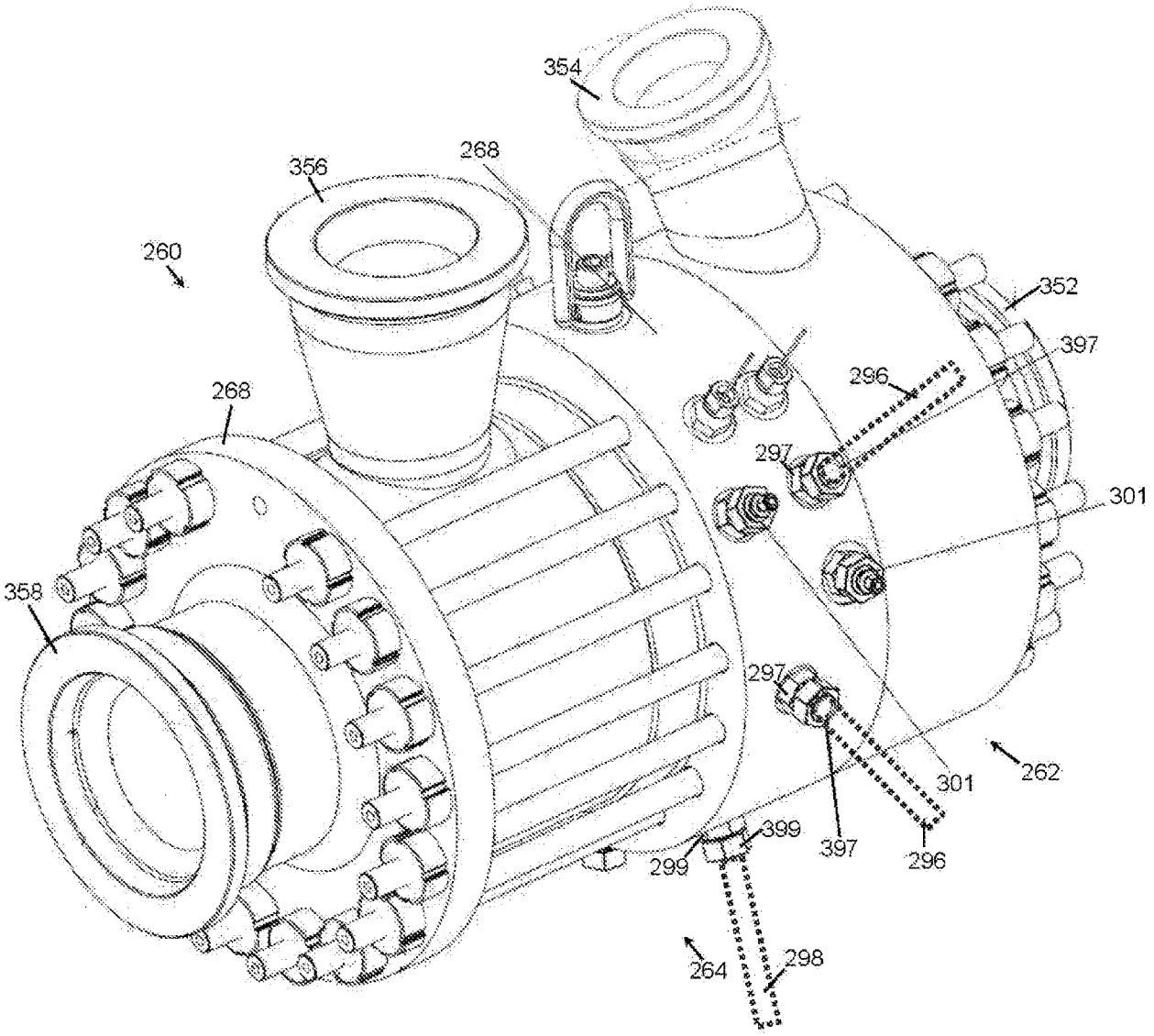
FIG. 7 depicts the turbopump illustrated in FIG. 1, including additional components and details, according to one or more embodiments disclosed herein.

FIG. 7 depicts the turbopump 260 from a perspective from outside of the bearing housing 268, according to one or more embodiments disclosed herein. The pump portion 262 and the drive turbine 264 are contained within the bearing housing 268 which may have multiple inlets, outlets, ports, intakes/discharges, and other devices for coupling to internal components of the turbopump 260. A pump inlet 352 and a pump discharge 354 may be fluidly coupled to the pump portion 262 of the turbopump 260 within the bearing housing 268. The pump inlet 352 may be configured to be fluidly coupled to the low pressure side of the working fluid circuit 202 and the pump discharge 354 may be configured to be fluidly coupled to the high pressure side of the working fluid circuit 202. A turbine inlet 356 and a turbine discharge 358 may be fluidly coupled to the pump portion 262 of the turbopump 260 within the bearing housing 268. The turbine inlet 356 may be configured to be fluidly coupled to the high pressure side of the working fluid circuit 202 and the turbine discharge 358 may be configured to be fluidly coupled to the low pressure side of the working fluid circuit 202.

FIG. 7 further depicts several bearing fluid supply inlets 397 on the bearing fluid supply manifold 297, as well as at least one bearing fluid drain outlet 399 on the bearing fluid drain manifold 299. The bearing fluid supply inlets 397 may be configured to be fluidly coupled to the bearing fluid supply line 296, as depicted in FIG. 7, such that the bearing fluid may flow from the bearing fluid supply line 296, through the bearing fluid supply inlets 397, and into the bearing fluid supply manifold 297. Once within the bearing fluid supply manifold 297, the bearing gas may flow through the bearing supply pressure lines 287 and to the thrust bearing 310, as illustrated in FIG. 5. Subsequently, upon flowing away from the thrust bearing 310, the bearing fluid may flow through the bearing drain pressure line 289 and into the bearing fluid drain manifold 299, as illustrated in FIG. 5. The bearing fluid drain outlet 399 may be configured to be fluidly coupled to the bearing fluid drain manifold 299, as depicted in FIG. 7, such that the bearing fluid contained within the bearing fluid drain manifold 299 may be flowed from the bearing fluid drain manifold 299, through the bearing fluid drain outlet 399, and to the bearing fluid drain line 298.

The turbopump 260 may further contain one or more pressure monitor ports 301, as depicted in FIG. 7. The pressure monitor ports 301 may be configured to receive sensors or other instruments for measuring and monitoring pressures, temperatures, flowrates, and other properties within the bearing housing 268, such as near the turbine-side thrust face 330 and the pump-side thrust face 340, as well as within the turbine-side bearing pockets 332, the pocket orifice 334, the pump-side bearing pockets 342, and/or the pocket orifice 344.

In one or more exemplary embodiments, the control algorithm contains a sliding mode controller configured to provide a sliding mode control method for controlling the turbopump back-pressure regulator valve 290. The control algorithm generally contains a plurality of loop controllers configured to control the turbopump back-pressure regulator valve 290 while adjusting values of pocket pressure ratios for bearing surfaces of the thrust bearing 310. The plurality of loop controllers may be configured to adjust, modulate, or otherwise control the turbopump back-pressure regulator valve 290 in order maintain or obtain a balanced thrust of the turbopump 260. The control algorithm may be incorporated or otherwise contained within the computer system 206 as part of the process control system 204.

Figure 8:
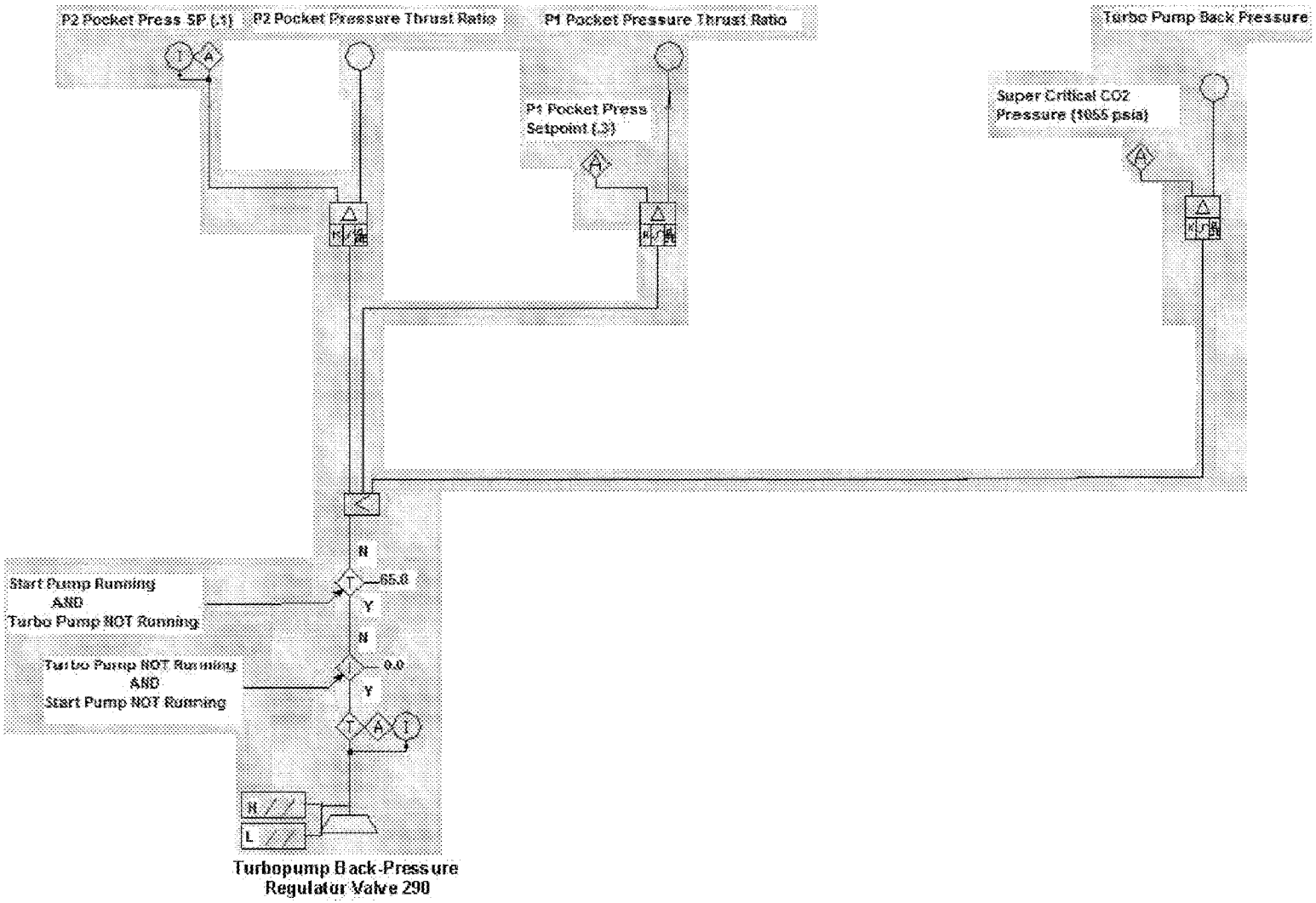
FIG. 8 depicts a schematic diagram of a system controller configured to operate the turbopump back-pressure regulator valve, according to one or more embodiments disclosed herein.

FIG. 8 depicts a schematic diagram of a system controller configured to operate the turbopump back-pressure regulator valve 290, according to one or more embodiments disclosed herein. The control algorithm may contain at least a primary governing loop controller, a secondary governing loop controller, and a tertiary governing loop controller. In some exemplary embodiments, the control algorithm may be configured to calculate valve positions for the turbopump back-pressure regulator valve 290 for providing the pump-side pocket pressure ratio (P2) of about 0.25 or less with the primary governing loop controller, the turbine-side pocket pressure ratio (P1) of about 0.25 or greater with the secondary governing loop controller, and a bearing fluid supply pressure at or greater than a critical pressure value for the bearing fluid.

The turbine-side pocket pressure ratio (P1), the pump-side pocket pressure ratio (P2), and the thrust force ($F_{thrust}$) may be calculated with the following equations:

$$P1=(PP1-P_{drain})/(P_{supply}-P_{drain}),$$

$$P2=(PP2-P_{drain})/(P_{supply}-P_{drain}), \text{ and}$$

$$F_{thrusf}=TA_{pocket}(PP1-PP2),$$

where:

PP1 is the pocket pressure on the turbine-side thrust face 330 in the turbine-side bearing pocket 332 and may be measured at the pressure tap 336, PP2 is the pocket pressure on the pump-side thrust face 340 in the pump-side bearing pocket 342 and may be measured at the pressure tap 346, $P_{supply}$ is the supply pressure of the bearing fluid and may be measured in the bearing supply pressure line 287, the bearing fluid supply manifold 297, and/or the bearing fluid supply line 296, $P_{drain}$ is the drain pressure of the bearing fluid and may be measured in the bearing drain pressure line 289, the bearing fluid drain manifold 299, and/or the bearing fluid drain line 298, $F_{thrust}$=is the thrust force, such as the thrust bearing load capacity in each direction, and $TA_{pocket}$ is the total area of the bearing pockets, which is the product of the number of—pocket is bearing pockets on one thrust face and the surface area of the bearing pocket.

In one exemplary embodiment, the primary governing loop controller may be configured to adjust the turbopump back-pressure regulator valve 290 for maintaining the pump-side pocket pressure ratio (P2) of about 0.30 or less, such as about 0.25 or less, such as about 0.20 or less, such as about 0.15 or less. In another exemplary embodiment, the primary governing loop controller may be configured to activate and adjust the turbopump back-pressure regulator valve 290 if a pump-side pocket pressure ratio (P2) of about 0.25 or greater is detected by the process control system 204. The pump-side pocket pressure ratio (P2) may be measured and monitored on a pump-side thrust face 340 of the thrust bearing 310, such as with a probe or a sensor at the pressure tap 346. The pump-side thrust face 340 has a plurality of pump-side bearing pockets 342 extending below the pump-side thrust face 340 and facing the pump portion 262. The pump-side pocket pressure ratio (P2) may be measured in the pump-side bearing pockets 342. In one exemplary embodiment, the plurality of pump-side bearing pockets 342 contains about 10 bearing pockets or less and the pump-side pocket pressure ratio (P2) is about 0.25 or less.

In one exemplary embodiment, the secondary governing loop controller may be configured to adjust the turbopump back-pressure regulator valve 290 for maintaining the turbine-side pocket pressure ratio (P1) of about 0.30 or less, such as about 0.25 or less, such as about 0.20 or less, such as about 0.15 or less. In another exemplary embodiment, the secondary governing loop controller may be configured to activate and adjust the turbopump back-pressure regulator valve 290 if the turbine-side pocket pressure ratio (P1) of about 0.25 or greater is detected by the process control system 204. The turbine-side pocket pressure ratio (P1) may be measured on a turbine-side thrust face 330 of the thrust bearing 310. The turbine-side thrust face 330 has a plurality of turbine-side bearing pockets 332 extending below the turbine-side thrust face 330 and facing the drive turbine 264. The turbine-side pocket pressure ratio (P1) may be measured and monitored in the turbine-side bearing pockets 332, such as with a probe or a sensor at the pressure tap 336. In one exemplary embodiment, the plurality of turbine-side bearing pockets 332 contains about 10 bearing pockets or less and the turbine-side pocket pressure ratio (P1) is about 0.25 or less.

In one exemplary embodiment, the tertiary governing loop controller may be configured to activate and adjust the turbopump back-pressure regulator valve 290 if an undesirable pressure of the bearing fluid is detected by the process control system 204. The undesirable pressure of the bearing fluid may be detected at or near the bearing fluid supply line 296. In one example, the undesirable pressure of the bearing fluid may be about 5% greater than the supercritical pressure of the bearing fluid or less.

In another exemplary embodiment, the tertiary governing loop controller may be configured to adjust the turbopump back-pressure regulator valve 290 for maintaining the bearing fluid in a supercritical state. In other exemplary embodiments, the tertiary governing loop controller may be configured to adjust the turbopump back-pressure regulator valve 290 for maintaining a bearing drain pressure of about 1,055 psi or greater. In other exemplary embodiments, the thrust force ($F_{thrust}$), such as the thrust bearing load capacity in each direction, may be within a range from about 4,000 pound-force (lbf) (about 17.8 kilonewton (kN) to about 8,000 lbf (about 35.6 kN), more narrowly within a range from about 5,000 lbf (about 22.2 kN) to about 7,000 lbf (about 31.1 kN), and more narrowly within a range from about 5,500 lbf (about 24.5 kN) to about 6,200 lbf (about 27.6 kN), for example, about 5,700 lbf (about 25.4 kN).

In another exemplary embodiment, a method for lubricating and/or cooling the turbopump 260 in the heat engine systems 90, 200 is provided and includes circulating and/or pressuring the working fluid throughout the working fluid circuit 202 with the turbopump 260, wherein the working fluid circuit 202 has a high pressure side and a low pressure side and at least a portion of the working fluid is in a supercritical state and transferring thermal energy from the heat source stream 110 to the working fluid through at least one of the heat exchangers 120, 130, 150. The heat exchangers 120, 130, 150 may be fluidly coupled to and in thermal communication with the high pressure side of the working fluid circuit 202 and fluidly coupled to and in thermal communication with the heat source stream 110.

The method further includes measuring and monitoring a turbine-side pocket pressure ratio (P1), a pump-side pocket pressure ratio (P2), a bearing fluid supply pressure, and a bearing fluid drain pressure via the process control system 204 operatively coupled to the working fluid circuit 202, wherein the turbine-side pocket pressure ratio (P1) may be measured and/or monitored in at least one turbine-side bearing pocket 332 of a plurality of turbine-side bearing pockets 332 disposed on a turbine-side thrust face 330 of the thrust bearing 310 within the turbopump 260, the pump-side pocket pressure ratio (P2) may be measured and/or monitored in at least one pump-side bearing pocket 342 of a plurality of pump-side bearing pockets 342 disposed on a pump-side thrust face 340 of the thrust bearing 310, the bearing fluid supply pressure may be measured and/or monitored in at least one bearing supply pressure line 287 disposed upstream of the thrust bearing 310, and the bearing fluid drain pressure may be measured and/or monitored in at least one bearing drain pressure line 289 disposed downstream of the thrust bearing 310.

The method also includes controlling the turbopump back-pressure regulator valve 290 by the primary governing loop controller embedded in the process control system 204. The turbopump back-pressure regulator valve 290 may be fluidly coupled to the bearing fluid drain line 298 disposed downstream of the thrust bearing 310 and the primary governing loop controller may be configured to modulate the turbopump back-pressure regulator valve 290 while adjusting the pump-side pocket pressure ratio (P2). The method further includes controlling the turbopump back-pressure regulator valve 290 by the secondary governing loop controller embedded in the process control system 204. The secondary governing loop controller may be configured to modulate the turbopump back-pressure regulator valve 290 while adjusting the turbine-side pocket pressure ratio (P1). The method also includes controlling the turbopump back-pressure regulator valve 290 by the tertiary governing loop controller embedded in the process control system 204. The tertiary governing loop controller may be configured to modulate the turbopump back-pressure regulator valve 290 while adjusting the bearing fluid supply pressure to be at or greater than a critical pressure value for the bearing fluid and maintain the bearing fluid in a supercritical state.

In another exemplary embodiment, a method for lubricating and/or cooling the turbopump 260 in the heat engine systems 90, 200 is provided and includes controlling the turbopump back-pressure regulator valve 290 by the primary governing loop controller embedded in the process control system 204, wherein the turbopump back-pressure regulator valve 290 may be fluidly coupled to the bearing fluid drain line 298 disposed downstream of the thrust bearing 310 and the primary governing loop controller may be configured to modulate the turbopump back-pressure regulator valve 290 while adjusting the pump-side pocket pressure ratio (P2).

The method further includes detecting an undesirable value of the turbine-side pocket pressure ratio (P1) via the process control system 204 and subsequently activating the secondary governing loop controller embedded in the process control system 204, deactivating the primary governing loop controller, and decreasing the turbine-side pocket pressure ratio (P1) to a desirable value. The undesirable value of the turbine-side pocket pressure ratio (P1) is greater than a predetermined threshold value of the turbine-side pocket pressure ratio (P1) and the desirable value of the turbine-side pocket pressure ratio (P1) is at or less than the predetermined threshold value of the turbine-side pocket pressure ratio (P1). The secondary governing loop controller may be configured to decrease the turbine-side pocket pressure ratio (P1) by modulating the turbopump back-pressure regulator valve 290. The method also includes detecting an undesirable value of the bearing fluid supply pressure via the process control system 204 and subsequently activating the tertiary governing loop controller embedded in the process control system 204, deactivating the primary governing loop controller or the secondary governing loop controller, and increasing the bearing fluid supply pressure to a desirable value. The undesirable value of the bearing fluid supply pressure is less than a critical pressure value for the bearing fluid and the desirable value of the bearing fluid supply pressure is at or greater than a critical pressure value for the bearing fluid. The tertiary governing loop controller may be configured to increase the bearing fluid supply pressure by modulating the turbopump back-pressure regulator valve 290 while increasing the bearing fluid drain pressure.

In one exemplary embodiment, the method may further include adjusting the pump-side pocket pressure ratio (P2) by modulating the turbopump back-pressure regulator valve 290 with the primary governing loop controller to obtain or maintain a pump-side pocket pressure ratio (P2) of about 0.25 or less. In another exemplary embodiment, the method may also include adjusting the turbine-side pocket pressure ratio (P1) by modulating the turbopump back-pressure regulator valve 290 with the secondary governing loop controller to obtain or maintain a turbine-side pocket pressure ratio (P1) of about 0.25 or greater. In another exemplary embodiment, the method may further include adjusting the turbopump back-pressure regulator valve 290 with the tertiary governing loop controller to obtain or maintain the bearing drain pressure of about 1,055 psi or greater.

Generally, the bearing fluid supply pressure may be increased until the bearing fluid is in a supercritical state. In one exemplary embodiment, the method further includes regulating and maintaining the bearing fluid in a supercritical state and in physical contact or thermal communication with the thrust bearing 310. The relatively cool temperature of the supercritical bearing fluid (e.g., sc-$CO_2$) helps to prevent damage to the thrust bearing 310.

In another exemplary embodiment, the method includes modulating the turbopump back-pressure regulator valve 290 to control the flow of the bearing fluid passing through the bearing fluid drain line 298. The turbopump back-pressure regulator valve 290 is adjusted to partially opened-positions that are within a range from about 35% to about 80% of being in a fully opened-position. Therefore, the valve position or modulation range of the turbopump back-pressure regulator valve 290 may be within a range from about 10% to about 95% of being in a fully opened-position, more narrowly, within a range from about 20% to about 90% of being in a fully opened-position, more narrowly, within a range from about 30% to about 85% of being in a fully opened-position, and more narrowly, within a range from about 35% to about 80% of being in a fully opened-position. In one exemplary embodiment, such as at the start-up of the start pump 280, the valve position or modulation range of the turbopump back-pressure regulator valve 290 may be within a range from about 50% to about 75%, more narrowly, within a range from about 55% to about 70% of being in a fully opened-position, and more narrowly, within a range from about 60% to about 65% of being in a fully opened-position.

Figure 9:
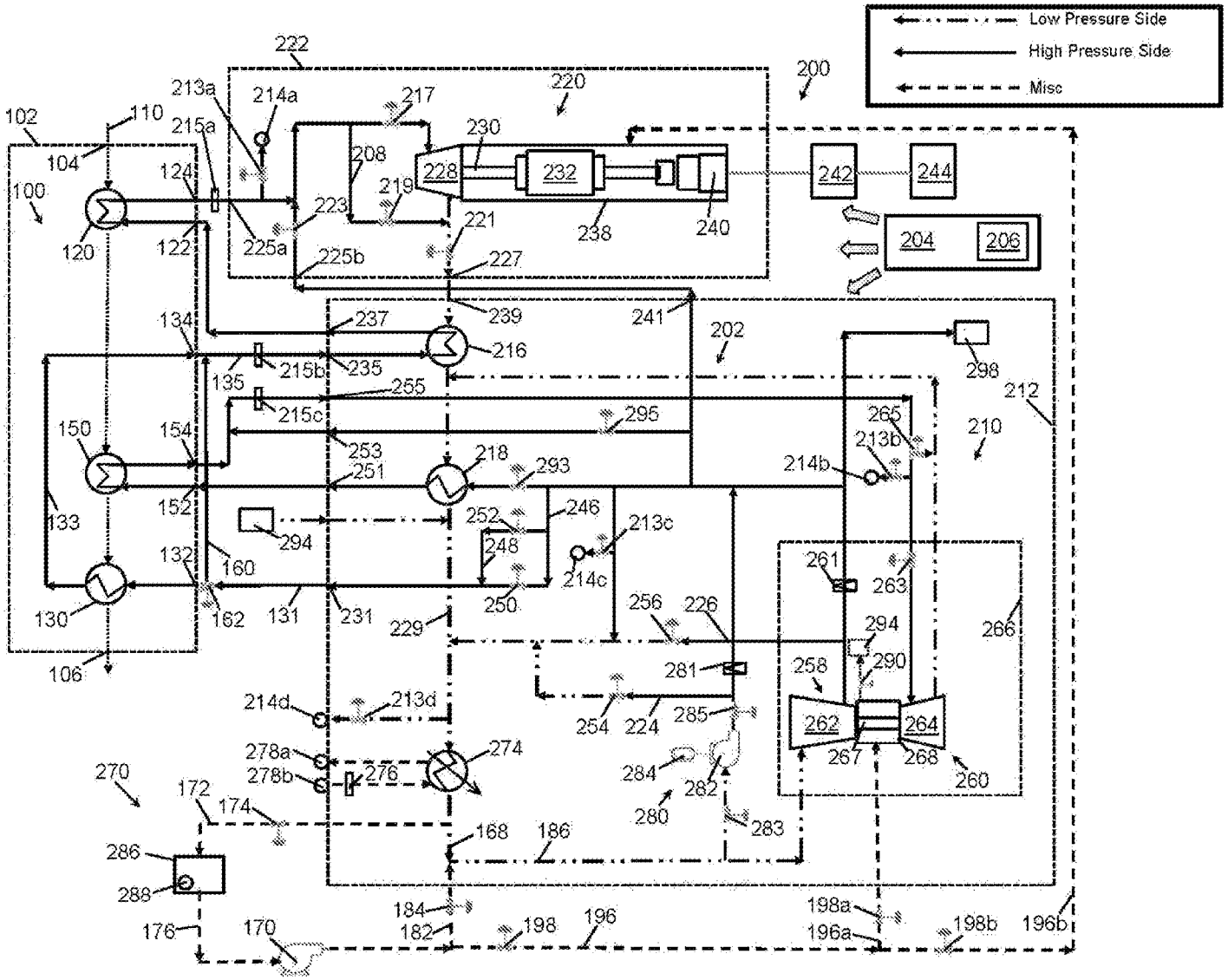
FIG. 9 depicts another exemplary heat engine system containing the turbopump system with the turbopump and the turbopump back-pressure regulator valve, according to one or more embodiments disclosed herein.

FIG. 9 depicts an exemplary heat engine system 200 that contains the process system 210 and the power generation system 220 fluidly coupled to and in thermal communication with the waste heat system 100 via the working fluid circuit 202, as described in one of more embodiments herein. The heat engine system 200 may be referred to as a thermal engine system, an electrical generation system, a waste heat or other heat recovery system, and/or a thermal to electrical energy system, as described in one of more embodiments herein. The heat engine system 200 is generally configured to encompass one or more elements of a Rankine cycle, a derivative of a Rankine cycle, or another thermodynamic cycle for generating electrical energy from a wide range of thermal sources. The heat engine system 200 depicted in FIG. 9 and the heat engine systems 90 depicted in Figurel share many common components. It should be noted that like numerals shown in the Figures and discussed herein represent like components throughout the multiple embodiments disclosed herein.

In one or more embodiments described herein, FIG. 9 depicts the working fluid circuit 202 containing the working fluid and having a high pressure side and a low pressure side, wherein at least a portion of the working fluid contains carbon dioxide in a supercritical state. In many examples, the working fluid contains carbon dioxide and at least a portion of the carbon dioxide is in a supercritical state. The heat engine system 200 also has the heat exchanger 120 fluidly coupled to and in thermal communication with the high pressure side of the working fluid circuit 202, configured to be fluidly coupled to and in thermal communication with the heat source stream 110, and configured to transfer thermal energy from the heat source stream 110 to the working fluid within the working fluid circuit 202. The heat exchanger 120 may be fluidly coupled to the working fluid circuit 202 upstream of the power turbine 228 and downstream of a recuperator 216.

The heat engine system 200 further contains the power turbine 228 disposed between the high pressure side and the low pressure side of the working fluid circuit 202, fluidly coupled to and in thermal communication with the working fluid, and configured to convert thermal energy to mechanical energy by a pressure drop in the working fluid flowing between the high and the low pressure sides of the working fluid circuit 202. The heat engine system 200 also contains a power generator 240 coupled to the power turbine 228 and configured to convert the mechanical energy into electrical energy, the power outlet 242 electrically coupled to the power generator 240 and configured to transfer the electrical energy from the power generator 240 to the electrical grid 244.

The heat engine system 200 further contains the turbopump 260 which has a drive turbine 264 and the pump portion 262. The pump portion 262 of the turbopump 260 may be fluidly coupled to the low pressure side of the working fluid circuit 202 by an inlet configured to receive the working fluid from the low pressure side of the working fluid circuit 202, fluidly coupled to the high pressure side of the working fluid circuit 202 by an outlet configured to release the working fluid into the high pressure side of the working fluid circuit 202, and configured to circulate the working fluid within the working fluid circuit 202. The drive turbine 264 of the turbopump 260 may be fluidly coupled to the high pressure side of the working fluid circuit 202 by an inlet configured to receive the working fluid from the high pressure side of the working fluid circuit 202, fluidly coupled to the low pressure side of the working fluid circuit 202 by an outlet configured to release the working fluid into the low pressure side of the working fluid circuit 202, and configured to rotate the pump portion 262 of the turbopump 260.

In some embodiments, the heat exchanger 150 may be configured to be fluidly coupled to and in thermal communication with the heat source stream 110. Also, the heat exchanger 150 may be fluidly coupled to and in thermal communication with the high pressure side of the working fluid circuit 202. Therefore, thermal energy may be transferred from the heat source stream 110, through the heat exchanger 150, and to the working fluid within the working fluid circuit 202. The heat exchanger 150 may be fluidly coupled to the working fluid circuit 202 upstream of the outlet of the pump portion 262 of the turbopump 260 and downstream of the inlet of the drive turbine 264 of the turbopump 260. The drive turbine throttle valve 263 may be fluidly coupled to the working fluid circuit 202 downstream of the heat exchanger 150 and upstream of the inlet of the drive turbine 264 of the turbopump 260. The working fluid containing the absorbed thermal energy flows from the heat exchanger 150 to the drive turbine 264 of the turbopump 260 via the drive turbine throttle valve 263. Therefore, in some embodiments, the drive turbine throttle valve 263 may be utilized to control the flowrate of the heated working fluid flowing from the heat exchanger 150 to the drive turbine 264 of the turbopump 260.

In some embodiments, the recuperator 216 may be fluidly coupled to the working fluid circuit 202 and configured to transfer thermal energy from the working fluid within the low pressure side to the working fluid within the high pressure side of the working fluid circuit 202. In other embodiments, a recuperator 218 may be fluidly coupled to the working fluid circuit 202 downstream of the outlet of the pump portion 262 of the turbopump 260 and upstream of the heat exchanger 150 and configured to transfer thermal energy from the working fluid within the low pressure side to the working fluid within the high pressure side of the working fluid circuit 202.

FIG. 9 further depicts that the waste heat system 100 of the heat engine system 200 contains three heat exchangers (e.g., the heat exchangers 120, 130, and 150) fluidly coupled to the high pressure side of the working fluid circuit 202 and in thermal communication with the heat source stream 110. Such thermal communication provides the transfer of thermal energy from the heat source stream 110 to the working fluid flowing throughout the working fluid circuit 202. In one or more embodiments disclosed herein, two, three, or more heat exchangers may be fluidly coupled to and in thermal communication with the working fluid circuit 202, such as a primary heat exchanger, a secondary heat exchanger, a tertiary heat exchanger, respectively the heat exchangers 120, 150, and 130, and/or an optional quaternary heat exchanger (not shown). For example, the heat exchanger 120 may be the primary heat exchanger fluidly coupled to the working fluid circuit 202 upstream of an inlet of the power turbine 228, the heat exchanger 150 may be the secondary heat exchanger fluidly coupled to the working fluid circuit 202 upstream of an inlet of the drive turbine 264 of the turbine pump 260, and the heat exchanger 130 may be the tertiary heat exchanger fluidly coupled to the working fluid circuit 202 upstream of an inlet of the heat exchanger 120.

The waste heat system 100 also contains an inlet 104 for receiving the heat source stream 110 and an outlet 106 for passing the heat source stream 110 out of the waste heat system 100. The heat source stream 110 flows through and from the inlet 104, through the heat exchanger 120, through one or more additional heat exchangers, if fluidly coupled to the heat source stream 110, and to and through the outlet 106. In some examples, the heat source stream 110 flows through and from the inlet 104, through the heat exchangers 120, 150, and 130, respectively, and to and through the outlet 106. The heat source stream 110 may be routed to flow through the heat exchangers 120, 130, 150, and/or additional heat exchangers in other desired orders.

The heat source stream 110 may be a waste heat stream such as, but not limited to, gas turbine exhaust stream, industrial process exhaust stream, or other combustion product exhaust streams, such as furnace or boiler exhaust streams. The heat source stream 110 may be at a temperature within a range from about 100° C. to about 1,000° C., or greater than 1,000° C., and in some examples, within a range from about 200° C. to about 800° C., more narrowly within a range from about 300° C. to about 700° C., and more narrowly within a range from about 400° C. to about 600° C., for example, within a range from about 500° C. to about 550° C. The heat source stream 110 may contain air, carbon dioxide, carbon monoxide, water or steam, nitrogen, oxygen, argon, derivatives thereof, or mixtures thereof. In some embodiments, the heat source stream 110 may derive thermal energy from renewable sources of thermal energy, such as solar or geothermal sources.

In some embodiments, the types of working fluid that may be circulated, flowed, or otherwise utilized in the working fluid circuit 202 of the heat engine system 200 include carbon oxides, hydrocarbons, alcohols, ketones, halogenated hydrocarbons, ammonia, amines, aqueous, or combinations thereof. Exemplary working fluids that may be utilized in the heat engine system 200 include carbon dioxide, ammonia, methane, ethane, propane, butane, ethylene, propylene, butylene, acetylene, methanol, ethanol, acetone, methyl ethyl ketone, water, derivatives thereof, or mixtures thereof. Halogenated hydrocarbons may include hydrochlorofluorocarbons (HCFCs), hydrofluorocarbons (HFCs) (e.g., 1,1,1,3,3-pentafluoropropane (R245fa)), fluorocarbons, derivatives thereof, or mixtures thereof.

In many embodiments described herein, the working fluid circulated, flowed, or otherwise utilized in the working fluid circuit 202 of the heat engine system 200, and the other exemplary circuits disclosed herein, may be or may contain carbon dioxide ($CO_2$) and mixtures containing carbon dioxide. Generally, at least a portion of the working fluid circuit 202 contains the working fluid in a supercritical state (e.g., sc-$CO_2$). Carbon dioxide utilized as the working fluid or contained in the working fluid for power generation cycles has many advantages over other compounds typical used as working fluids, since carbon dioxide has the properties of being non-toxic and non-flammable and is also easily available and relatively inexpensive. Due in part to a relatively high working pressure of carbon dioxide, a carbon dioxide system may be much more compact than systems using other working fluids. The high density and volumetric heat capacity of carbon dioxide with respect to other working fluids makes carbon dioxide more "energy dense" meaning that the size of all system components can be considerably reduced without losing performance. It should be noted that use of the terms carbon dioxide ($CO_2$), supercritical carbon dioxide (sc-$CO_2$), or subcritical carbon dioxide (sub-$CO_2$) is not intended to be limited to carbon dioxide of any particular type, source, purity, or grade. For example, industrial grade carbon dioxide may be contained in and/or used as the working fluid without departing from the scope of the disclosure.

In other exemplary embodiments, the working fluid in the working fluid circuit 202 may be a binary, ternary, or other working fluid blend. The working fluid blend or combination can be selected for the unique attributes possessed by the fluid combination within a heat recovery system, as described herein. For example, one such fluid combination includes a liquid absorbent and carbon dioxide mixture enabling the combined fluid to be pumped in a liquid state to high pressure with less energy input than required to compress carbon dioxide. In another exemplary embodiment, the working fluid may be a combination of carbon dioxide (e.g., sub-$CO_2$ or sc-$CO_2$) and one or more other miscible fluids or chemical compounds. In yet other exemplary embodiments, the working fluid may be a combination of carbon dioxide and propane, or carbon dioxide and ammonia, without departing from the scope of the disclosure.

The working fluid circuit 202 generally has a high pressure side and a low pressure side and contains a working fluid circulated within the working fluid circuit 202. The use of the term "working fluid" is not intended to limit the state or phase of matter of the working fluid. For instance, the working fluid or portions of the working fluid may be in a liquid phase, a gas phase, a fluid phase, a subcritical state, a supercritical state, or any other phase or state at any one or more points within the heat engine system 200 or thermodynamic cycle. In one or more embodiments, the working fluid is in a supercritical state over certain portions of the working fluid circuit 202 of the heat engine system 200 (e.g., a high pressure side) and in a subcritical state over other portions of the working fluid circuit 202 of the heat engine system 200 (e.g., a low pressure side). FIG. 9 depicts the high and low pressure sides of the working fluid circuit 202 of the heat engine system 200 by representing the high pressure side with "------" and the low pressure side with "-.-.-."—as described in one or more embodiments. In other embodiments, the entire thermodynamic cycle may be operated such that the working fluid is maintained in either a supercritical or subcritical state throughout the entire working fluid circuit 202 of the heat engine system 200.

Generally, the high pressure side of the working fluid circuit 202 contains the working fluid (e.g., sc-$CO_2$) at a pressure of about 15 MPa or greater, such as about 17 MPa or greater or about 20 MPa or greater. In some examples, the high pressure side of the working fluid circuit 202 may have a pressure within a range from about 15 MPa to about 30 MPa, more narrowly within a range from about 16 MPa to about 26 MPa, more narrowly within a range from about 17 MPa to about 25 MPa, and more narrowly within a range from about 17 MPa to about 24 MPa, such as about 23.3 MPa. In other examples, the high pressure side of the working fluid circuit 202 may have a pressure within a range from about 20 MPa to about 30 MPa, more narrowly within a range from about 21 MPa to about 25 MPa, and more narrowly within a range from about 22 MPa to about 24 MPa, such as about 23 MPa.

The low pressure side of the working fluid circuit 202 contains the working fluid (e.g., $CO_2$ or sub-$CO_2$) at a pressure of less than 15 MPa, such as about 12 MPa or less or about 10 MPa or less. In some examples, the low pressure side of the working fluid circuit 202 may have a pressure within a range from about 4 MPa to about 14 MPa, more narrowly within a range from about 6 MPa to about 13 MPa, more narrowly within a range from about 8 MPa to about 12 MPa, and more narrowly within a range from about 10 MPa to about 11 MPa, such as about 10.3 MPa. In other examples, the low pressure side of the working fluid circuit 202 may have a pressure within a range from about 2 MPa to about 10 MPa, more narrowly within a range from about 4 MPa to about 8 MPa, and more narrowly within a range from about 5 MPa to about 7 MPa, such as about 6 MPa.

In some examples, the high pressure side of the working fluid circuit 202 may have a pressure within a range from about 17 MPa to about 23.5 MPa, and more narrowly within a range from about 23 MPa to about 23.3 MPa while the low pressure side of the working fluid circuit 202 may have a pressure within a range from about 8 MPa to about 11 MPa, and more narrowly within a range from about 10.3 MPa to about 11 MPa.

The heat engine system 200 further contains the power turbine 228 disposed between the high pressure side and the low pressure side of the working fluid circuit 202, disposed downstream of the heat exchanger 120, and fluidly coupled to and in thermal communication with the working fluid. The power turbine 228 may be configured to convert a pressure drop in the working fluid to mechanical energy whereby the absorbed thermal energy of the working fluid is transformed to mechanical energy of the power turbine 228. Therefore, the power turbine 228 is an expansion device capable of transforming a pressurized fluid into mechanical energy, generally, transforming high temperature and pressure fluid into mechanical energy, such as rotating a shaft.

The power turbine 228 may contain or be a turbine, a turbo, an expander, or another device for receiving and expanding the working fluid discharged from the heat exchanger 120. The power turbine 228 may have an axial construction or radial construction and may be a single-staged device or a multi-staged device. Exemplary turbines that may be utilized in power turbine 228 include an expansion device, a geroler, a gerotor, a valve, other types of positive displacement devices such as a pressure swing, a turbine, a turbo, or any other device capable of transforming a pressure or pressure/enthalpy drop in a working fluid into mechanical energy. A variety of different types of expanding devices may be utilized as the power turbine 228 to achieve various performance properties.

The power turbine 228 is generally coupled to the power generator 240 by the rotating shaft 230. The gearbox 232 is generally disposed between the power turbine 228 and the power generator 240 and adjacent or encompassing the rotating shaft 230. The rotating shaft 230 may be a single piece or contain two or more pieces coupled together. In one or more examples, a first segment of the rotating shaft 230 extends from the power turbine 228 to the gearbox 232, a second segment of the rotating shaft 230 extends from the gearbox 232 to the power generator 240, and multiple gears are disposed between and coupled to the two segments of the rotating shaft 230 within the gearbox 232.

In some configurations, the heat engine system 200 also provides for the delivery of a portion of the working fluid, seal gas, bearing gas, air, or other gas into a chamber or housing, such as a housing 238 within the power generation system 220 for purposes of cooling one or more parts of the power turbine 228. In other configurations, the rotating shaft 230 includes a seal assembly (not shown) designed to prevent or capture any working fluid leakage from the power turbine 228. Additionally, a working fluid recycle system may be implemented along with the seal assembly to recycle seal gas back into the working fluid circuit 202 of the heat engine system 200.

The power generator 240 may be a generator, an alternator (e.g., permanent magnet alternator), or other device for generating electrical energy, such as transforming mechanical energy from the rotating shaft 230 and the power turbine 228 to electrical energy. The power outlet 242 may be electrically coupled to the power generator 240 and configured to transfer the generated electrical energy from the power generator 240 and to the electrical grid 244. The electrical grid 244 may be or include an electrical grid, an electrical bus (e.g., plant bus), power electronics, other electric circuits, or combinations thereof. The electrical grid 244 generally contains at least one alternating current bus, alternating current grid, alternating current circuit, or combinations thereof. In one example, the power generator 240 is a generator and is electrically and operatively connected or coupled to the electrical grid 244 via the power outlet 242. In another example, the power generator 240 is an alternator and is electrically and operatively connected to power electronics (not shown) via the power outlet 242. In another example, the power generator 240 is electrically connected to power electronics which are electrically connected to the power outlet 242.

The power electronics may be configured to convert the electrical power into desirable forms of electricity by modifying electrical properties, such as voltage, current, or frequency. The power electronics may include converters or rectifiers, inverters, transformers, regulators, controllers, switches, resisters, storage devices, and other power electronic components and devices. In other embodiments, the power generator 240 may contain, be coupled with, or be other types of load receiving equipment, such as other types of electrical generation equipment, rotating equipment, a gearbox (e.g., the gearbox 232), or other device configured to modify or convert the shaft work created by the power turbine 228. In one embodiment, the power generator 240 is in fluid communication with a cooling loop having a radiator and a pump for circulating a cooling fluid, such as water, thermal oils, and/or other suitable refrigerants. The cooling loop may be configured to regulate the temperature of the power generator 240 and power electronics by circulating the cooling fluid to draw away generated heat.

The heat engine system 200 also provides for the delivery of a portion of the working fluid into a chamber or housing of the power turbine 228 for purposes of cooling one or more parts of the power turbine 228. In one embodiment, due to the potential need for dynamic pressure balancing within the power generator 240, the selection of the site within the heat engine system 200 from which to obtain a portion of the working fluid is critical because introduction of this portion of the working fluid into the power generator 240 should respect or not disturb the pressure balance and stability of the power generator 240 during operation. Therefore, the pressure of the working fluid delivered into the power generator 240 for purposes of cooling is the same or substantially the same as the pressure of the working fluid at an inlet of the power turbine 228. The working fluid is conditioned to be at a desired temperature and pressure prior to being introduced into the power turbine 228. A portion of the working fluid, such as the spent working fluid, exits the power turbine 228 at an outlet of the power turbine 228 and is directed to one or more heat exchangers or recuperators, such as recuperators 216 and 218. The recuperators 216 and 218 may be fluidly coupled to the working fluid circuit 202 in series with each other. The recuperators 216 and 218 are operative to transfer thermal energy between the high pressure side and the low pressure side of the working fluid circuit 202.

In one embodiment, the recuperator 216 is fluidly coupled to the low pressure side of the working fluid circuit 202, disposed downstream of a working fluid outlet on the power turbine 228, and disposed upstream of the recuperator 218 and/or the condenser 274. The recuperator 216 may be configured to remove at least a portion of thermal energy from the working fluid discharged from the power turbine 228. In addition, the recuperator 216 is also fluidly coupled to the high pressure side of the working fluid circuit 202, disposed upstream of the heat exchanger 120 and/or a working fluid inlet on the power turbine 228, and disposed downstream of the heat exchanger 130. The recuperator 216 may be configured to increase the amount of thermal energy in the working fluid prior to flowing into the heat exchanger 120 and/or the power turbine 228. Therefore, the recuperator 216 is operative to transfer thermal energy between the high pressure side and the low pressure side of the working fluid circuit 202. In some examples, the recuperator 216 may be a heat exchanger configured to cool the low pressurized working fluid discharged or downstream of the power turbine 228 while heating the high pressurized working fluid entering into or upstream of the heat exchanger 120 and/or the power turbine 228.

Similarly, in another embodiment, the recuperator 218 is fluidly coupled to the low pressure side of the working fluid circuit 202, disposed downstream of a working fluid outlet on the power turbine 228 and/or the recuperator 216, and disposed upstream of the condenser 274. The recuperator 218 may be configured to remove at least a portion of thermal energy from the working fluid discharged from the power turbine 228 and/or the recuperator 216. In addition, the recuperator 218 is also fluidly coupled to the high pressure side of the working fluid circuit 202, disposed upstream of the heat exchanger 150 and/or a working fluid inlet on the drive turbine 264 of turbopump 260, and disposed downstream of a working fluid outlet on the pump portion 262 of the turbopump 260. The recuperator 218 may be configured to increase the amount of thermal energy in the working fluid prior to flowing into the heat exchanger 150 and/or the drive turbine 264. Therefore, the recuperator 218 is operative to transfer thermal energy between the high pressure side and the low pressure side of the working fluid circuit 202. In some examples, the recuperator 218 may be a heat exchanger configured to cool the low pressurized working fluid discharged or downstream of the power turbine 228 and/or the recuperator 216 while heating the high pressurized working fluid entering into or upstream of the heat exchanger 150 and/or the drive turbine 264.

A cooler or a condenser 274 may be fluidly coupled to and in thermal communication with the low pressure side of the working fluid circuit 202 and may be configured or operative to control a temperature of the working fluid in the low pressure side of the working fluid circuit 202. The condenser 274 may be disposed downstream of the recuperators 216 and 218 and upstream of the start pump 280 and the turbopump 260. The condenser 274 receives the cooled working fluid from the recuperator 218 and further cools and/or condenses the working fluid which may be recirculated throughout the working fluid circuit 202. In many examples, the condenser 274 is a cooler and may be configured to control a temperature of the working fluid in the low pressure side of the working fluid circuit 202 by transferring thermal energy from the working fluid in the low pressure side to a cooling loop or system outside of the working fluid circuit 202.

A cooling media or fluid is generally utilized in the cooling loop or system by the condenser 274 for cooling the working fluid and removing thermal energy outside of the working fluid circuit 202. The cooling media or fluid flows through, over, or around while in thermal communication with the condenser 274. Thermal energy in the working fluid is transferred to the cooling fluid via the condenser 274. Therefore, the cooling fluid is in thermal communication with the working fluid circuit 202, but not fluidly coupled to the working fluid circuit 202. The condenser 274 may be fluidly coupled to the working fluid circuit 202 and independently fluidly coupled to the cooling fluid. The cooling fluid may contain one or multiple compounds and may be in one or multiple states of matter. The cooling fluid may be a media or fluid in a gaseous state, a liquid state, a subcritical state, a supercritical state, a suspension, a solution, derivatives thereof, or combinations thereof.

In many examples, the condenser 274 is generally fluidly coupled to a cooling loop or system (not shown) that receives the cooling fluid from a cooling fluid return **278*a* and returns the warmed cooling fluid to the cooling loop or system via a cooling fluid supply 278*b*. The cooling fluid may be water, carbon dioxide, or other aqueous and/or organic fluids (e.g., alcohols and/or glycols), air or other gases, or various mixtures thereof that is maintained at a lower temperature than the temperature of the working fluid. In other examples, the cooling media or fluid contains air or another gas exposed to the condenser 274, such as an air steam blown by a motorized fan or blower. A filter 276 may be disposed along and in fluid communication with the cooling fluid line at a point downstream of the cooling fluid supply 278*b* and upstream of the condenser 274. In some examples, the filter 276 may be fluidly coupled to the cooling fluid line within the process system 210**.

The heat engine system 200 further contains several pumps, such as the turbopump 260 and the start pump 280, disposed within the working fluid circuit 202 and fluidly coupled between the low pressure side and the high pressure side of the working fluid circuit 202. The turbopump 260 and the start pump 280 are operative to circulate the working fluid throughout the working fluid circuit 202. The start pump 280 is generally a motorized pump and may be utilized to initially pressurize and circulate the working fluid in the working fluid circuit 202. Once a predetermined pressure, temperature, and/or flowrate of the working fluid is obtained within the working fluid circuit 202, the start pump 280 may be taken off line, idled, or turned off and the turbopump 260 is utilize to circulate the working fluid during the electricity generation process. The working fluid may enter the pump portion 262 of the turbopump 260 and the pump portion 282 of the start pump 280 from the low pressure side of the working fluid circuit 202 and may be discharged from the pump portions 262, 282 into the high pressure side of the working fluid circuit 202.

The start pump 280 may be a motorized pump, such as an electric motorized pump, a mechanical motorized pump, or other type of pump. Generally, the start pump 280 may be a variable frequency motorized drive pump and contains a pump portion 282 and a motor-drive portion 284. The motor-drive portion 284 of the start pump 280 contains a motor and a drive including a driveshaft and gears. In some examples, the motor-drive portion 284 has a variable frequency drive, such that the speed of the motor may be regulated by the drive. The pump portion 282 of the start pump 280 is driven by the motor-drive portion 284 coupled thereto. The pump portion 282 has an inlet for receiving the working fluid from the low pressure side of the working fluid circuit 202, such as from the condenser 274 and/or the mass management system 270. The pump portion 282 has an outlet for releasing the working fluid into the high pressure side of the working fluid circuit 202.

A start pump inlet valve 283 and a start pump outlet valve 285 may be utilized to control the flow of the working fluid passing through the start pump 280. The start pump inlet valve 283 may be fluidly coupled to the low pressure side of the working fluid circuit 202 upstream of the pump portion 282 of the start pump 280 and may be utilized to control the flowrate of the working fluid entering the inlet of the pump portion 282. The start pump outlet valve 285 may be fluidly coupled to the high pressure side of the working fluid circuit 202 downstream of the pump portion 282 of the start pump 280 and may be utilized to control the flowrate of the working fluid exiting the outlet of the pump portion 282.

The drive turbine 264 of the turbopump 260 may be driven by heated working fluid, such as the working fluid flowing from the heat exchanger 150. The drive turbine 264 is fluidly coupled to the high pressure side of the working fluid circuit 202 by an inlet configured to receive the working fluid from the high pressure side of the working fluid circuit 202, such as flowing from the heat exchanger 150. The drive turbine 264 is fluidly coupled to the low pressure side of the working fluid circuit 202 by an outlet configured to release the working fluid into the low pressure side of the working fluid circuit 202.

The pump portion 262 of the turbopump 260 may be driven via the driveshaft 267 coupled to the drive turbine 264. The pump portion 262 of the turbopump 260 may be fluidly coupled to the low pressure side of the working fluid circuit 202 by an inlet configured to receive the working fluid from the low pressure side of the working fluid circuit 202. The inlet of the pump portion 262 may be configured to receive the working fluid from the low pressure side of the working fluid circuit 202, such as from the condenser 274 and/or the mass management system 270. Also, the pump portion 262 may be fluidly coupled to the high pressure side of the working fluid circuit 202 by an outlet configured to release the working fluid into the high pressure side of the working fluid circuit 202 and circulate the working fluid within the working fluid circuit 202.

The driveshaft 267 may be a single piece or contain two or more pieces coupled together. In one or more examples, a first segment of the driveshaft 267 extends from the drive turbine 264 to the gearbox, a second segment of the rotating shaft 230 extends from the gearbox to the pump portion 262, and multiple gears are disposed between and coupled to the two segments of the driveshaft 267 within the gearbox.

In one configuration, the working fluid released from the outlet on the drive turbine 264 is returned into the working fluid circuit 202 downstream of the recuperator 216 and upstream of the recuperator 218. In one or more embodiments, the turbopump 260, including piping and valves, is optionally disposed on a turbopump skid 266, as depicted in FIG. 9. The turbopump skid 266 may be disposed on or adjacent to the main process skid 212.

A drive turbine bypass valve 265 is generally coupled between and in fluid communication with a fluid line extending from the inlet on the drive turbine 264 with a fluid line extending from the outlet on the drive turbine 264. The drive turbine bypass valve 265 is generally opened to bypass the turbopump 260 while using the start pump 280 during the initial stages of generating electricity with the heat engine system 200. Once a predetermined pressure and temperature of the working fluid is obtained within the working fluid circuit 202, the drive turbine bypass valve 265 is closed and the heated working fluid is flowed through the drive turbine 264 to start the turbopump 260.

A drive turbine throttle valve 263 may be coupled between and in fluid communication with a fluid line extending from the heat exchanger 150 to the inlet on the drive turbine 264 of the turbopump 260. The drive turbine throttle valve 263 may be configured to modulate the flow of the heated working fluid into the drive turbine 264 which in turn—may be utilized to adjust the flow of the working fluid throughout the working fluid circuit 202. Additionally, a valve 293 may be utilized to control the flow of the working fluid passing through the high pressure side of the recuperator 218 and through the heat exchanger 150. The additional thermal energy absorbed by the working fluid from the recuperator 218 and the heat exchanger 150 is transferred to the drive turbine 264 for powering or otherwise driving the pump portion 262 of the turbopump 260. The valve 293 may be utilized to provide and/or control back pressure for the drive turbine 264 of the turbopump 260.

A drive turbine attemperator valve 295 may be fluidly coupled to the working fluid circuit 202 via an attemperator bypass line 291 disposed between the outlet on the pump portion 262 of the turbopump 260 and the inlet on the drive turbine 264 and/or disposed between the outlet on the pump portion 282 of the start pump 280 and the inlet on the drive turbine 264. The attemperator bypass line 291 and the drive turbine attemperator valve 295 may be configured to flow the working fluid from the pump portion 262 or 282, around and avoid the recuperator 218 and the heat exchanger 150, and to the drive turbine 264, such as during a warm-up or cool-down step of the turbopump 260. The attemperator bypass line 291 and the drive turbine attemperator valve 295 may be utilized to warm the working fluid with the drive turbine 264 while avoiding the thermal heat from the heat source stream 110 via the heat exchangers, such as the heat exchanger 150.

The check valve 261 may be disposed downstream of the outlet of the pump portion 262 of the turbopump 260 and the check valve 281 may be disposed downstream of the outlet of the pump portion 282 of the start pump 280. The check valves 261 and 281 are flow control safety valves and may be utilized to release an over-pressure, regulate the directional flow, or prohibit backflow of the working fluid within the working fluid circuit 202. The check valve 261 may be configured to prevent the working fluid from flowing upstream towards or into the outlet of the pump portion 262 of the turbopump 260. Similarly, check valve 281 may be configured to prevent the working fluid from flowing upstream towards or into the outlet of the pump portion 282 of the start pump 280.

The drive turbine throttle valve 263 is fluidly coupled to the working fluid circuit 202 upstream of the inlet of the drive turbine 264 of the turbopump 260 and configured to control a flow of the working fluid flowing into the drive turbine 264. The power turbine bypass valve 219 is fluidly coupled to the power turbine bypass line 208 and configured to modulate, adjust, or otherwise control the working fluid flowing through the power turbine bypass line 208 for controlling the flowrate of the working fluid entering the power turbine 228.

The power turbine bypass line 208 is fluidly coupled to the working fluid circuit 202 at a point upstream of an inlet of the power turbine 228 and at a point downstream of an outlet of the power turbine 228. The power turbine bypass line 208 may be configured to flow the working fluid around and avoid the power turbine 228 when the power turbine bypass valve 219 is in an open-position. The flowrate and the pressure of the working fluid flowing into the power turbine 228 may be reduced or stopped by adjusting the power turbine bypass valve 219 to the open-position. Alternatively, the flowrate and the pressure of the working fluid flowing into the power turbine 228 may be increased or started by adjusting the power turbine bypass valve 219 to the closed-position due to the backpressure formed through the power turbine bypass line 208.

The power turbine bypass valve 219 and the drive turbine throttle valve 263 may be independently controlled by the process control system 204 that is communicably connected, wired and/or wirelessly, with the power turbine bypass valve 219, the drive turbine throttle valve 263, and other parts of the heat engine system 200. The process control system 204 is operatively connected to the working fluid circuit 202 and a mass management system 270 and is enabled to monitor and control multiple process operation parameters of the heat engine system 200.

In one or more embodiments, the working fluid circuit 202 provides a bypass flowpath for the start pump 280 via the start pump bypass line 224 and a start pump bypass valve 254, as well as a bypass flowpath for the turbopump 260 via the turbopump bypass line 226 and a turbopump bypass valve 256. One end of the start pump bypass line 224 is fluidly coupled to an outlet of the pump portion 282 of the start pump 280 and the other end of the start pump bypass line 224 is fluidly coupled to a fluid line 229. Similarly, one end of a turbopump bypass line 226 is fluidly coupled to an outlet of the pump portion 262 of the turbopump 260 and the other end of the turbopump bypass line 226 is coupled to the start pump bypass line 224. In some configurations, the start pump bypass line 224 and the turbopump bypass line 226 merge together as a single line upstream of coupling to a fluid line 229. The fluid line 229 extends between and is fluidly coupled to the recuperator 218 and the condenser 274. The start pump bypass valve 254 may be disposed along the start pump bypass line 224 and fluidly coupled between the low pressure side and the high pressure side of the working fluid circuit 202 when in a closed-position. Similarly, the turbopump bypass valve 256 may be disposed along the turbopump bypass line 226 and fluidly coupled between the low pressure side and the high pressure side of the working fluid circuit 202 when in a closed-position.

FIG. 9 further depicts a power turbine throttle valve 250 fluidly coupled to a bypass line 246 on the high pressure side of the working fluid circuit 202 and upstream of the heat exchanger 120, as disclosed by at least one embodiment described herein. The power turbine throttle valve 250 is fluidly coupled to the bypass line 246 and configured to modulate, adjust, or otherwise control the working fluid flowing through the bypass line 246 for controlling a general coarse flowrate of the working fluid within the working fluid circuit 202. The bypass line 246 is fluidly coupled to the working fluid circuit 202 at a point upstream of the valve 293 and at a point downstream of the pump portion 282 of the start pump 280 and/or the pump portion 262 of the turbopump 260. Additionally, a power turbine trim valve 252 is fluidly coupled to a bypass line 248 on the high pressure side of the working fluid circuit 202 and upstream of the heat exchanger 150, as disclosed by another embodiment described herein. The power turbine trim valve 252 is fluidly coupled to the bypass line 248 and configured to modulate, adjust, or otherwise control the working fluid flowing through the bypass line 248 for controlling a fine flowrate of the working fluid within the working fluid circuit 202. The bypass line 248 is fluidly coupled to the bypass line 246 at a point upstream of the power turbine throttle valve 250 and at a point downstream of the power turbine throttle valve 250.

The heat engine system 200 further contains a drive turbine throttle valve 263 fluidly coupled to the working fluid circuit 202 upstream of the inlet of the drive turbine 264 of the turbopump 260 and configured to modulate a flow of the working fluid flowing into the drive turbine 264, a power turbine bypass line 208 fluidly coupled to the working fluid circuit 202 upstream of an inlet of the power turbine 228, fluidly coupled to the working fluid circuit 202 downstream of an outlet of the power turbine 228, and configured to flow the working fluid around and avoid the power turbine 228, a power turbine bypass valve 219 fluidly coupled to the power turbine bypass line 208 and configured to modulate a flow of the working fluid flowing through the power turbine bypass line 208 for controlling the flowrate of the working fluid entering the power turbine 228, and a process control system 204 operatively connected to the heat engine system 90 or 200, wherein the process control system 204 may be configured to adjust the drive turbine throttle valve 263 and the power turbine bypass valve 219.

A heat exchanger bypass line 160 is fluidly coupled to a fluid line 131 of the working fluid circuit 202 upstream of the heat exchangers 120, 130, and/or 150 by a heat exchanger bypass valve 162, as illustrated in FIG. 9. The heat exchanger bypass valve 162 may be a solenoid valve, a hydraulic valve, an electric valve, a manual valve, or derivatives thereof. In many examples, the heat exchanger bypass valve 162 is a solenoid valve and configured to be controlled by the process control system 204.

In one or more embodiments, the working fluid circuit 202 provides release valves 213*a*, 213*b*, 213*c*, and 213*d*, as well as release outlets 214*a*, 214*b*, 214*c*, and 214*d*, respectively in fluid communication with each other. Generally, the release valves 213*a*, 213*b*, 213*c*, and 213*d* remain closed during the electricity generation process, but may be configured to automatically open to release an over-pressure at a predetermined value within the working fluid. Once the working fluid flows through the valve 213*a*, 213*b*, 213*c*, or 213*d*, the working fluid is vented through the respective release outlet 214*a*, 214*b*, 214*c*, or 214*d*. The release outlets 214*a*, 214*b*, 214*c*, and 214*d* may provide passage of the working fluid into the ambient surrounding atmosphere. Alternatively, the release outlets 214*a*, 214*b*, 214*c*, and 214*d* may provide passage of the working fluid into a recycling or reclamation step that generally includes capturing, condensing, and storing the working fluid.

The release valve 213*a* and the release outlet 214*a* are fluidly coupled to the working fluid circuit 202 at a point disposed between the heat exchanger 120 and the power turbine 228. The release valve 213*b* and the release outlet 214*b* are fluidly coupled to the working fluid circuit 202 at a point disposed between the heat exchanger 150 and the turbo portion 264 of the turbopump 260. The release valve 213*c* and the release outlet 214*c* are fluidly coupled to the working fluid circuit 202 via a bypass line that extends from a point between the valve 293 and the pump portion 262 of the turbopump 260 to a point on the turbopump bypass line 226 between the turbopump bypass valve 256 and the fluid line 229. The release valve 213*d* and the release outlet 214*d* are fluidly coupled to the working fluid circuit 202 at a point disposed between the recuperator 218 and the condenser 274.

A computer system 206, as part of the process control system 204, contains a multi-controller algorithm utilized to control the drive turbine throttle valve 263, the power turbine bypass valve 219, the heat exchanger bypass valve 162, the power turbine throttle valve 250, the power turbine trim valve 252, as well as other valves, pumps, and sensors within the heat engine system 200. In one embodiment, the process control system 204 is enabled to move, adjust, manipulate, or otherwise control the heat exchanger bypass valve 162, the power turbine throttle valve 250, and/or the power turbine trim valve 252 for adjusting or controlling the flow of the working fluid throughout the working fluid circuit 202. By controlling the flow of the working fluid, the process control system 204 is also operable to regulate the temperatures and pressures throughout the working fluid circuit 202.

FIGS. 1 and 9 depicts the heat engine systems 90, 200 containing the mass management system (MMS) 270 fluidly coupled to the working fluid circuit 202, as described by another exemplary embodiment. The mass management system 270, also referred to as an inventory management system, may be utilized to control the amount of working fluid added to, contained within, or removed from the working fluid circuit 202. The mass management system 270 may have two or more transfer lines that may be configured to have one-directional flow, such an inventory return line 172 and an inventory supply line 182. Therefore, the mass management system 270 may contain the mass control tank 286 and the transfer pump 170 connected in series by an inventory line 176 and may further contain the inventory return line 172 and the inventory supply line 182. The inventory return line 172 may be fluidly coupled between the working fluid circuit 202 and the mass control tank 286. An inventory return valve 174 may be fluidly coupled to the inventory return line 172 and configured to remove the working fluid from the working fluid circuit 202. Also, the inventory supply line 182 may be fluidly coupled between the transfer pump 170 and the working fluid circuit 202. An inventory supply valve 184 may be fluidly coupled to the inventory supply line 182 and configured to add the working fluid into the working fluid circuit 202 or transfer to a bearing gas supply line 196.

In another embodiment, the heat engine system 90 may further contain the bearing gas supply line 196 fluidly coupled to and between the inventory supply line 182 and a bearing-containing device 194, as depicted in FIG. 1. The bearing-containing device 194, for example, may be the bearing housing 268 of the turbopump 260, the bearing housing 238 of the power generation system 220, or other components containing bearings utilized within or along with the heat engine system 90. Therefore, the bearing housing 238 and/or the bearing housing 268 may independently receive a portion of the working fluid as the bearing fluid. The bearing gas supply line 196 generally contains at least one valve, such as bearing gas supply valve 198, configured to control the flow of the working fluid from the inventory supply line 182, through the bearing gas supply line 196, and to bearing-containing device 194. In another aspect, the bearing gas supply line 196 may be utilized during a startup process to transfer or otherwise deliver the working fluid—as a cooling agent and lubricant—to bearings contained within a bearing housing of a system component (e.g., rotary equipment or turbo machinery).

In other embodiments, the transfer pump 170 may also be configured to transfer the working fluid from the mass control tank 286 to the bearing housings 238, 268 that completely, substantially, or partially encompass or otherwise enclose bearings contained within a system component. FIG. 9 depicts the heat engine system 200 further containing bearing gas supply lines 196, 196*a*, 196*b* fluidly coupled to and between the transfer pump 170 and the bearing housing 238, 268. The bearing gas supply lines 196, 196*a*, 196*b* generally contain at least one valve, such as bearing gas supply valves 198*a*, 198*b*, configured to control the flow of the working fluid from the mass control tank 286, through the transfer pump 170, and to the bearing housing 238, 268. In various examples, the system component may be a turbopump, a turbocompressor, a turboalternator, a power generation system, other turbomachinery, and/or other bearing-containing devices 194 (as depicted in FIG. 1). In some examples, the system component may be the system pump and or drive turbine, such as the turbopump 260 containing the bearing housing 268. In other examples, the system component may be the power generation system 220 that contains the expander or the power turbine 228, the power generator 240, and the bearing housing 238.

The mass control tank 286 and the working fluid circuit 202 share the working fluid (e.g., carbon dioxide)—such that the mass control tank 286 may receive, store, and disperse the working fluid during various operational steps of the heat engine system 90. In one embodiment, the transfer pump 170 may be utilized to conduct inventory control by removing working fluid from the working fluid circuit 202, storing working fluid, and/or adding working fluid into the working fluid circuit 202. In another embodiment, the transfer pump 170 may be utilized during a startup process to transfer or otherwise deliver the working fluid—as a cooling agent—from the mass control tank 286 to bearings contained within the bearing housing 268 of the turbopump 260, the bearing housing 238 of the power generation system 220, and/or other system components containing bearings (e.g., rotary equipment or turbo machinery).

Exemplary structures of the bearing housing 238 or 268 may completely or substantially encompass or enclose the bearings as well as all or part of turbines, generators, pumps, driveshafts, gearboxes, or other components shown or not shown for heat engine system 90. The bearing housing 238 or 268 may completely or partially include structures, chambers, cases, housings, such as turbine housings, generator housings, driveshaft housings, driveshafts that contain bearings, gearbox housings, derivatives thereof, or combinations thereof. FIG. 9 depicts the bearing housing 238 containing all or a portion of the power turbine 228, the power generator 240, the rotating shaft 230, and the gearbox 232 of the power generation system 220. In some examples, the housing of the power turbine 228 is coupled to and/or forms a portion of the bearing housing 238. Similarly, the bearing housing 268 contains all or a portion of the drive turbine 264, the pump portion 262, and the driveshaft 267 of the turbopump 260. In other examples, the housing of the drive turbine 264 and the housing of the pump portion 262 may be independently coupled to and/or form portions of the bearing housing 268.

In one or more embodiments disclosed herein, at least one bearing gas supply line 196 may be fluidly coupled to and disposed between the transfer pump 170 and at least one bearing housing (e.g., bearing housing 238 or 268) substantially encompassing, enclosing, or otherwise surrounding the bearings of one or more system components. The bearing gas supply line 196 may have or otherwise split into multiple spurs or segments of fluid lines, such as bearing gas supply lines 196*a* and 196*b*, which each independently extends to a specified bearing housing 238 or 268, respectively, as illustrated in FIG. 9. In one example, the bearing gas supply line 196*a* may be fluidly coupled to and disposed between the transfer pump 170 and the bearing housing 268 within the turbopump 260. In another example, the bearing gas supply line 196*b* may be fluidly coupled to and disposed between the transfer pump 170 and the bearing housing 238 within the power generation system 220.

FIG. 9 further depicts a bearing gas supply valve 198*a* fluidly coupled to and disposed along the bearing gas supply line 196*a*. The bearing gas supply valve 198*a* may be utilized to control the flow of the working fluid from the transfer pump 170 to the bearing housing 268 within the turbopump 260. Similarly, a bearing gas supply valve 198*b* may be fluidly coupled to and disposed along the bearing gas supply line 196*b*. The bearing gas supply valve 198*b* may be utilized to control the flow of the working fluid from the transfer pump 170 to the bearing housing 238 within the power generation system 220.

In some embodiments, the overall efficiency of the heat engine system 200 and the amount of power ultimately generated can be influenced by the inlet or suction pressure at the pump when the working fluid contains supercritical carbon dioxide. In order to minimize or otherwise regulate the suction pressure of the pump, the heat engine system 200 may incorporate the use of a mass management system ("MMS") 270. The mass management system 270 controls the inlet pressure of the start pump 280 by regulating the amount of working fluid entering and/or exiting the heat engine system 200 at strategic locations in the working fluid circuit 202, such as at tie-in points, inlets/outlets, valves, or conduits throughout the heat engine system 200. Consequently, the heat engine system 200 becomes more efficient by increasing the pressure ratio for the start pump 280 to a maximum possible extent.

The mass management system 270 contains at least one vessel or tank, such as a storage vessel, a fill vessel, and/or a mass control tank (e.g., mass control tank 286), fluidly coupled to the low pressure side of the working fluid circuit 202 via one or more valves, such as inventory supply valve 184. The valves are moveable—as being partially opened, fully opened, and/or closed—to either remove working fluid from the working fluid circuit 202 or add working fluid to the working fluid circuit 202. Exemplary embodiments of the mass management system 270, and a range of variations thereof, are found in U.S. Pat. No. 8,613,195, the contents of which are incorporated herein by reference to the extent consistent with the present disclosure. Briefly, however, the mass management system 270 may include a plurality of valves and/or connection points, each in fluid communication with the mass control tank 286. The valves may be characterized as termination points where the mass management system 270 is operatively connected to the heat engine system 200. The connection points and valves may be configured to provide the mass management system 270 with an outlet for flaring excess working fluid or pressure, or to provide the mass management system 270 with additional/supplemental working fluid from an external source, such as a fluid fill system.

In some embodiments, the mass control tank 286 may be configured as a localized storage tank for additional/supplemental working fluid that may be added to the heat engine system 200 when needed in order to regulate the pressure or temperature of the working fluid within the working fluid circuit 202 or otherwise supplement escaped working fluid. By controlling the valves, the mass management system 270 adds and/or removes working fluid mass to/from the heat engine system 200 with or without the need of a pump, thereby reducing system cost, complexity, and maintenance.

In some examples, the mass control tank 286 is part of the mass management system 270 and is fluidly coupled to the working fluid circuit 202. At least one connection point, such as a working fluid feed 288, may be a fluid fill port for the mass control tank 286 of the mass management system 270. Additional or supplemental working fluid may be added to the mass management system 270 from an external source, such as a fluid fill system via the working fluid feed 288. Exemplary fluid fill systems are described and illustrated in U.S. Pat. No. 8,281,593, the contents of which are incorporated herein by reference to the extent consistent with the present disclosure.

In another embodiment described herein, bearing gas and seal gas may be supplied to the turbopump 260 or other devices contained within and/or utilized along with the heat engine system 200. One or multiple streams of bearing gas and/or seal gas may be derived from the working fluid within the working fluid circuit 202 and contain carbon dioxide in a gaseous, subcritical, or supercritical state. In some exemplary embodiments, the bearing gas or fluid is flowed by the start pump 280, from a bearing gas supply and/or a bearing gas supply, into the working fluid circuit 202, through a bearing gas supply line (not shown), and to the bearings within the power generation system 220. In other exemplary embodiments, the bearing gas or fluid is flowed by the start pump 280, from the working fluid circuit 202, through a bearing gas supply line (not shown), and to the bearings within the turbopump 260. In some examples, the bearing fluid supply 292 may be a connection point or valve that feeds into a seal gas system. The bearing fluid supply 292 may contain an independent source or tank of the bearing fluid or the bearing fluid supply 292 may be a source of the working fluid (e.g., sc-$OO_2$), such as from the working fluid circuit 202, the mass management system 270, the transfer pump 170, or other sources.

The bearing fluid return 294 is generally coupled to the bearing fluid drain line 298 and configured to receive the bearing fluid downstream of the bearing housing 268, as depicted in FIGS. 1, 2, and 5. The bearing fluid may be a discharge, recapture, or return of bearing fluid/gas, seal gas, and/or other fluids/gases. In some embodiments, the bearing fluid return 294 may be a tank or vessel, such as a leak recapture storage vessel or may be a dry gas seal (DGS) or seal gas conditioning system or other fluid/gas conditioning system or process system that may be equipped with filters, compressors/pumps, tanks/vessels, valves, and piping. In other embodiments, if the bearing fluid is derived from the working fluid, the bearing fluid return 294 may provide a feed stream of captured gas (e.g., bearing fluid, sc-$OO_2$) back into the working fluid circuit 202 of recycled, recaptured, or otherwise returned gases (not shown). The gas return may be fluidly coupled to the working fluid circuit 202 upstream of the condenser 274 and downstream of the recuperator 218 (not shown).

In several exemplary embodiments, the process control system 204 may be communicably connected, wired and/or wirelessly, with numerous sets of sensors, valves, and pumps, in order to process the measured and reported temperatures, pressures, and mass flowrates of the working fluid at the designated points within the working fluid circuit 202. In response to these measured and/or reported parameters, the process control system 204 may be operable to selectively adjust the valves in accordance with a control program or algorithm, thereby maximizing operation of the heat engine system 200.

The process control system 204 may operate with the heat engine system 200 semi-passively with the aid of several sets of sensors. The first set of sensors is arranged at or adjacent the suction inlet of the turbopump 260 and the start pump 280 and the second set of sensors is arranged at or adjacent the outlet of the turbopump 260 and the start pump 280. The first and second sets of sensors monitor and report the pressure, temperature, mass flowrate, or other properties of the working fluid within the low and high pressure sides of the working fluid circuit 202 adjacent the turbopump 260 and the start pump 280. The third set of sensors is arranged either inside or adjacent the mass control tank 286 of the mass management system 270 to measure and report the pressure, temperature, mass flowrate, or other properties of the working fluid within the mass control tank 286. Additionally, an instrument air supply (not shown) may be coupled to sensors, devices, or other instruments within the heat engine system 200 and/or the mass management system 270 that may utilized a gaseous source, such as nitrogen or air.

In some embodiments described herein, the waste heat system 100 may be disposed on or in a waste heat skid 102 fluidly coupled to the working fluid circuit 202, as well as other portions, sub-systems, or devices of the heat engine system 200. The waste heat skid 102 may be fluidly coupled to a source of and an exhaust for the heat source stream 110, a main process skid 212, a power generation skid 222, and/or other portions, sub-systems, or devices of the heat engine system 200.

In one or more configurations, the waste heat system 100 disposed on or in the waste heat skid 102 generally contains inlets 122, 132, and 152 and outlets 124, 134, and 154 fluidly coupled to and in thermal communication with the working fluid within the working fluid circuit 202. The inlet 122 may be disposed upstream of the heat exchanger 120 and the outlet 124 may be disposed downstream of the heat exchanger 120. The working fluid circuit 202 may be configured to flow the working fluid from the inlet 122, through the heat exchanger 120, and to the outlet 124 while transferring thermal energy from the heat source stream 110 to the working fluid by the heat exchanger 120. The inlet 152 may be disposed upstream of the heat exchanger 150 and the outlet 154 may be disposed downstream of the heat exchanger 150. The working fluid circuit 202 may be configured to flow the working fluid from the inlet 152, through the heat exchanger 150, and to the outlet 154 while transferring thermal energy from the heat source stream 110 to the working fluid by the heat exchanger 150. The inlet 132 may be disposed upstream of the heat exchanger 130 and the outlet 134 may be disposed downstream of the heat exchanger 130. The working fluid circuit 202 may be configured to flow the working fluid from the inlet 132, through the heat exchanger 130, and to the outlet 134 while transferring thermal energy from the heat source stream 110 to the working fluid by the heat exchanger 130.

In one or more configurations, the power generation system 220 may be disposed on or in the power generation skid 222 generally contains inlets 225*a*, 225*b* and an outlet 227 fluidly coupled to and in thermal communication with the working fluid within the working fluid circuit 202. The inlets 225*a*, 225*b* are upstream of the power turbine 228 within the high pressure side of the working fluid circuit 202 and are configured to receive the heated and high pressure working fluid. In some examples, the inlet 225*a* may be fluidly coupled to the outlet 124 of the waste heat system 100 and configured to receive the working fluid flowing from the heat exchanger 120 and the inlet 225*b* may be fluidly coupled to the outlet 241 of the process system 210 and configured to receive the working fluid flowing from the turbopump 260 and/or the start pump 280. The outlet 227 may be disposed downstream of the power turbine 228 within the low pressure side of the working fluid circuit 202 and may be configured to provide the low pressure working fluid. In some examples, the outlet 227 may be fluidly coupled to the inlet 239 of the process system 210 and configured to flow the working fluid to the recuperator 216.

A filter 215*a* may be disposed along and in fluid communication with the fluid line at a point downstream of the heat exchanger 120 and upstream of the power turbine 228. In some examples, the filter 215*a* is fluidly coupled to the working fluid circuit 202 between the outlet 124 of the waste heat system 100 and the inlet 225*a* of the process system 210.

The portion of the working fluid circuit 202 within the power generation system 220 is fed the working fluid by the inlets 225*a* and 225*b*. A power turbine stop valve 217 is fluidly coupled to the working fluid circuit 202 between the inlet 225*a* and the power turbine 228. The power turbine stop valve 217 may be configured to control the working fluid flowing from the heat exchanger 120, through the inlet 225*a*, and into the power turbine 228 while in an open-position. Alternatively, the power turbine stop valve 217 may be configured to cease the flow of working fluid from entering into the power turbine 228 while in a closed-position.

A power turbine attemperator valve 223 is fluidly coupled to the working fluid circuit 202 via an attemperator bypass line 211 disposed between the outlet on the pump portion 262 of the turbopump 260 and the inlet on the power turbine 228 and/or disposed between the outlet on the pump portion 282 of the start pump 280 and the inlet on the power turbine 228. The attemperator bypass line 211 and the power turbine attemperator valve 223 may be configured to flow the working fluid from the pump portion 262 or 282, around and avoid the recuperator 216 and the heat exchangers 120 and 130, and to the power turbine 228, such as during a warm-up or cool-down step. The attemperator bypass line 211 and the power turbine attemperator valve 223 may be utilized to warm the working fluid with heat coming from the power turbine 228 while avoiding the thermal heat from the heat source stream 110 flowing through the heat exchangers, such as the heat exchangers 120 and 130. In some examples, the power turbine attemperator valve 223 may be fluidly coupled to the working fluid circuit 202 between the inlet 225*b* and the power turbine stop valve 217 upstream of a point on the fluid line that intersects the incoming stream from the inlet 225*a*. The power turbine attemperator valve 223 may be configured to control the working fluid flowing from the start pump 280 and/or the turbopump 260, through the inlet 225*b*, and to a power turbine stop valve 217, the power turbine bypass valve 219, and/or the power turbine 228.

The power turbine bypass valve 219 is fluidly coupled to a turbine bypass line that extends from a point of the working fluid circuit 202 upstream of the power turbine stop valve 217 and downstream of the power turbine 228. Therefore, the bypass line and the power turbine bypass valve 219 are configured to direct the working fluid around and avoid the power turbine 228. If the power turbine stop valve 217 is in a closed-position, the power turbine bypass valve 219 may be configured to flow the working fluid around and avoid the power turbine 228 while in an open-position. In one embodiment, the power turbine bypass valve 219 may be utilized while warming up the working fluid during a start-up operation of the electricity generating process. An outlet valve 221 is fluidly coupled to the working fluid circuit 202 between the outlet on the power turbine 228 and the outlet 227 of the power generation system 220.

In one or more configurations, the process system 210 may be disposed on or in the main process skid 212 generally contains inlets 235, 239, and 255 and outlets 231, 237, 241, 251, and 253 fluidly coupled to and in thermal communication with the working fluid within the working fluid circuit 202. The inlet 235 is upstream of the recuperator 216 and the outlet 154 is downstream of the recuperator 216. The working fluid circuit 202 may be configured to flow the working fluid from the inlet 235, through the recuperator 216, and to the outlet 237 while transferring thermal energy from the working fluid in the low pressure side of the working fluid circuit 202 to the working fluid in the high pressure side of the working fluid circuit 202 by the recuperator 216. The outlet 241 of the process system 210 is downstream of the turbopump 260 and/or the start pump 280, upstream of the power turbine 228, and configured to provide a flow of the high pressure working fluid to the power generation system 220, such as to the power turbine 228. The inlet 239 is upstream of the recuperator 216, downstream of the power turbine 228, and configured to receive the low pressure working fluid flowing from the power generation system 220, such as to the power turbine 228. The outlet 251 of the process system 210 is downstream of the recuperator 218, upstream of the heat exchanger 150, and configured to provide a flow of working fluid to the heat exchanger 150. The inlet 255 is downstream of the heat exchanger 150, upstream of the drive turbine 264 of the turbopump 260, and configured to provide the heated high pressure working fluid flowing from the heat exchanger 150 to the drive turbine 264 of the turbopump 260. The outlet 253 of the process system 210 is downstream of the pump portion 262 of the turbopump 260 and/or the pump portion 282 of the start pump 280, couples a bypass line disposed downstream of the heat exchanger 150 and upstream of the drive turbine 264 of the turbopump 260, and configured to provide a flow of working fluid to the drive turbine 264 of the turbopump 260.

Additionally, a filter 215*c* may be disposed along and in fluid communication with the fluid line at a point downstream of the heat exchanger 150 and upstream of the drive turbine 264 of the turbopump 260. In some examples, the filter 215*c* is fluidly coupled to the working fluid circuit 202 between the outlet 154 of the waste heat system 100 and the inlet 255 of the process system 210.

In another embodiment described herein, as illustrated in FIG. 9, the heat engine system 200 contains the process system 210 disposed on or in a main process skid 212, the power generation system 220 disposed on or in a power generation skid 222, the waste heat system 100 disposed on or in a waste heat skid 102. The working fluid circuit 202 extends throughout the inside, the outside, and between the main process skid 212, the power generation skid 222, the waste heat skid 102, as well as other systems and portions of the heat engine system 200. In some embodiments, the heat engine system 200 contains the heat exchanger bypass line 160 and the heat exchanger bypass valve 162 disposed between the waste heat skid 102 and the main process skid 212. A filter 215*b* may be disposed along and in fluid communication with the fluid line 135 at a point downstream of the heat exchanger 130 and upstream of the recuperator 216. In some examples, the filter 215*b* is fluidly coupled to the working fluid circuit 202 between the outlet 134 of the waste heat system 100 and the inlet 235 of the process system 210.

In exemplary embodiments described herein, the turbopump back-pressure regulator valve 290 may provide or maintain proper pressure to control the thrust of the pocket pressure ratios referred to as the turbine-side pocket pressure ratio (P1) and the pump-side pocket pressure ratio (P2). In some exemplary embodiments, methods described herein include utilizing advanced control theory of sliding mode, the multi-variables of the turbine-side pocket pressure ratio (P1) and the pump-side pocket pressure ratio (P2) and regulating the bearing fluid (e.g., $CO_2$) in the supercritical state or phase are coordinated to be maintained within limits that prevent damage to the thrust bearing 310 of the turbopump 260.

In exemplary embodiments described herein, the turbopump back-pressure regulator valve 290 may be closed or at a zero valve position when both the start pump 280 and the turbopump 260 have not yet been turned on during the startup of the heat engine systems 90, 200. The turbopump back-pressure regulator valve 290 may be closed in order to prevent a flow of the bearing fluid from back feeding through the bearing fluid supply 292 and bypass any filters (e.g., $CO_2$ filter) for the turbopump 260. At the time when the start pump 280 is turned on, the turbopump back-pressure regulator valve 290 may be adjusted to a partially opened-position that is within a range from about 60% to about 65% of being in a fully opened-position. When operations (or running of) the turbopump 260 is detected, such as by head rise, P2 pressure, and turbopump speed, the turbopump back-pressure regulator valve 290 may be placed into automatic control using the control algorithm via the process control system 204 and the computer system 206.

In exemplary embodiments, the control algorithm contains at least a primary governing loop controller, a secondary governing loop controller, and a tertiary governing loop controller. The control algorithm may be configured to calculate valve positions for the turbopump back-pressure regulator valve 290 for providing a pump-side pocket pressure ratio (P2) of a desirable value or range with the primary governing loop controller, a turbine-side pocket pressure ratio (P1) of a desirable value or range with the secondary governing loop controller, and a bearing fluid supply pressure at or greater than a critical pressure value for the bearing fluid. In one exemplary embodiment, the primary governing loop controller controls the pump-side pocket pressure ratio (P2) to a value of about 0.15. In the event that the turbine-side pocket pressure ratio (P1) approaches its alarm value of about 0.30, the secondary governing loop controller assumes control of the turbopump back-pressure regulator valve 290 to balance the thrust on the turbopump 260. If at any time during operation of the heat engine systems 90, 200, the bearing fluid supply pressure for the turbopump 260 begins to fall below supercritical pressure, the tertiary governing loop controller assumes control of the turbopump back-pressure regulator valve 290 to bring the pressure back into the supercritical pressure region. In some examples, during the controller(s) automatic operation, and while the turbopump 260 is in operation, hard limits may be induced on the valve position to force the turbopump back-pressure regulator valve 290 from going to a fully-opened position or a fully-closed position.

The methods provide the extensive use of sliding mode control to coordinate the competing variables and maintain such variables within limits to protect the bearing pressures within the turbopump 260. In one example, the method includes controlling pocket pressure ratios to maintain a "balanced thrust" of the turbopump 260. In another example, the method includes controlling a controller to ensure that the bearing fluid supply pressure for the turbopump 260 is maintained in the supercritical region for the specific bearing fluid, such as carbon dioxide.

It is to be understood that the present disclosure describes several exemplary embodiments for implementing different features, structures, or functions of the invention. Exemplary embodiments of components, arrangements, and configurations are described herein to simplify the present disclosure, however, these exemplary embodiments are provided merely as examples and are not intended to limit the scope of the disclosure. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the present disclosure may include embodiments in which the first and second features are formed in direct contact, and may also include embodiments in which additional features may be formed interposing the first and second features, such that the first and second features may not be in direct contact. Finally, the exemplary embodiments described herein may be combined in any combination of ways, i.e., any element from one exemplary embodiment may be used in any other exemplary embodiment without departing from the scope of the disclosure.

Additionally, certain terms are used throughout the written description and claims to refer to particular components. As one skilled in the art will appreciate, various entities may refer to the same component by different names, and as such, the naming convention for the elements described herein is not intended to limit the scope of the disclosure, unless otherwise specifically defined herein. Further, the naming convention used herein is not intended to distinguish between components that differ in name but not function. Further, in the written description and in the claims, the terms "including," "containing," and "comprising" are used in an open-ended fashion, and thus should be interpreted to mean "including, but not limited to". All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The invention claimed is:

1. A heat engine system, comprising:

a working fluid circuit to contain a working fluid, the working fluid circuit having a high pressure side and a low pressure side, wherein a portion of the working fluid is in a supercritical state when the heat engine system is in operation;

a heat exchanger fluidly coupled to and in thermal communication with the high pressure side of the working fluid circuit and fluidly coupled to and in thermal communication with a heat source stream, the heat exchanger to transfer thermal energy from the heat source stream to the working fluid within the high pressure side;

an expander fluidly coupled to the working fluid circuit and disposed between the high pressure side and the low pressure side to convert a pressure drop in the working fluid to mechanical energy;

a rotating shaft coupled to the expander to drive a device with the mechanical energy;

a recuperator fluidly coupled to the working fluid circuit to transfer thermal energy from the working fluid in the low pressure side to the working fluid in the high pressure side;

a start pump fluidly coupled to the working fluid circuit and disposed between the low pressure side and the high pressure side to circulate or pressurize the working fluid within the working fluid circuit;

a turbopump fluidly coupled to the working fluid circuit to circulate or pressurize the working fluid within the working fluid circuit, the turbopump including a housing;

a bearing fluid supply line fluidly coupled to the housing to provide a bearing fluid into the housing;

a bearing fluid drain line fluidly coupled to the housing to remove the bearing fluid from the housing;

a bearing fluid supply manifold disposed on or in the housing to receive incoming bearing fluid or gas and distribute to one or more multiple bearing supply pressure lines;

a bearing fluid drain manifold disposed on or in the housing to flow bearing drain fluid through a bearing fluid drain outlet and to the bearing fluid drain line;

a turbopump back-pressure regulator valve fluidly coupled to the bearing fluid drain line to control flow through the bearing fluid drain line; and a process control system operatively connected to the working fluid circuit to adjust the turbopump back-pressure regulator valve with a control algorithm embedded in a computer system, the process control system including embedded therein:

a primary governing loop controller to control a turbopump back-pressure regulator valve and to modulate the turbopump back-pressure regulator valve while adjusting a pump-side pocket pressure ratio (P2), wherein the turbopump back-pressure regulator valve is fluidly coupled to the bearing fluid drain line disposed downstream of a thrust bearing of the turbopump;

a secondary governing loop controller to control the turbopump back-pressure regulator valve and to modulate the turbopump back-pressure regulator valve while adjusting a turbine-side pocket pressure ratio (P1); and a tertiary governing loop controller to control the turbopump back-pressure regulator valve and to modulate the turbopump back-pressure regulator valve while adjusting a bearing fluid supply pressure to be at or greater than a critical pressure value for the bearing fluid to maintain the bearing fluid in a supercritical state wherein:

P1 equals the pocket pressure on a turbine-side thrust face in a turbine-side bearing pocket minus a drain pressure of the bearing fluid divided by a supply pressure of the bearing fluid minus the drain pressure of the bearing fluid; and P2 equals the pocket pressure on a pump-side thrust face in a pump side bearing pocket minus the drain pressure of the bearing fluid divided by the supply pressure of the bearing fluid minus the drain pressure of the bearing fluid.

2. The heat engine system of claim 1, wherein the turbopump comprises:

a drive turbine disposed between the high and low pressure sides;

a pump portion disposed between the high and low pressure sides;

a driveshaft coupled to and between the drive turbine and the pump portion, wherein the drive turbine is to drive the pump portion via the driveshaft; and the thrust bearing circumferentially disposed around the driveshaft and between the drive turbine and the pump portion;

wherein the housing at least partially encompasses the driveshaft and the thrust bearing.

3. The heat engine system of claim 1, wherein the bearing fluid comprises carbon dioxide.

4. The heat engine system of claim 1, wherein the bearing fluid comprises a portion of the working fluid.

5. The heat engine system of claim 4, wherein the bearing fluid and the working fluid comprise carbon dioxide.

6. The heat engine system of claim 1, wherein the thrust bearing comprises:

a cylindrical body having a central axis and containing an inner portion and an outer portion aligned with the central axis;

the pump-side thrust face comprising a plurality of pump-side bearing pockets extending below the pump-side thrust face and facing the pump portion;

the turbine-side thrust face comprising a plurality of turbine-side bearing pockets extending below the turbine-side thrust face and facing the drive turbine;

a circumferential side surface extending along the circumference of the cylindrical body and between the pump-side thrust face and the turbine-side thrust face; and a central orifice defined by and extending through the cylindrical body along the central axis to provide passage of the driveshaft therethrough.

7. The heat engine system of claim 6, wherein the plurality of pump-side bearing pockets contains from about 2 bearing pockets to about 12 bearing pockets and the plurality of turbine-side bearing pockets contains from about 2 bearing pockets to about 12 bearing pockets.

8. A turbopump system for circulating or pressurizing a working fluid within a working fluid circuit, comprising:

a turbopump including a housing and a thrust bearing having two opposing sides;

a bearing fluid supply line fluidly coupled to the housing to provide a bearing fluid into the housing;

a bearing fluid drain line fluidly coupled to the housing to remove the bearing fluid from the housing;

a turbopump back-pressure regulator valve fluidly coupled to the bearing fluid drain line to control flow through the bearing fluid drain line and control an applied pressure on the thrust bearing, the turbopump back-pressure regulator valve adjusted to maintain proper pressures within a plurality of_bearing pockets disposed on the two opposing surfaces of the thrust bearing; and a process control system operatively connected to the turbopump back-pressure regulator valve to adjust the turbopump back-pressure regulator valve with a control algorithm embedded in a computer system and also to monitor and adjust pocket pressure ratios, the process control system including embedded therein:

a primary governing loop controller to control the turbopump back-pressure regulator valve and to modulate the turbopump back-pressure regulator valve while adjusting a pump-side pocket pressure ratio (P2), wherein the turbopump back-pressure regulator valve is disposed downstream of the thrust bearing of the turbopump;

a secondary governing loop controller to control the turbopump back-pressure regulator valve and to modulate the turbopump back-pressure regulator valve while adjusting a turbine-side pocket pressure ratio (P1); and a tertiary governing loop controller to control the turbopump back-pressure regulator valve and to modulate the turbopump back-pressure regulator valve while adjusting a bearing fluid supply pressure to be at or greater than a critical pressure value for the bearing fluid to maintain the bearing fluid in a supercritical state;

wherein:

P1 equals the pocket pressure on a turbine-side thrust face in a turbine-side bearing pocket minus a drain pressure of the bearing fluid divided by a supply pressure of the bearing fluid minus the drain pressure of the bearing fluid; and P2 equals the pocket pressure on a pump-side thrust face in a pump side bearing pocket minus the drain pressure of the bearing fluid divided by the supply pressure of the bearing fluid minus the drain pressure of the bearing fluid.

9. The turbopump system of claim 8, the turbopump further including:

a drive turbine to convert a pressure drop in the working fluid to mechanical energy;

a pump portion to circulate or pressurize the working fluid within the working fluid circuit;

a driveshaft coupled to and between the drive turbine and the pump portion, wherein the drive turbine is to drive the pump portion via the driveshaft;

wherein:

the housing at least partially encompasses the driveshaft and the thrust bearing, the thrust bearing is circumferentially disposed around the driveshaft and between the drive turbine and the pump portion, and the thrust bearing further comprises:

a cylindrical body having a central axis and containing an inner portion and an outer portion aligned with the central axis;

the pump-side thrust face comprising a plurality of pump-side bearing pockets extending below the pump-side thrust face and facing the pump portion, the pump-side bearing pockets comprising a portion of the bearing pockets;

the turbine-side thrust face comprising a plurality of turbine-side bearing pockets extending below the turbine-side thrust face and facing the drive turbine, the turbine-side bearing pockets comprising a portion of the bearing pockets;

a circumferential side surface extending along the circumference of the cylindrical body and between the pump-side thrust face and the turbine-side thrust face; and a central orifice defined by and extending through the cylindrical body along the central axis to provide passage of the driveshaft therethrough.

10. The turbopump system of claim 8, wherein the-turbopump includes a housing and the turbopump system further comprises:

a bearing fluid supply manifold disposed on or in a housing of the turbopump to receive the incoming bearing fluid or gas and to distribute to one or more multiple bearing supply pressure lines; and a bearing fluid drain manifold disposed on or in the housing to flow bearing drain fluid through a bearing fluid drain outlet and to the bearing fluid drain line.

11. The turbopump system of claim 8, wherein the plurality of pump-side bearing pockets contains from about 2 bearing pockets to about 12 bearing pockets and the plurality of turbine-side bearing pockets contains from about 2 bearing pockets to about 12 bearing pockets.

12. The turbopump system of claim 8, wherein the bearing fluid comprises carbon dioxide.

13. The turbopump system of claim 8, wherein the bearing fluid comprises a portion of the working fluid.

14. The turbopump system of claim 13, wherein the bearing fluid and the working fluid comprise carbon dioxide.

15. A method for use in lubricating a turbopump in a heat engine system, comprising:

monitoring a turbine-side pocket pressure ratio (P1), a pump-side pocket pressure ratio (P2), a bearing fluid supply pressure, and a bearing fluid drain pressure of a circulating working fluid in a working fluid circuit via a process control system operatively coupled to the working fluid circuit, wherein:

at least a portion of the working fluid is in a supercritical state;

P1 equals a pocket pressure on a turbine-side thrust face in a turbine-side bearing pocket minus the drain pressure of the bearing fluid divided by the supply pressure of the bearing fluid minus the drain pressure of the bearing fluid;

P2 equals a pocket pressure on a pump-side thrust face in a pump side bearing pocket minus the drain pressure of the bearing fluid divided by the supply pressure of the bearing fluid minus the drain pressure of the bearing fluid, and the turbine-side pocket pressure ratio (P1) is monitored in at least one turbine-side bearing pocket of a plurality of turbine-side bearing pockets disposed on the turbine-side thrust face of a thrust bearing within the turbopump, the pump-side pocket pressure ratio (P2) is monitored in at least one pump-side bearing pocket of a plurality of pump-side bearing pockets disposed on the pump-side thrust face of the thrust bearing, the bearing fluid supply pressure is monitored in at least one bearing supply pressure line disposed upstream of the thrust bearing, and the bearing fluid drain pressure is monitored in at least one bearing drain pressure line disposed downstream of the thrust bearing;

controlling a turbopump back-pressure regulator valve by a primary governing loop controller embedded in the process control system, wherein the turbopump back-pressure regulator valve is fluidly coupled to a bearing fluid drain line disposed downstream of the thrust bearing and the primary governing loop controller is to modulate the turbopump back-pressure regulator valve while adjusting the pump-side pocket pressure ratio (P2);

controlling the turbopump back-pressure regulator valve by a secondary governing loop controller embedded in the process control system, wherein the secondary governing loop controller is to modulate the turbopump back-pressure regulator valve while adjusting the turbine-side pocket pressure ratio (P1); and controlling the turbopump back-pressure regulator valve by a tertiary governing loop controller embedded in the process control system, wherein the tertiary governing loop controller is to modulate the turbopump back-pressure regulator valve while adjusting the bearing fluid supply pressure to be at or greater than a critical pressure value for the bearing fluid and maintain the bearing fluid in a supercritical state.

16. The method of claim 15, further comprising adjusting the pump-side pocket pressure ratio (P2) by modulating the turbopump back-pressure regulator valve with the primary governing loop controller to obtain or maintain a pump-side pocket pressure ratio (P2) of about 0.25 or less.

17. The method of claim 15, further comprising adjusting the turbine-side pocket pressure ratio (P1) by modulating the turbopump back-pressure regulator valve with the secondary governing loop controller to obtain or maintain a turbine-side pocket pressure ratio (P1) of about 0.25 or greater.

18. The method of claim 15, further comprising adjusting the turbopump back-pressure regulator valve with the tertiary governing loop controller to obtain or maintain the bearing drain pressure of about 1,055 psi or greater.

19. The method of claim 15, wherein each of the primary governing loop controller, the secondary governing loop controller, and the tertiary governing loop controller is independently a system controller selected from the group consisting of a sliding mode controller, a pressure mode controller, a multi-mode controller, and combinations thereof.

20. The method of claim 15, further comprising regulating and maintaining the bearing fluid in contact with the thrust bearing to be in a supercritical state.

21. The method of claim 15, further comprising modulating the turbopump back-pressure regulator valve to control the flow of the bearing fluid passing through the bearing fluid drain line, wherein the turbopump back-pressure regulator valve is adjusted to partially opened-positions that are within a range from about 35% to about 80% of being in a fully opened-position.

22. A turbopump system, comprising:

a working fluid circuit having a high pressure side and a low pressure side;

a turbopump to circulate a working fluid through the working fluid circuit, at least a portion of the working fluid to be circulated in a supercritical state, the turbopump including a thrust bearing;

a heat source stream;

a heat exchanger to transfer thermal energy to the working fluid from the heat source stream in the high pressure side of the working circuit;

a process control system to monitor a turbine-side pocket pressure ratio (P1), a pump-side pocket pressure ratio (P2), a bearing fluid supply pressure, and a bearing fluid drain pressure via a process control system operatively coupled to the working fluid circuit, wherein:

P1 equals the pocket pressure on a turbine-side thrust face in the turbine-side bearing pocket minus the drain pressure of the bearing fluid divided by the supply pressure of the bearing fluid minus the drain pressure of the bearing fluid; and P2 equals a pocket pressure on a pump-side thrust face in a pump side pump side bearing pocket minus the drain pressure of the bearing fluid divided by the supply pressure of the bearing fluid minus the drain pressure of the bearing fluid, and the process control system including embedded therein:

a primary governing loop controller to control a turbopump back-pressure regulator valve and to modulate the turbopump back-pressure regulator valve while adjusting the pump-side pocket pressure ratio (P2), wherein the turbopump back-pressure regulator valve is fluidly coupled to a bearing fluid drain line disposed downstream of the thrust bearing of the turbopump;

a secondary governing loop controller to control the turbopump back-pressure regulator valve and to modulate the turbopump back-pressure regulator valve while adjusting the turbine-side pocket pressure ratio (P1); and a tertiary governing loop controller to control the turbopump back-pressure regulator valve and to modulate the turbopump back-pressure regulator valve while adjusting the bearing fluid supply pressure to be at or greater than a critical pressure value for the bearing fluid to maintain the bearing fluid in a supercritical state.

23. The turbopump system of claim 22, wherein each of the primary governing loop controller, the secondary governing loop controller, and the tertiary governing loop controller is independently a system controller selected from the group consisting of a sliding mode controller, a pressure mode controller, a multi-mode controller, and combinations thereof.

24. The turbopump system of claim 22, wherein the turbopump includes:

a drive turbine disposed between the high and low pressure sides;

a pump portion disposed between the high and low pressure sides;

a driveshaft coupled to and between the drive turbine and the pump portion, wherein the drive turbine is to drive the pump portion via the driveshaft;

the thrust bearing, the thrust bearing circumferentially disposed around the driveshaft and between the drive turbine and the pump portion; and a housing at least partially encompassing the driveshaft and the thrust bearing.

25. The turbopump system of claim 22, further comprising:

an expander fluidly coupled to the working fluid circuit, disposed between the high pressure side and the low pressure side of the working fluid circuit, the expander to convert a pressure drop in the working fluid to mechanical energy;

a rotating shaft coupled to the expander to drive a device with the mechanical energy;

a recuperator fluidly coupled to the working fluid circuit to transfer thermal energy from the working fluid in the low pressure side to the working fluid in the high pressure side; and a start pump fluidly coupled to the working fluid circuit, disposed between the low pressure side and the high pressure side to circulate or pressurize the working fluid within the working fluid circuit.

26. The turbopump system of claim 25 wherein the turbopump further comprises a housing and the turbopump system further comprises:

a bearing fluid supply manifold disposed on or in the housing to receive incoming bearing fluid or gas and distribute to one or more multiple bearing supply pressure lines;

a bearing fluid drain manifold disposed on or in the housing to flow bearing drain fluid through a bearing fluid drain outlet and to a bearing fluid drain line.

* * * * *